US009840081B2

(12) United States Patent
Mokhamad et al.

(10) Patent No.: US 9,840,081 B2
(45) Date of Patent: Dec. 12, 2017

(54) LIQUID SUPPLY DEVICE AND INK-JET PRINTER

(71) Applicant: SEIKO EPSON CORPORATION, Tokyo (JP)

(72) Inventors: Syarif Mokhamad, Cikarang Selatan (ID); Dian Herdiansyah, Cikarang Selatan (ID)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/215,172

(22) Filed: Jul. 20, 2016

(65) Prior Publication Data

US 2016/0325551 A1 Nov. 10, 2016

Related U.S. Application Data

(63) Continuation of application No. 14/598,351, filed on Jan. 16, 2015, now Pat. No. 9,421,779.

(30) Foreign Application Priority Data

Jan. 20, 2014 (JP) ..... 2014-007516

(51) Int. Cl.

| | |
|---|---|
| ***B41J 2/175*** | (2006.01) |
| ***B41J 29/02*** | (2006.01) |
| ***B41J 29/13*** | (2006.01) |

(52) U.S. Cl.

CPC ..... *B41J 2/17513* (2013.01); *B41J 2/175* (2013.01); *B41J 2/1752* (2013.01); *B41J 2/17509* (2013.01); *B41J 2/17523* (2013.01); *B41J 2/17553* (2013.01); *B41J 29/02* (2013.01); *B41J 29/13* (2013.01)

(58) Field of Classification Search

CPC .. B41J 2/17513; B41J 2/17523; B41J 2/1752; B41J 2/17509; B41J 29/13; B41J 2/17553; B41J 29/02; B41J 2/175

See application file for complete search history.

(56) References Cited

U.S. PATENT DOCUMENTS

| | | | |
|---|---|---|---|
| 4,870,431 | A | 9/1989 | Sousa et al. |
| 5,489,925 | A | 2/1996 | Brooks et al. |

(Continued)

FOREIGN PATENT DOCUMENTS

| | | | |
|---|---|---|---|
| JP | 2012-051307 | A | 3/2012 |
| JP | 2012-071581 | A | 4/2012 |

*Primary Examiner* — Manish S Shah
*Assistant Examiner* — Yaovi M Ameh
(74) *Attorney, Agent, or Firm* — Global IP Counselors, LLP

(57) ABSTRACT

A liquid supply device is adapted to supply liquid to a liquid ejection section configured and arranged eject the liquid. The liquid storing device includes a plurality of liquid storage sections and a plurality of tubes. The liquid storage sections are configured and arranged to store the liquid. The tubes are connected to the liquid storage sections so that the liquid stored in the liquid storage sections flows out through the tubes. At least one of the tubes is respectively connected to a corresponding one of the liquid storage sections. At least one of the liquid storage sections includes a support section supporting at least two of the tubes in a state in which the at least two of the tubes are aligned in a direction perpendicular to one surface of the at least one of the liquid storage sections.

14 Claims, 73 Drawing Sheets

(56) References Cited

U.S. PATENT DOCUMENTS

| | | | | |
|---|---|---|---|---|
| 9,470,347 | B1 * | 10/2016 | Peirce | F16L 19/10 |
| 2001/0026304 | A1 * | 10/2001 | Matsuzaki | B41J 2/17503 347/85 |
| 2005/0275699 | A1 | 12/2005 | Sasaki | |
| 2008/0007605 | A1 | 1/2008 | Sakurai et al. | |
| 2012/0038719 | A1 | 2/2012 | Shimizu et al. | |
| 2012/0056949 | A1 * | 3/2012 | Ishizawa | B41J 2/175 347/85 |
| 2012/0182364 | A1 | 7/2012 | Takeda et al. | |

* cited by examiner

LIQUID SUPPLY DEVICE AND INK-JET PRINTER

CROSS-REFERENCE TO RELATED APPLICATIONS

This is a continuation application of U.S. patent application Ser. No. 14/598,351, filed on Jan. 16, 2015. This application claims priority to Japanese Patent Application No. 2014-007516 filed on Jan. 20, 2014. The entire disclosures of U.S. patent application Ser. No. 14/598,351 and Japanese Patent Application No. 2014-007516 are hereby incorporated herein by reference.

BACKGROUND

Technical Field

The present invention relates to a liquid supply device and an ink-jet printer.

Related Art

Conventionally, as an example of a liquid ejection device, an ink-jet printer is known. In the ink jet printer, it is possible to perform printing on a print medium by ejecting ink as an example of liquid from an ejection head to the print medium such as print paper. Some liquid ejection devices are known to provide a liquid supply device in which ink stored in a tank (ink storage section) as an example of a liquid storing container is supplied to an ejection head (print head) via a tube (hose). As the liquid supply device, conventionally, a structure in which ink stored in a tank (ink storage section) is supplied to an ejection head (print head) via a tube (hose) is known (see Japanese Unexamined Patent Application Publication No. 2012-71581, for example). Also, for the liquid device with the liquid ejection device, when supplying ink to a tank, it is known that a posture (hereinafter a using posture) of the tank when using the liquid ejection device is inclined to a posture (hereinafter an injecting posture) of the tank for injecting the ink to the tank (for example, see Japanese Unexamined Patent Application Publication No. 2012-51307). Hereinafter, a structure in which the liquid ejection device is equipped with the liquid supply device may sometimes be denoted as a liquid ejection system.

SUMMARY

A liquid supply device according to one aspect is adapted to supply liquid to a liquid ejection section configured and arranged eject the liquid. The liquid storing device includes a plurality of liquid storage sections and a plurality of tubes. The liquid storage sections are configured and arranged to store the liquid. The tubes are connected to the liquid storage sections so that the liquid stored in the liquid storage sections flows out through the tubes. At least one of the tubes is respectively connected to a corresponding one of the liquid storage sections. At least one of the liquid storage sections includes a support section supporting at least two of the tubes in a state in which the at least two of the tubes are aligned in a direction perpendicular to one surface of the at least one of the liquid storage sections.

BRIEF DESCRIPTION OF THE DRAWINGS

Referring now to the attached drawings which form a part of this original disclosure.

DETAILED DESCRIPTION OF EXEMPLARY EMBODIMENTS

Embodiments of the liquid ejection system, as an example, with the ink-jet printer (hereinafter printer), as an example of the liquid ejection device, will be described with reference to the drawings. In each of the drawings, the scale of the arrangements and parts may be different because each of the figures is shown to be large enough to recognize each of the arrangements.

First Embodiment

Figure 1:
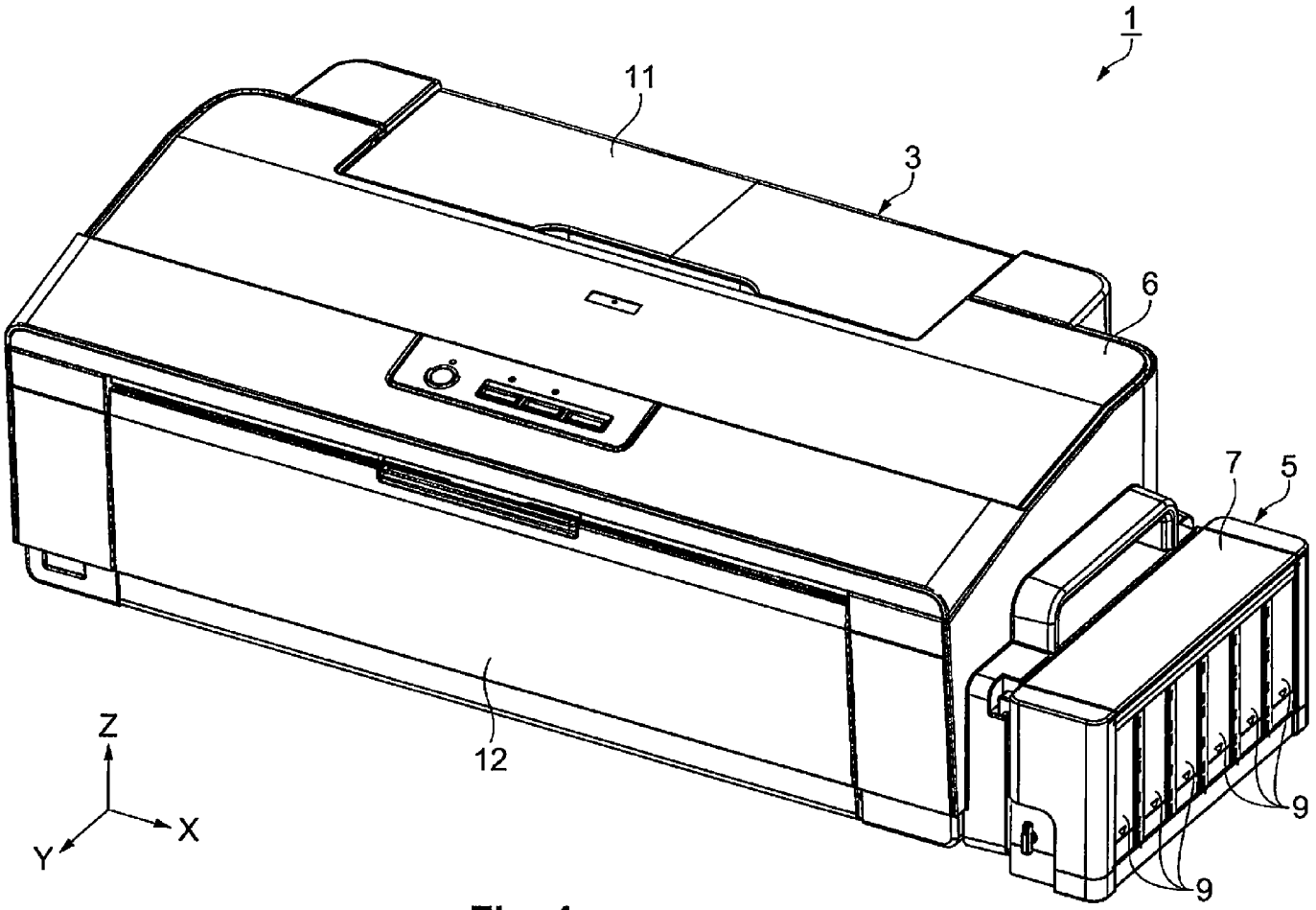
FIG. 1 is a perspective view showing a liquid ejection system of the present embodiment.

The liquid ejection system 1 of the first embodiment is, as shown in FIG. 1, provided with a printer 3, as an example of the liquid ejection device, and an ink supply device 5 as an example of the liquid supply device. The printer 3 includes a printer case 6. The printer case 6 constitutes an outer shell of the printer 3. The ink supply device 5 includes a tank case 7 and a plurality of (at least two) tanks 9. The printer case 6 and the tank case 7 constitute an outer shell of the liquid ejection system 1. The tank 9 is an example of a liquid storing container.

FIG. 1 includes XYZ axes as a coordinate system in which they intersect perpendicular to each other. Hereinafter, the XYZ axes are shown in figures, if necessary. A direction of an arrow shows a +direction (positive direction) for each of the XYZ axes, and the other direction shows a −direction (negative direction). When the liquid ejection system 1 is in use, the liquid ejection system 1 is provided on a horizontal plane made by the X and Y axes. When the liquid ejection system 1 is in use, the Z axis is an axis intersecting perpendicularly to the horizontal plane, where a −Z direction is a vertically-down direction.

Figure 2:
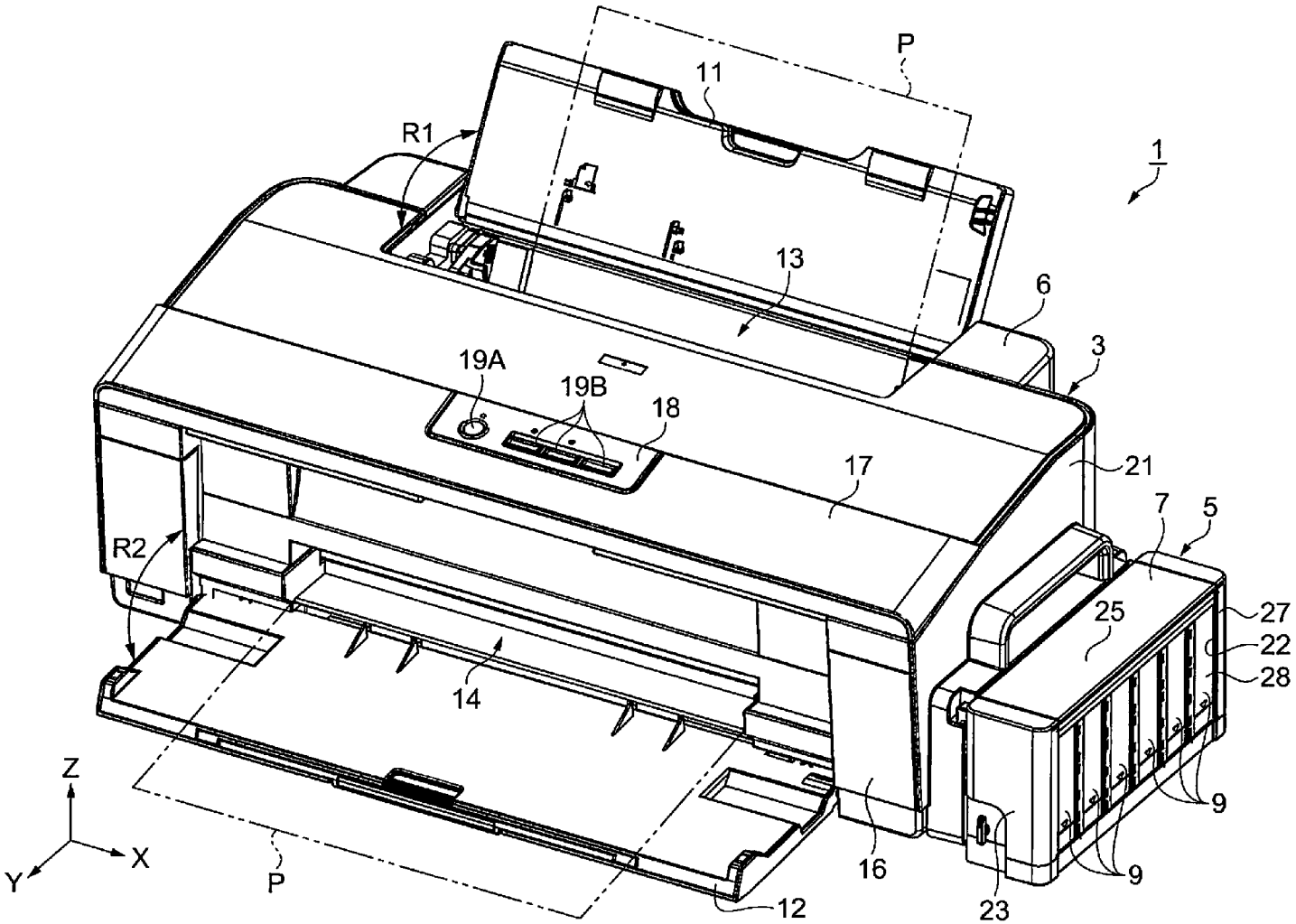
FIG. 2 is a perspective view showing the liquid ejection system of the present embodiment.

The printer case 6 includes a paper feed cover 11 and a paper ejection cover 12. The paper feed cover 11, as shown in FIG. 2, is arranged rotatable in an R1 direction in the figure with respect to the printer case 6. With this, the paper feed cover 11 is arranged openable/closable with respect to the printer case 6. When the paper feed cover 11 is in a state of being open with respect to the printer case 6 (hereinafter referred to as "open state"), it becomes a state in which a print medium P such as print paper is fed to the printer 3 from the paper feeding section 13. Also, the paper ejection cover 12 is arranged rotatable in an R2 direction in the figure with respect to the printer case 6. With this, the paper ejection cover 12 is arranged openable/closable with respect to the printer case 6. When the paper ejection cover 12 is in a state of being open with respect to the printer case 6, it becomes a state in which the print medium P is discharged from the paper discharge section 14 to the outside of the printer 3. In FIG. 2, the open states of the paper feed cover 11 and the paper ejection cover 12 are shown. On the other hand, in FIG. 1, close states of paper feed cover 11 and the paper ejection cover 12 are shown.

A mechanism unit 15 (FIG. 4) of the printer 3 is stored in the printer case 6. The mechanism unit 15 is a mechanism part which performs printing at the printer 3. The details of the mechanism unit 15 will be described hereinafter. The plurality of tanks 9 are stored in the tank case 7 as shown in FIG. 1, and each of them stores the ink for printing. In the liquid ejection system 1, the plurality of tanks 9 are provided outside the printer case 6. For this reason, in the liquid ejection system 1, the plurality of tanks 9 are not stored in the printer case 6 which covers the mechanism unit 15.

For the printer 3, a surface on which the paper discharge section 14 (FIG. 2) is provided is a front surface 16. Also, the printer 3 includes a control panel 18 on an upper surface 17 which intersects with a front surface 16. On the control panel 18, a power button 19A, other control button 19B, and the like are provided. In the printer case 6, the ink supply device 5 is provided on a side part 21 which intersects the front surface 16 and the upper surface 17. A window part 22 is provided on the tank case 7. On the tank case 7, the window part 22 is provided on a side part 27 which intersects with the front surface 23 and the upper surface 25. The window part 22 includes a light permeability. The plurality of tanks 9 are provided at a place to overlap with the window part 22. For this reason, an operator who uses the liquid ejection system 1 can see the plurality of tanks 9 via the window part 22. The surface overlapping the window part 22 at each of the tanks 9 is set to be a visible surface 28 through which the ink in the tank 9 is visible. The remaining amount of the ink in the tank 9 can be seen through the visible surface 28.

Figure 3:
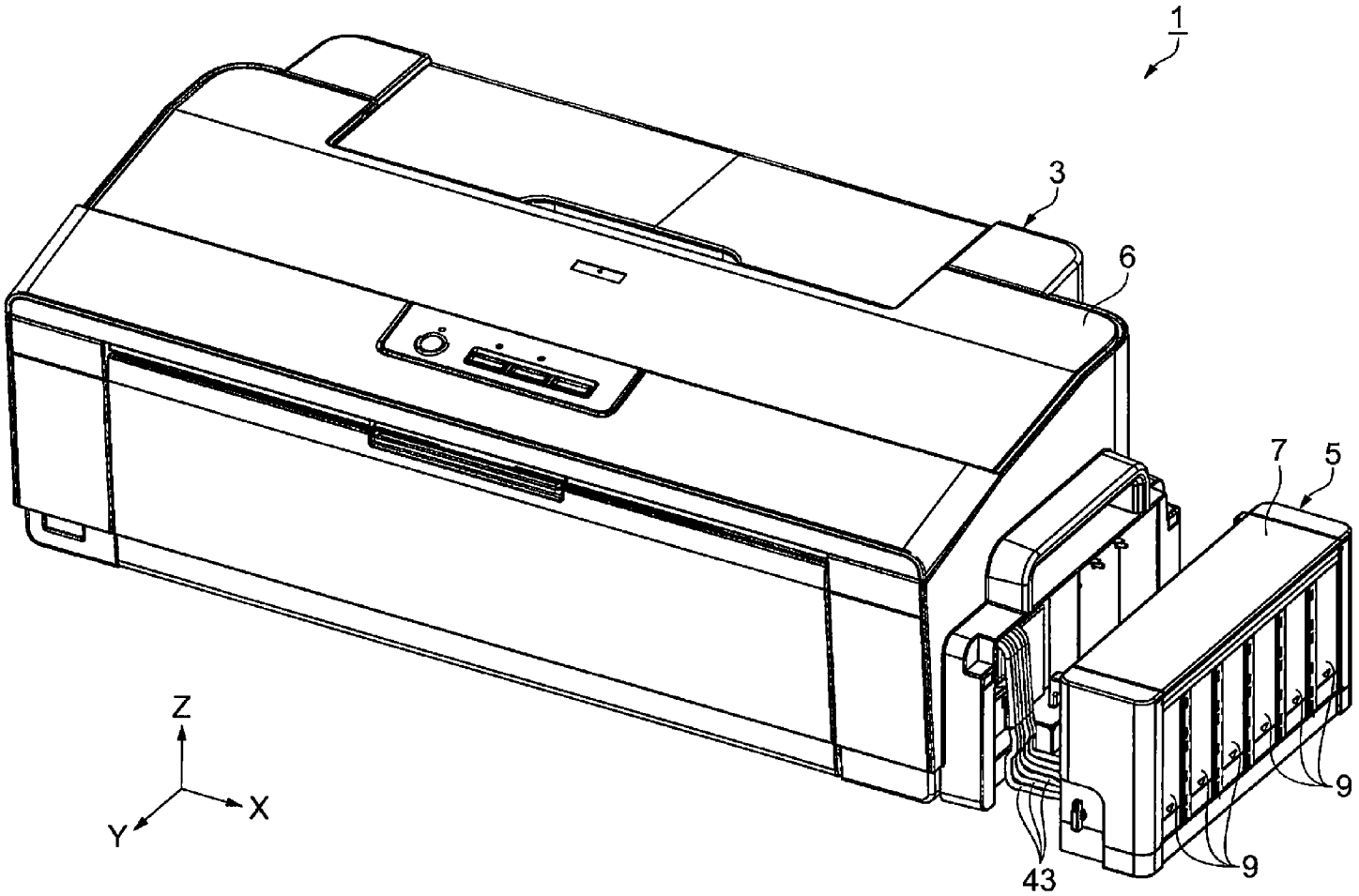
FIG. 3 is a perspective view showing the liquid ejection system of the present embodiment.

In the present embodiment, a part of each of the tanks 9 facing the window part 22 possesses light permeability. From the part of each of the tanks 9 having the light permeability, the ink in the tank 9 can be seen. Therefore, an operator can see the plurality of tanks 9 via the window part 22, and therefore can see the ink amount of each of the tanks 9. The printer case 6 and the tank case 7 are provided mutually independent to each other. And in the present embodiment, as shown in FIG. 3, the tank case 7 is detachable from and attachable to the printer case 6 with the plurality of tanks 9 accommodated therein.

Figure 4:
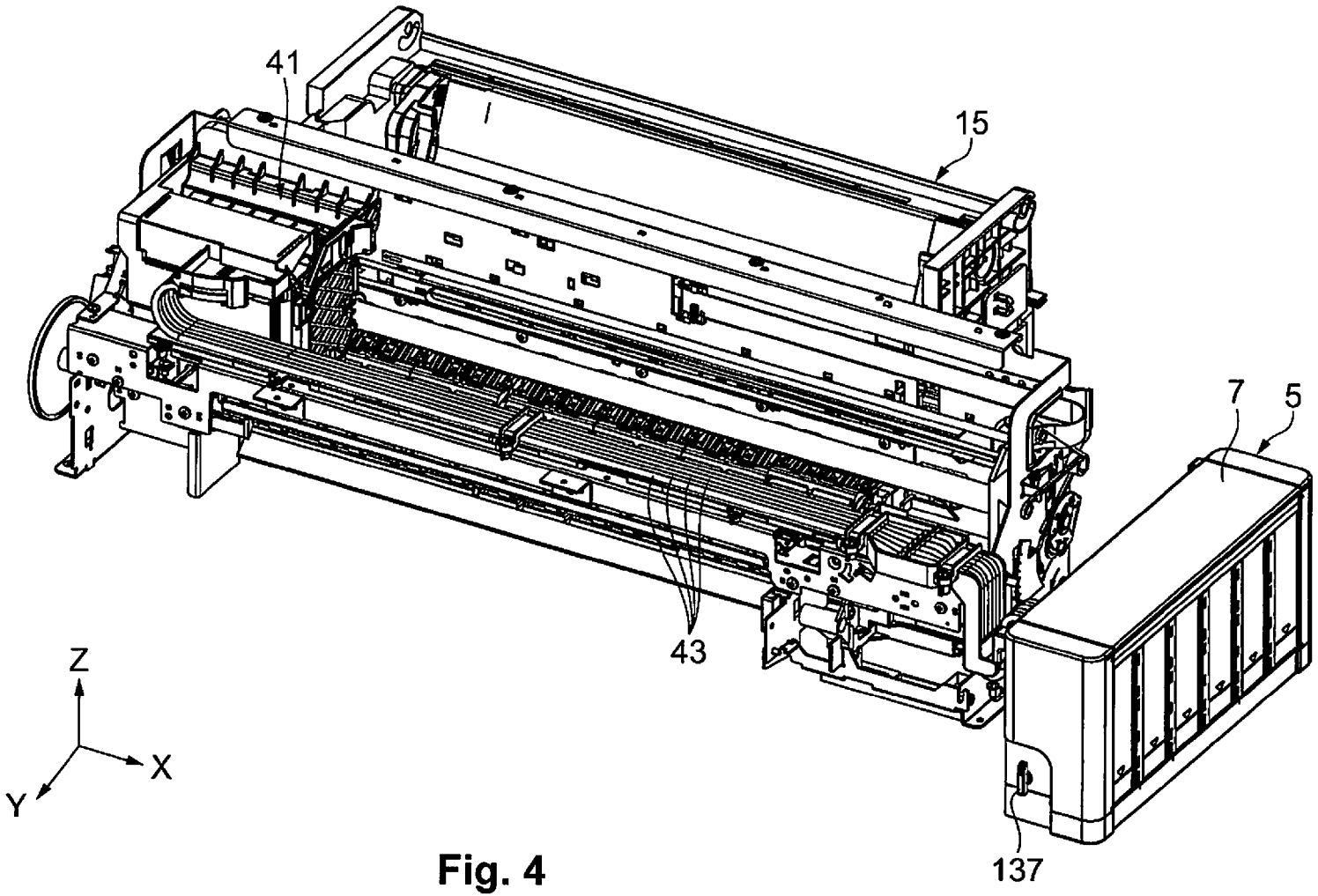
FIG. 4 is a perspective view showing a mechanism unit and an ink supply device of the present embodiment.
Figure 5:
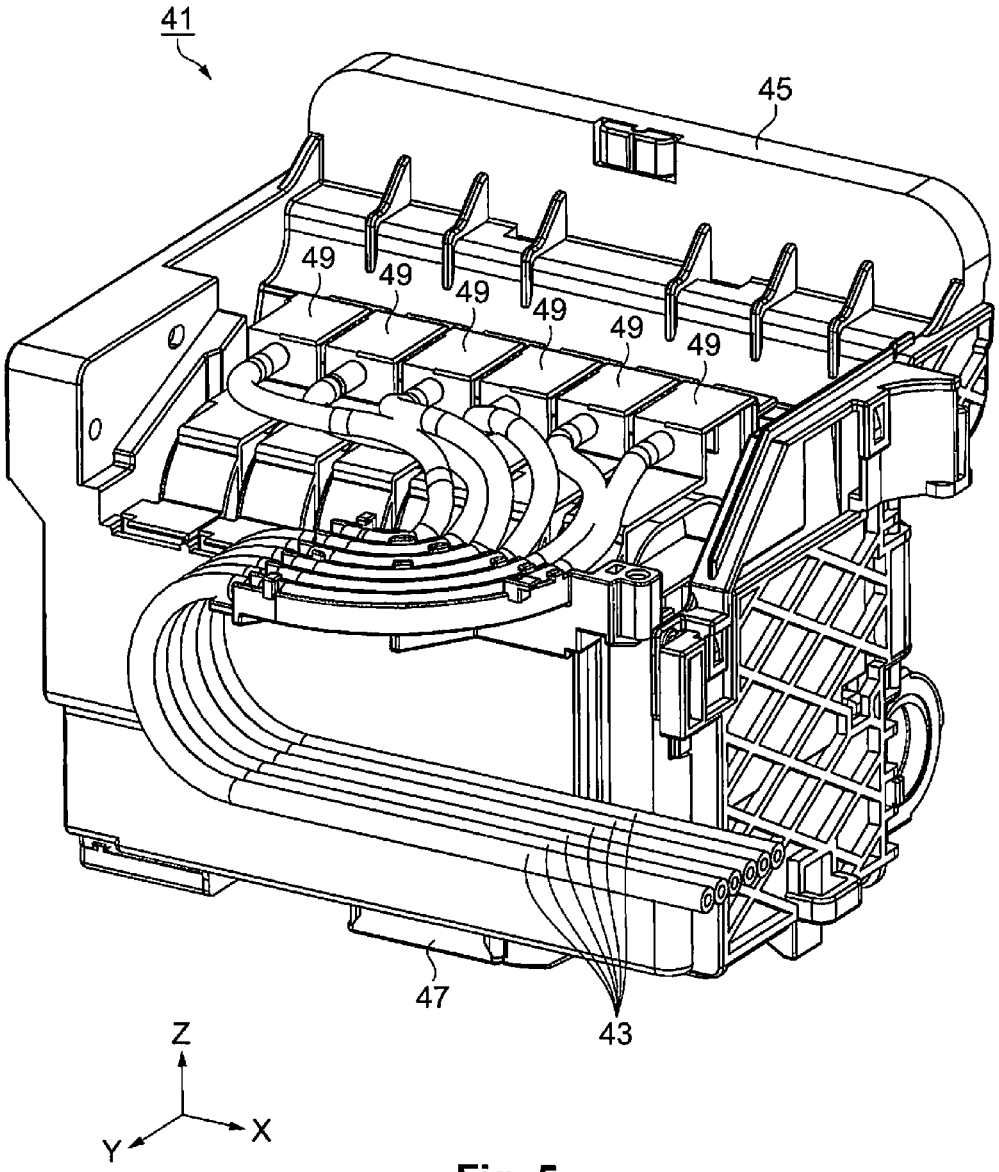
FIG. 5 is a perspective view showing a print section of the present embodiment.

The mechanism unit 15 of the printer 3, as shown in FIG. 4 which is a perspective view showing the mechanism unit 15 and the supply device 5, includes a print section 41. Also, the ink supply device 5 includes a supply tube 43. The print section 41, as shown in FIG. 5, includes a carriage 45, a print head 47 as an example of the liquid ejection section, and a plurality of relay units 49. The print head 47 and the plurality of relay units 49 are provided on the carriage 45. The supply tube 43 has elasticity and is provided between the tank 9 (FIG. 4) and the relay unit 49. The ink in the tank 9 is transferred to the relay unit 49 (FIG. 5) via the supply tube 43. The relay unit 49 relays the ink, which has been supplied from the tank 9 via the supply tube 43, to the print head 47. The print head 47 jets the ink having been supplied as ink droplets.

Further, the liquid ejection system 1 includes a control section (not shown in figures), a medium conveyance mechanism (not shown in figures), and head conveyance mechanism (not shown in figures). The control section controls movement of the liquid ejection system 1. The movement of the liquid ejection system 1 is controlled by the control section. On the basis of instructions from the control section, the medium conveyance mechanism transfers the print medium P in the Y axis direction by driving the medium conveyance mechanism by the drive from the motor (not shown in figures). On the basis of instructions from the control section, the head conveyance mechanism transfers the carriage 45 along the X axis by transmitting the drive from the motor (not shown in figures) via a timing belt (not shown in figures). The print head 47 is provided on the carriage 45. For this reason, the print head 47 can be transferred along the X axis via the carriage 45. The print head 47 is supported by the carriage 45 in a state of facing the print medium P. By the medium conveyance mechanism and the head conveyance mechanism, by changing the relative position of the print head 47 with respect to the print medium P, printing is performed on the print medium by ejecting the ink from the print head 47.

In the liquid ejection system 1, an ink inlet section (described later) is provided in each of the tanks 9. The operator or a user can inject the ink in the tank 9 from the ink inlet section. For example, when the ink in the tank 9 is consumed by printing, and the ink amount in the tank 9 is decreased, the user or the operator can refill the ink in the tank 9 from the ink inlet section. The ink inlet section is stored inside the tank case 7, and is covered by the tank case 7 and the printer case 6. For this reason, in a state (state which is shown in FIG. 1) in which the tank case 7 and the printer case 6 are equipped, the user or the operator cannot see the ink inlet section.

Figure 6:
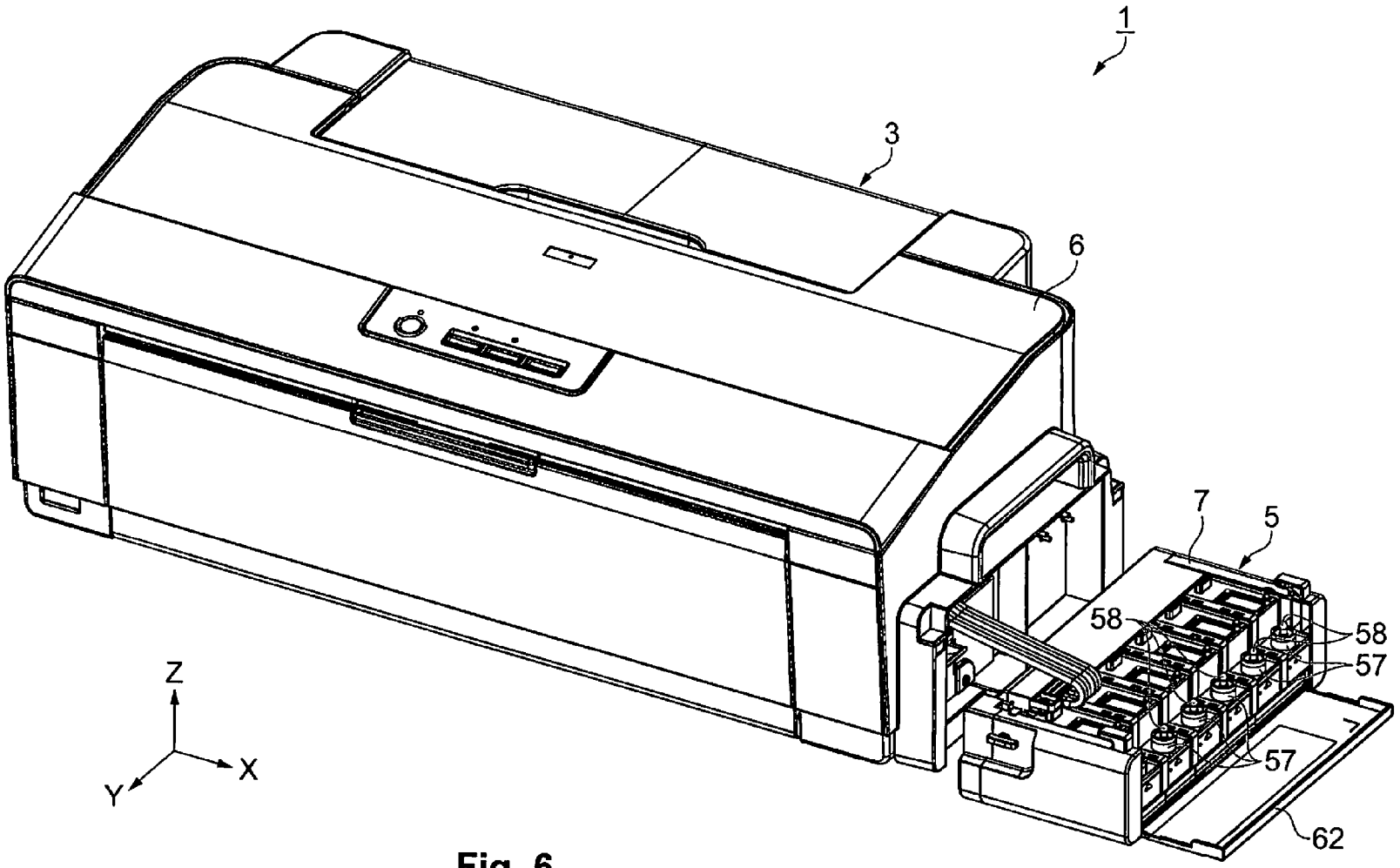
FIG. 6 is a perspective view showing the liquid ejection system of the present embodiment.

By removing the tank case 7 from the printer case 6, and overturning the tank case 7 to the side with respect to the printer case 6 and being in an open state by rotating an upper panel 62, the ink inlet section 57, as shown in FIG. 6, is exposed from the tank case 7. The upper panel 62 constitutes the upper surface 25 when the tank case 7 is in the posture shown in FIG. 1. The ink inlet section 57 is provided with a cap 58. The ink inlet section 57 is closed with the cap 58. The user or the operator injects the ink in the tank 9 after removing the cap 58 from the ink inlet section 57, when the injecting the ink in the tank 9.

When overturning the tank case 7 to the side as shown in FIG. 6, the window part 22 (FIG. 1) of the tank case 7 is oriented in the −Z axis direction. When the window part 22 of the tank case 7 is in a state of being oriented in the −Z axis direction, the visible surface 28 (FIG. 1) of the tank 9 is also oriented in the −Z axis direction. The posture of the visible surface 28 of the tank 9 being oriented in the −Z axis direction is denoted as an injecting posture. In the present embodiment, with the injecting posture, the ink inlet section 57 is oriented to the +Z axis direction, as shown in FIG. 6. On the other hand, a posture with which the visible surface 28 of the tank 9 is oriented in a direction intersecting with the Z axis (for example, the X axis or the Y axis shown in FIG. 1) is denoted as a using posture. In the present embodiment, with the using posture shown in FIG. 1, the ink inlet section 57 is oriented in the −X axis direction.

EXAMPLE 1

Figure 7:
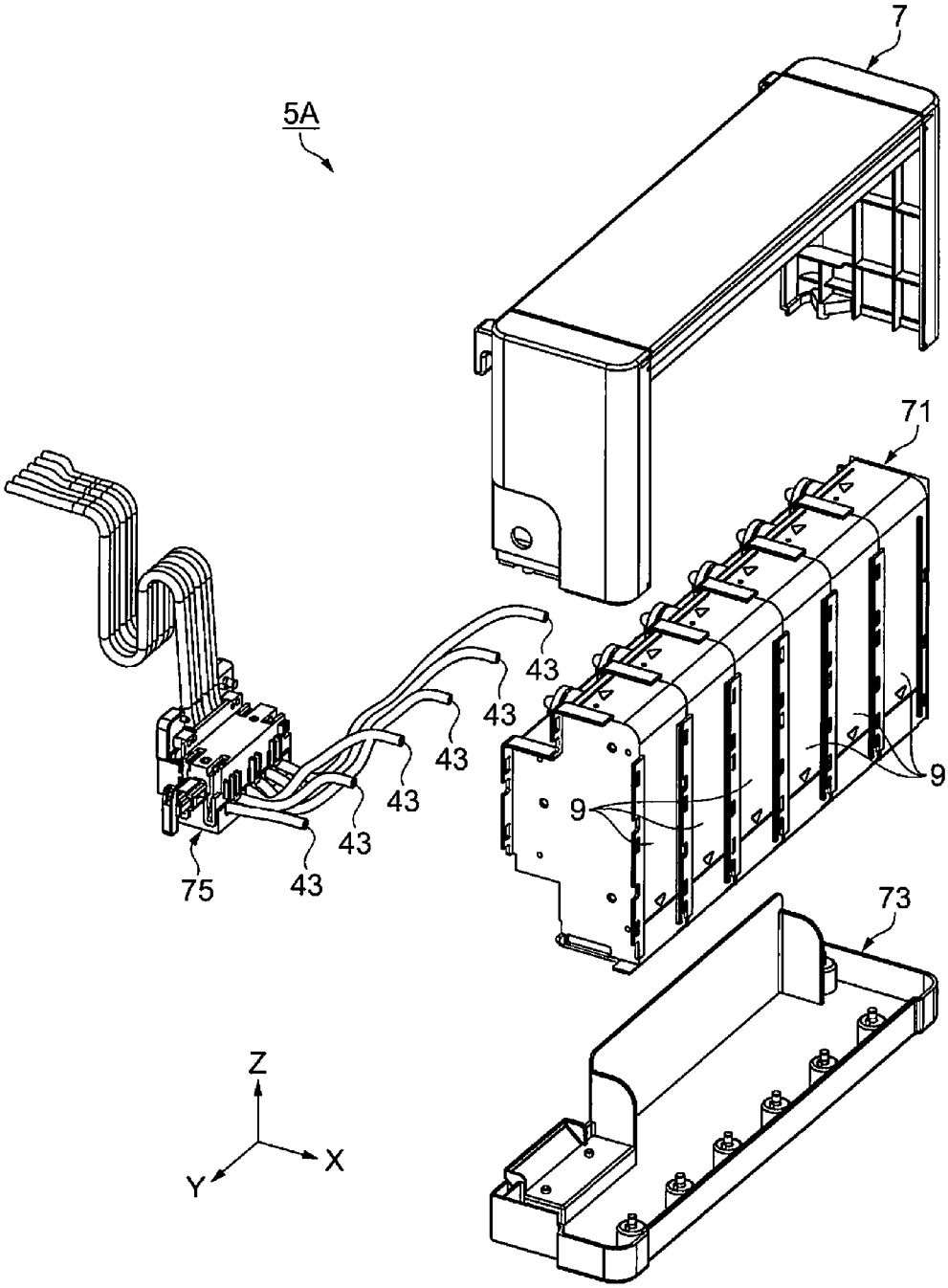
FIG. 7 is an exploded perspective view showing the ink supply device of Example 1.

An ink supply device 5A of Example 1 will be described. The ink supply device 5A of Example 1, as shown in FIG. 7, includes the tank case 7, a plurality of supply tubes 43, a tank unit 71, a support frame 73, and a flow passage opening/closing device 75. The tank unit 71 includes the plurality of tanks 9 being mutually connected. In the ink supply device 5A of Example 1, the tank unit 71 includes six of the tanks 9.

For the tank unit 71 shown in FIG. 7, a kind of the ink is different for each of the tanks 9. For the ink supply device 5A, the kinds of the inks include six kinds being black, yellow, magenta, cyan, light magenta, and light cyan. And the tank 9 storing the black ink, the tank 9 storing the yellow ink, the tank 9 storing the magenta ink, the tank 9 storing the cyan ink, the tank 9 storing the light magenta ink, and the tank 9 storing the light cyan ink are provided.

The supply tube 43 is provided for each of the tank 9. For this reason, in the ink supply device 5A, there are six of the supply tubes 43 being provided. The tank unit 71 is supported by the support frame 73. On the tank unit 71, each of the tanks 9 is secured on the support frame 73 by screws. Also, the tank case 7 is also secured on the support frame 73 by screws. And the tank unit 71 is stored in an area surrounded by the support frame 73 and the tank case 7.

Figure 8:
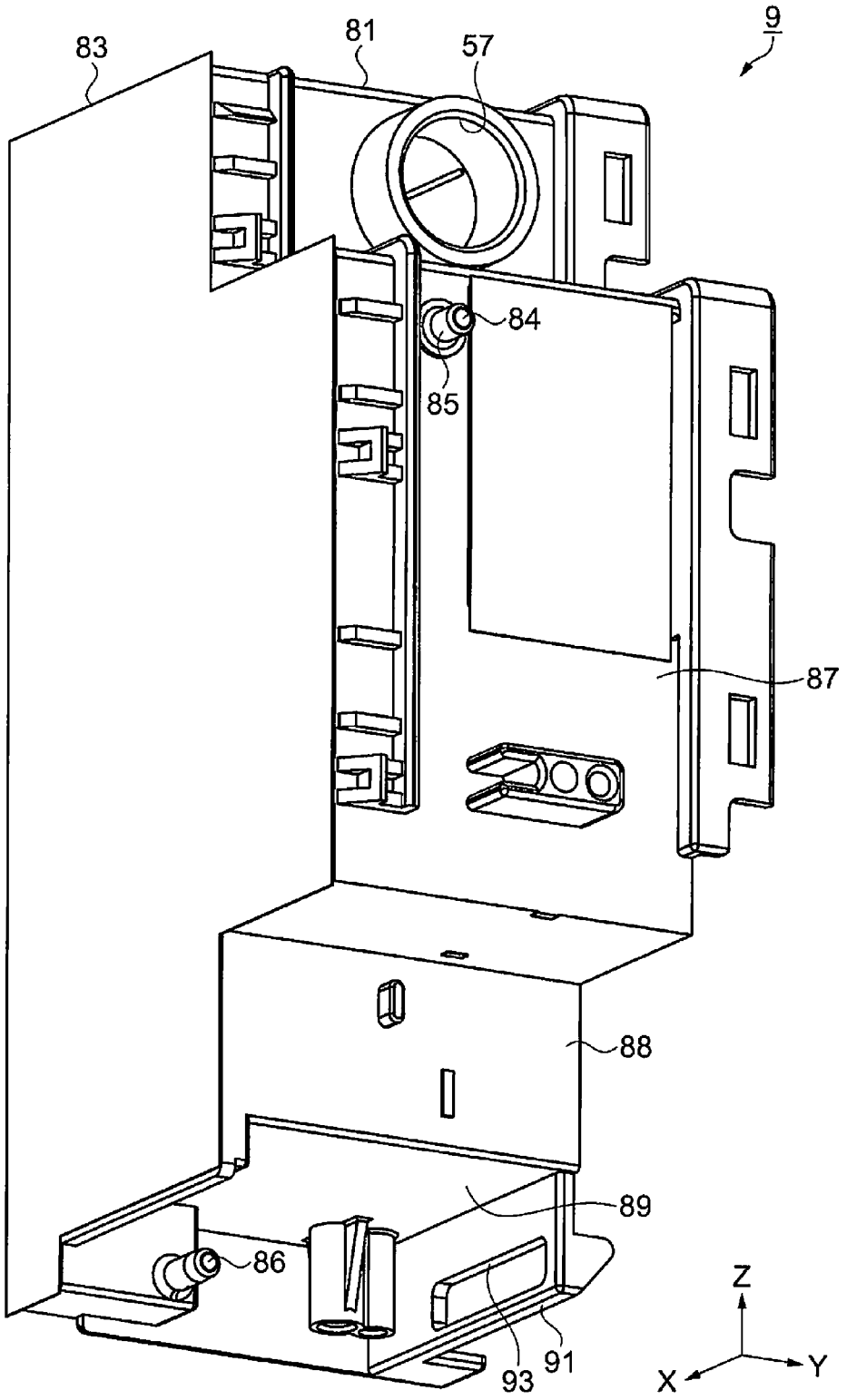
FIG. 8 is a perspective view showing a tank of the present embodiment.

Here, the tank 9 will be described. The tank 9, as shown in FIG. 8, includes a storage 81 and a sheet member 83. In the storage 81, a recessed section (not shown in figures) is arranged. The sheet member 83 is connected to the storage 81, and closes the recess section of the storage 81. At least a part of a space surrounded by the storage 81 and the sheet member 83 functions as the ink storage section. The ink is stored in the ink storage section. In the storage 81, the ink inlet section 57 which is mentioned before, a vent 84, a vent portion 85, and a supply port 86 are provided. The ink inlet section 57 communicates to the ink storage section in the tank 9.

Also, each of the vent 84 and the supply port 86 communicates to the ink storage section. The vent 84 is provided on the side wall 87 of the storage 81. The vent 84 is provided at the vent portion 85. The vent portion 85 protrudes in the −X axis direction from the side wall 87 of the storage 81. The vent portion 85 is cylindrically formed. The vent 84 is an opening arranged at the vent portion 85, and is a flow opening (or introduction opening) of the air to the ink storage section. When the ink in the ink storage section is consumed and the ink amount in the ink storage section is decreased, the pressure in the ink storage section becomes lower than the air pressure outside. At this time, the air can be introduced from the vent 84 in the ink storage section, and the pressure in the ink storage section can be easily maintained equal to the air pressure outside. The supply port 86 is positioned closer to the −Z axis direction side than the bottom surface 89 of the tank 9. The supply port 86 is a discharge outlet at which the ink in the ink storage section can be discharged outside the ink storage section. The ink in the ink storage section is supplied to the print head 47 (FIG. 5) via the supply port 86. The supply tube 43 which is shown in FIG. 7 is connected to the supply port 86.

Between the side wall 87 and the bottom surface 89, a side wall 88 is provided. The side wall 88 intersects with the bottom surface 89 and extends from the bottom surface 89 in the Z axis direction. The side wall 88 is positioned closer to the −X axis direction side than the side wall 87. For this reason, between the side wall 87 and the side wall 88, a gap in the X axis direction is arranged. For the six of the tanks 9 of the tank unit 71, the flow passage opening/closing device 75 (FIG. 7) is provided at a part of a space of the gap between the side wall 87 and the wall 88.

Figure 9:
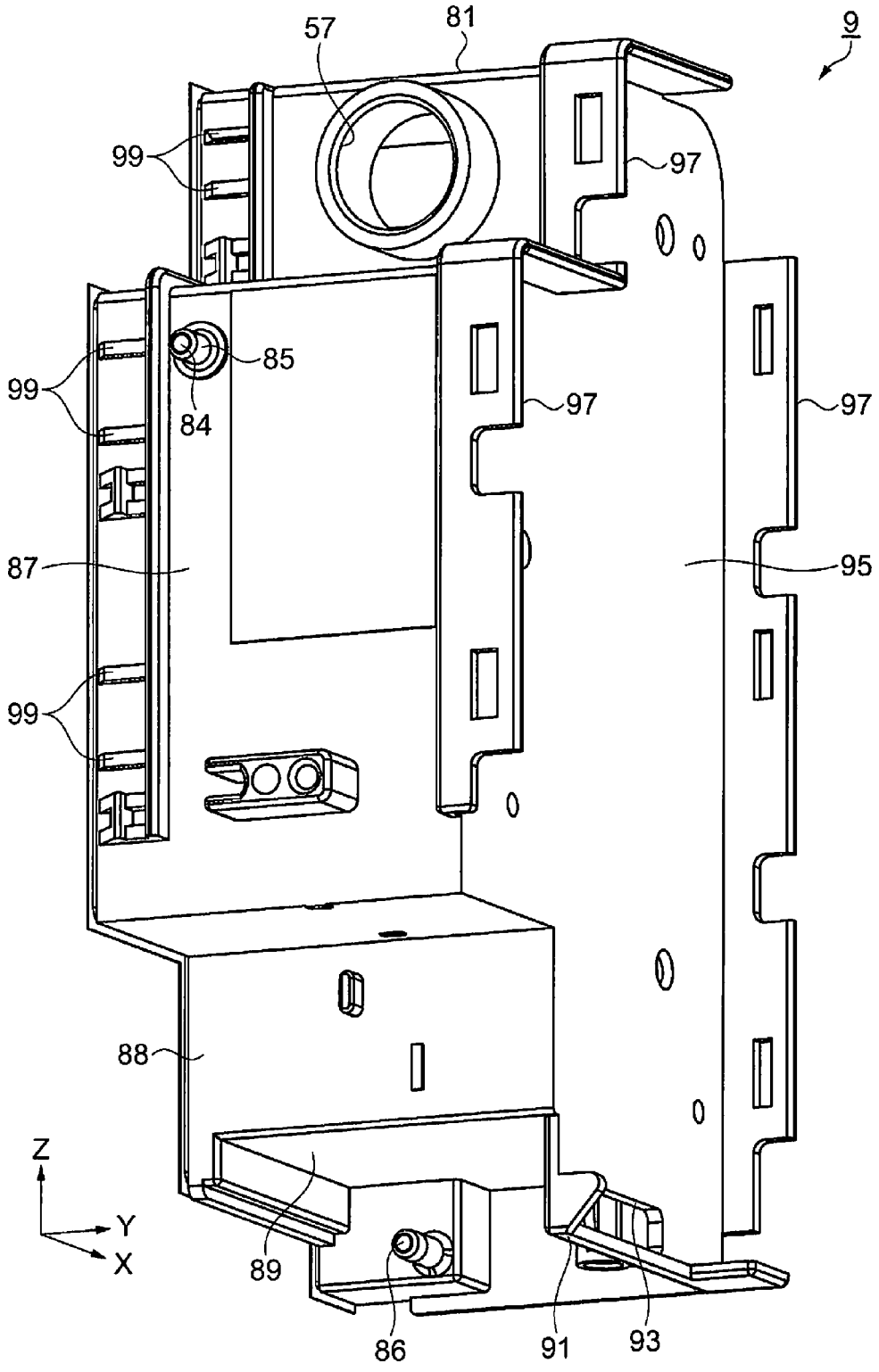
FIG. 9 is a perspective view showing the tank of the present embodiment.
Figure 10:
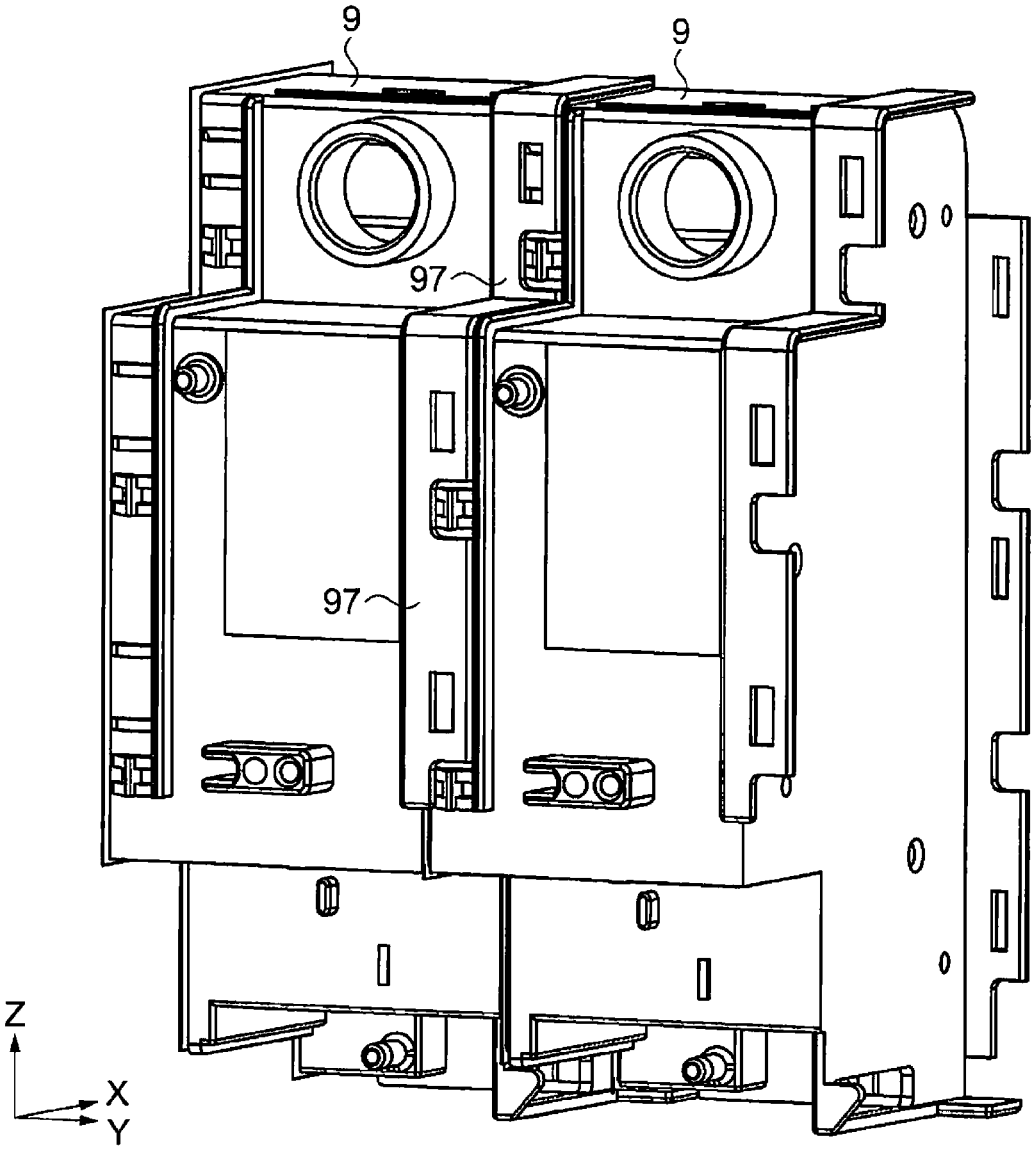
FIG. 10 is a perspective view showing a plurality of tanks of the present embodiment.

On the bottom surface 89 of the storage 81, a side wall 91 which protrudes in the −Z direction from the bottom surface 89 is provided. On the side wall 91, an opening 93 which penetrates through the side wall 91 is provided. The side wall 91 on which the opening 93 is provided has a frame shape. The opening 93 is formed in a size capable of inserting the supply tube 43. The side wall 91 having the frame shape is arranged to be supportable in supporting the supply tube 43 being inserted in the opening 93. Also, the storage 81, as shown in FIG. 9, includes a fitting section 97 which protrudes in the Y axis direction from the side wall 95, and a fitted section 99 provided opposite (−Y axis direction side) to the fitting section 97. Two of the tanks 9 which are next to each other along the Y axis, as shown in FIG. 10, are connectable by coupling one of the fitting section 97 of the tank 9 and the other of the fitted section 99 (FIG. 9) of the tank 9 to each other. In this way, it is possible to connect the plurality of the tanks 9 by the fitting section 97 and the fitted section 99.

Figure 11:
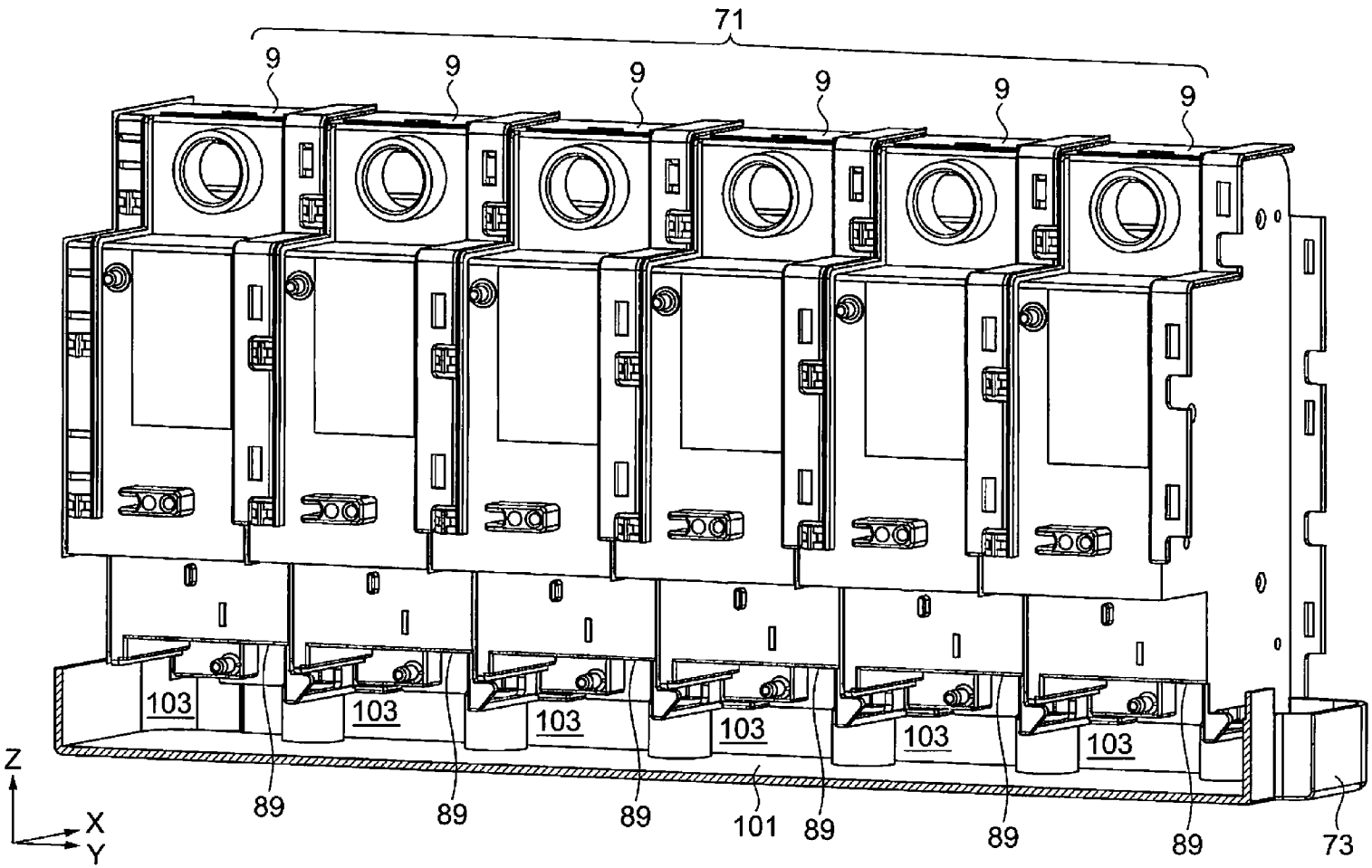
FIG. 11 is a perspective view showing a tank unit and a support frame of Example 1.
Figure 12:
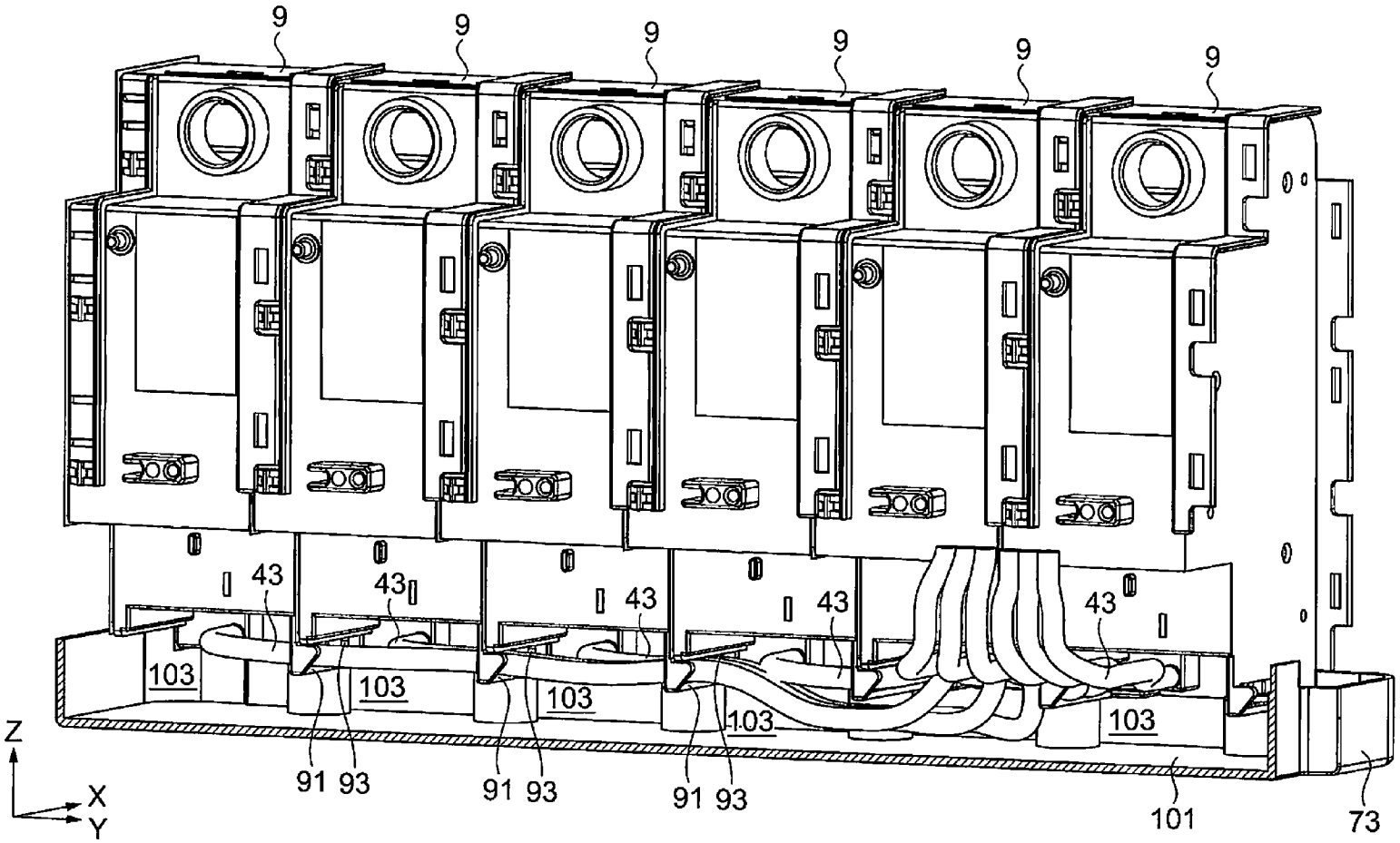
FIG. 12 is a perspective view showing the tank unit, a supply tube, and the support frame of Example 1.

At the tank unit 71, as shown in FIG. 11, in a state in which the six of the tanks 9 are connected, each of the tanks 9 is secured to the support frame 73. By the way, in FIG. 11, a state in which a part of support frame 73 is cut is depicted in order to show the arrangement for better understanding. A space is arranged between the bottom surface 89 of the tank 9 and the bottom surface 101 of the support frame 73. In other words, the space 103 is arranged between the bottom surface 89 of the tank 9 and the bottom surface 101 of the support frame 73. The supply tube 43 connected to the supply port 86 of the tank 9, as shown in FIG. 12, is piped in the space 103. At least a part of the plurality of the supply tube 43 are arranged in a state of being inserted (a state of penetrating) to the opening 93 of the side wall 91 having the frame shape. With this, it is possible to keep the chance low of the plurality of the supply tubes 43 being spread in the space 103. In other words, it is easy to bundle the plurality of the supply tubes 43.

Figure 13:
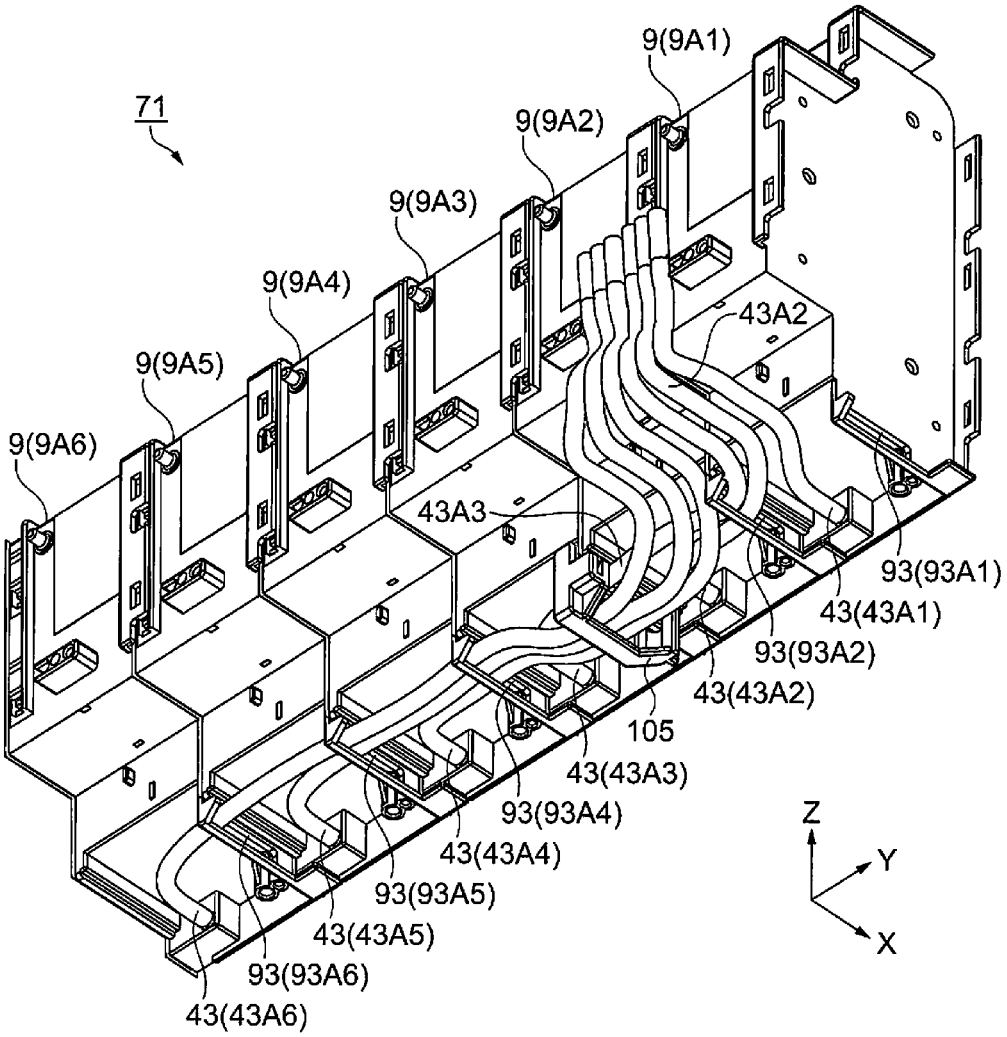
FIG. 13 is a perspective view showing the tank unit of Example 1.

A support member 105 is provided on the tank unit 71, as shown in FIG. 13. The support member 105 supports in the Z axis direction three of the supply tubes 43 out of the six of the supply tubes 43. The support member 105 is provided at the tank 9A3 which is third in the −Y axis direction from the tank 9A1 being located closest to the Y axis side on the tank unit 71. The support member 105 supports the supply tube 43A6 connected to the tank 9A6, the supply tube 43A5 connected to the tank 9A5 being next to the tank 9A6, and the supply tube 43A4 connected to the tank 9A4 being next to the tank 9A5.

The supply tube 43A6 connected to the tank 9A6 reaches the support member 105, passing through the opening 93A6 of the tank 9A6, the opening 93A5 of the tank 9A5, and the opening 93A6 of the tank 9A4. The supply tube 43A5 reaches the support member 105, passing through the opening 93A5 of the tank 9A5, and the opening 93A4 of the tank 9A4. The supply tube 43A4 reaches the support member 105, passing through the opening 93A4 of the tank 9A4. One support member 105 is provided for the tank unit 71, but the number of the support member 105 is not limited to one. For the tank unit 71, an arrangement in which, for example, a plurality of support members 105 are provided can be employed.

Figure 14:
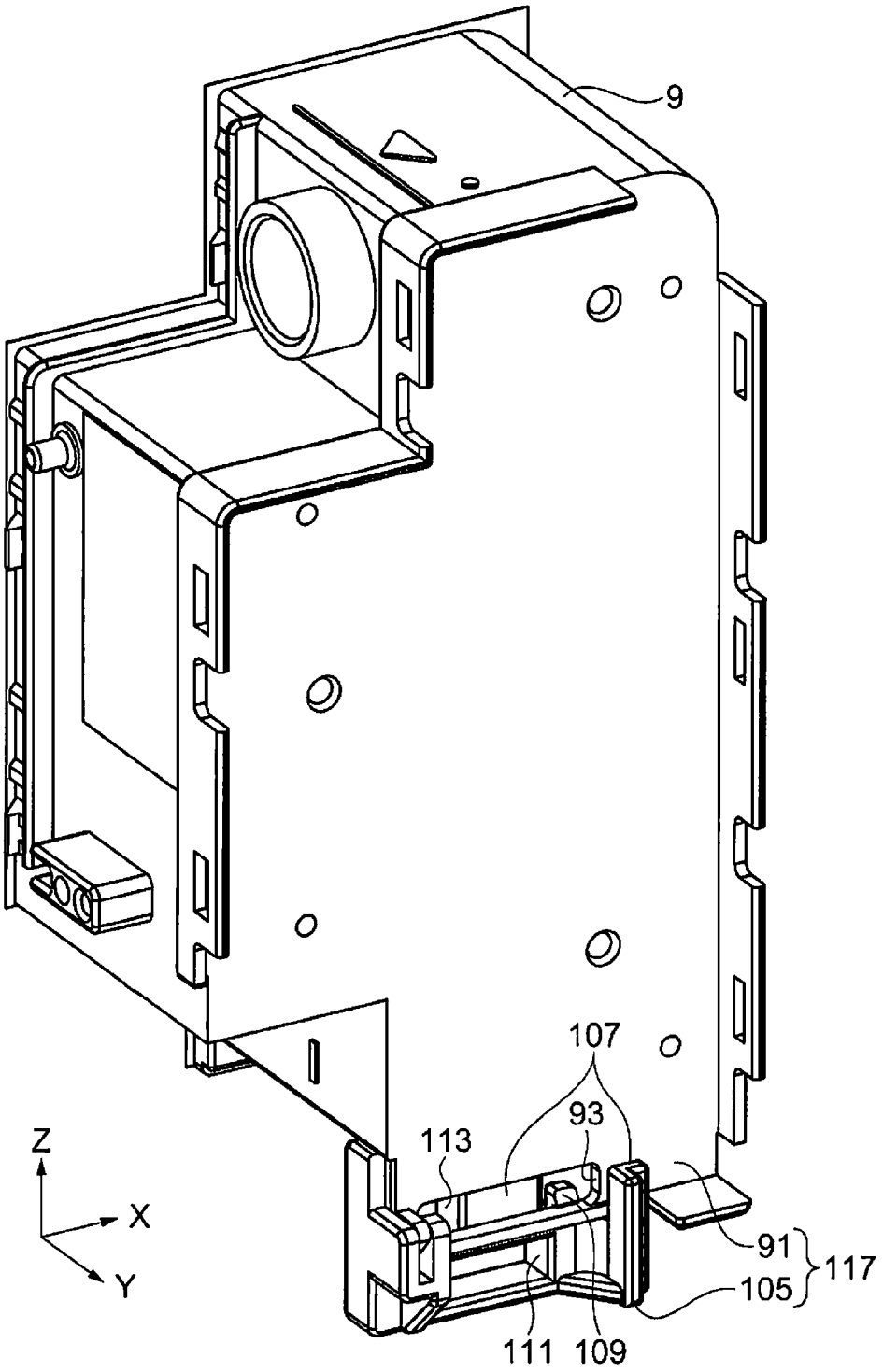
FIG. 14 is a perspective view showing a tank and a support member of Example 1.
Figure 15:
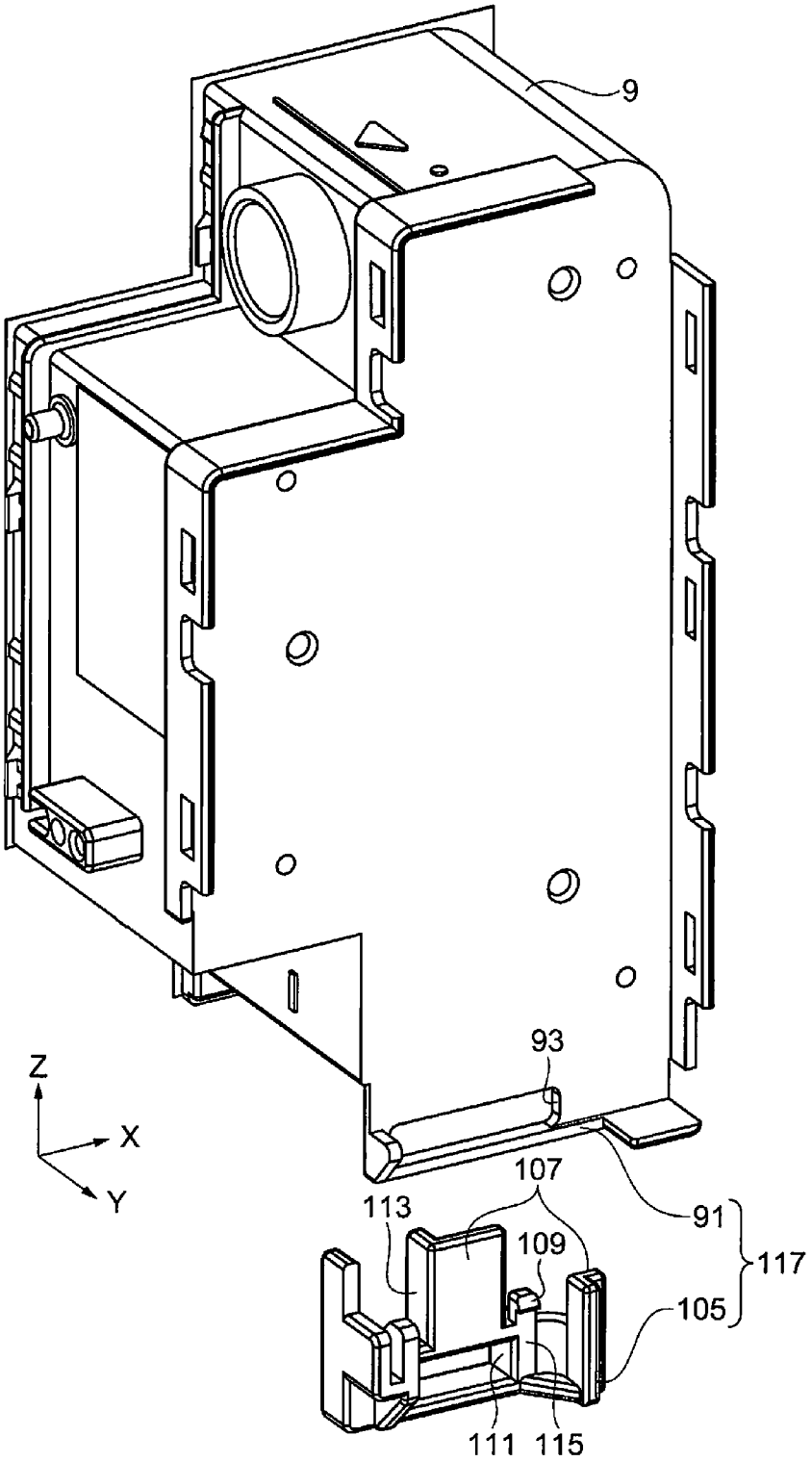
FIG. 15 is an exploded perspective view showing the tank and the support member of Example 1.

The support member 105 is provided on the side wall 91 of the tank 9, as shown in FIG. 14. The support member 105, as shown in FIG. 15, is arranged detachable from/attachable to the tank 9. The support member 105 includes a pair of fitting section 107, and an engagement section 109. Also, an opening 111 and a notch 113 are provided on the support member 105. The pair of the fitting sections 107 protrudes in the Z axis direction from the frame 115 having the frame shape due to the opening 111. In the Y axis direction, between the pair of the fitting sections 107, a space is arranged. The engagement section 109 protrudes in the Z axis direction from the frame 115. The opening 111 is arranged on the frame 115, and penetrates through the frame 115 in the Y axis direction. The notch 113 is provided on the side of Z axis direction of the frame 115. The notch 113 opens in the Z axis direction.

The support member 105 having the above mentioned arrangement is equipped on the side wall 91 of the tank 9. At this time, the pair of the fitting section 107 couples with the side wall 91, and the engagement section 109 engages with the opening 93. With this, as shown in FIG. 14, the support member 105 is equipped on the tank 9. In a state in which the support member 105 is equipped on the tank 9, the support member 105 and the side wall 91 constitute the support section 117. When the engagement of the engagement section 109 is released in a state in which the support member 105 is equipped on the tank 9, and the support member 105 is displaced in the −Z axis direction with respect to the tank 9, the support member 105 can be removed from the tank 9.

Figure 16:
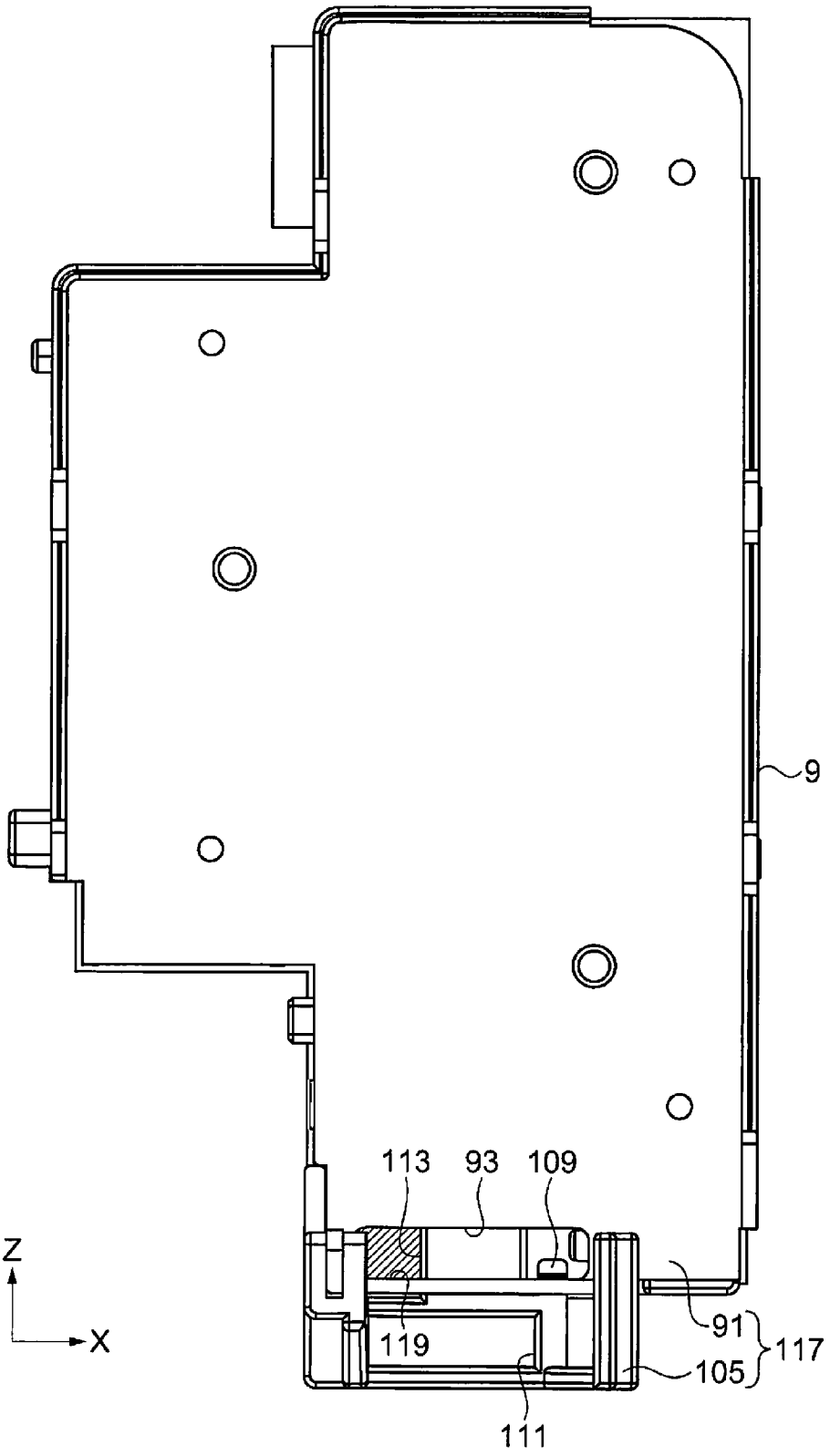
FIG. 16 is a side view showing the tank and the support member of Example 1.

In the state in which the support member 105 is equipped on the tank 9, the notch 113 overlaps with the opening 93 of the tank 9. Further, as shown in FIG. 16, the opening 93 and the notch 113 constitute the opening 119. In FIG. 16, in order to understand the arrangement better, an area of the opening 119 is hatched. The opening 119 is formed in a size, such that the supply tube 43 can be inserted. The supply tube 43 which is inserted in the opening 119 is supported in the Z axis direction by the opening 119. Also, a change amount in the X and −X axis direction of the supply tube 43 which is inserted in the opening 119 is limited by the opening 93 and the support member 105.

Figure 17:
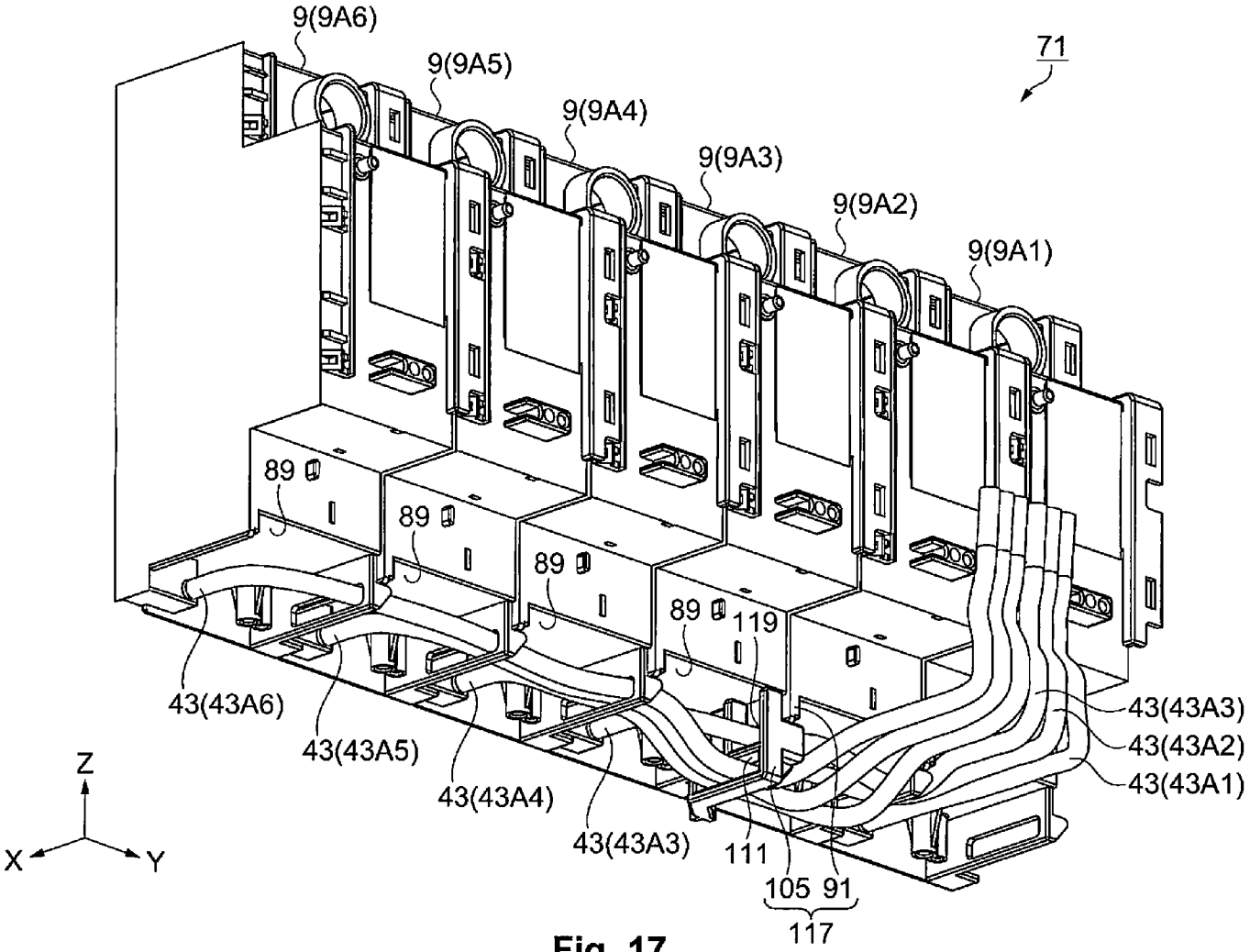
FIG. 17 is a perspective view showing the tank unit of Example 1.

In the opening 119, as shown in FIG. 17, the supply tube 43A3 connected to the tank 9A3 is inserted. With this, the supply tube 43A6, the supply tube 43A5, the supply tube 43A4, and the supply tube 43A3 of the plurality of supply tubes 43 are supported by the support section 117. The support section 117 supports the supply tube 43A6, the supply tube 43A5, the supply tube 43A4, and the supply tube 43A3 on the bottom surface 89. The supply tube 43A3 is shifted further to the Z axis direction by the support section 117 than the supply tube 43A6, the supply tube 43A5, and the supply tube 43A4. In other words, the support section 117 aligns and supports the supply tube 43A6, the supply tube 43A5, the supply tube 43A4, and the supply tube 43A3 in a direction perpendicular to the bottom surface 89. In other words, the supply tube 43A6, the supply tube 43A5, the supply tube 43A4, and the supply tube 43A3 are aligned in an up-and-down direction. With this, it is easier to prevent the space 103 (FIG. 12), which is necessary for piping the supply tube 43, from spreading along the bottom surface 89 of the tank 9.

The direction of aligning the supply tube 43A6, the supply tube 43A5, the supply tub e43A4, and the supply tube 43A3 is not limited to the up-and-down direction. The direction of aligning the supply tube 43A6, the supply tube 43A5, the supply tube 43A4, and the supply tube 43A3 can be zigzag, as long as the supply tube 43A6, the supply tube 43A5, the supply tube 43A4, and the supply tube 43A3 are shifted in the up-and-down direction. Further, a plane on which the support section 117 supports the supply tube 43 is not limited to the bottom surface 89, but can be other side surfaces.

At the tank 9, in order to increase the number of the supply tubes 43 which can be inserted to the opening 93, while bent of the supply tubes 43 is prevented, it is necessary to increase the size of the opening 93 along the bottom surface 89, in other words in the −X axis direction. In other words, at the tank 9, it is difficult to insert altogether four of the supply tubes 43 connected to four of the tanks 9, which are continuously aligned, to the opening 93. This is from the standpoint of preventing the bent or the collapse of the supply tube 43.

In contrast to this, in accordance with an arrangement in which the support section 117 (FIG. 17) is configured at the tank unit 71, at least two of the plurality of supply tubes 43 can be aligned in a direction intersecting the bottom surface 89 and supported. With this, it is possible to avoid the two of the supply tubes 43 being aligned parallel to the bottom surface 89, and therefore it is easier to prevent the space 103 which is necessary for piping the plurality of supply tubes 43 from expanding along the bottom surface 89. As a result, because it is easier to miniaturize the ink supply device 5, it is easier to miniaturize the liquid ejection system 1 of the printer 3.

Further, at the support section 117, the plurality of supply tubes 43 are aligned in the direction intersecting the bottom surface 89, it is easier to set a distance between the bottom surface 89 and the plurality of supply tubes 43 to be a designed distance. When the plurality of support members 105 for which distances between the bottom surface 89 and the opening 111 of the support member 105 are different to each other are prepared, it is easier to set the distance between the bottom surface 89 and the plurality of supply tubes 43 to be a desired distance. With this, for example, it is easier to set a water head difference between the print head 47 and the ink supply device 5A to be a desired water head difference.

Also, a part of the opening 119 of the support section 117 is constituted by the notch 113 of the support member 105. The notch 113 is open in the Z axis direction. For this reason, after the supply tube 43 is inserted to the opening 93 (FIG. 15), the support member 105 can be equipped to the tank 9. The notch 113 can be inserted in the Z axis direction to the supply tube 43 which has been inserted to the opening 93. With this, for example, after the supply tube 43 is inserted to the opening 111 of the support member 105, and after another supply tube 43 is inserted to the opening 93 of the tank 9 as well, it is possible to equip the support member 105 to the tank 9. For this reason, for a method of assembly (order) of the tank unit 71, a plurality of combinations can be prepared. At the support section 117, the opening 119 (FIG. 16) is constituted by the opening 93 of the tank 9 and the notch 113 of the support member 105; however, the arrangement of the opening 119 is not limited to this. As the opening 119, an example of an arrangement in which only notch constitutes the opening 119 for example can be employed. With this arrangement, it is fine when the notch 113 as the opening 119 is merely inserted to the supply tube 43 in the −Z axis direction.

Figure 18:
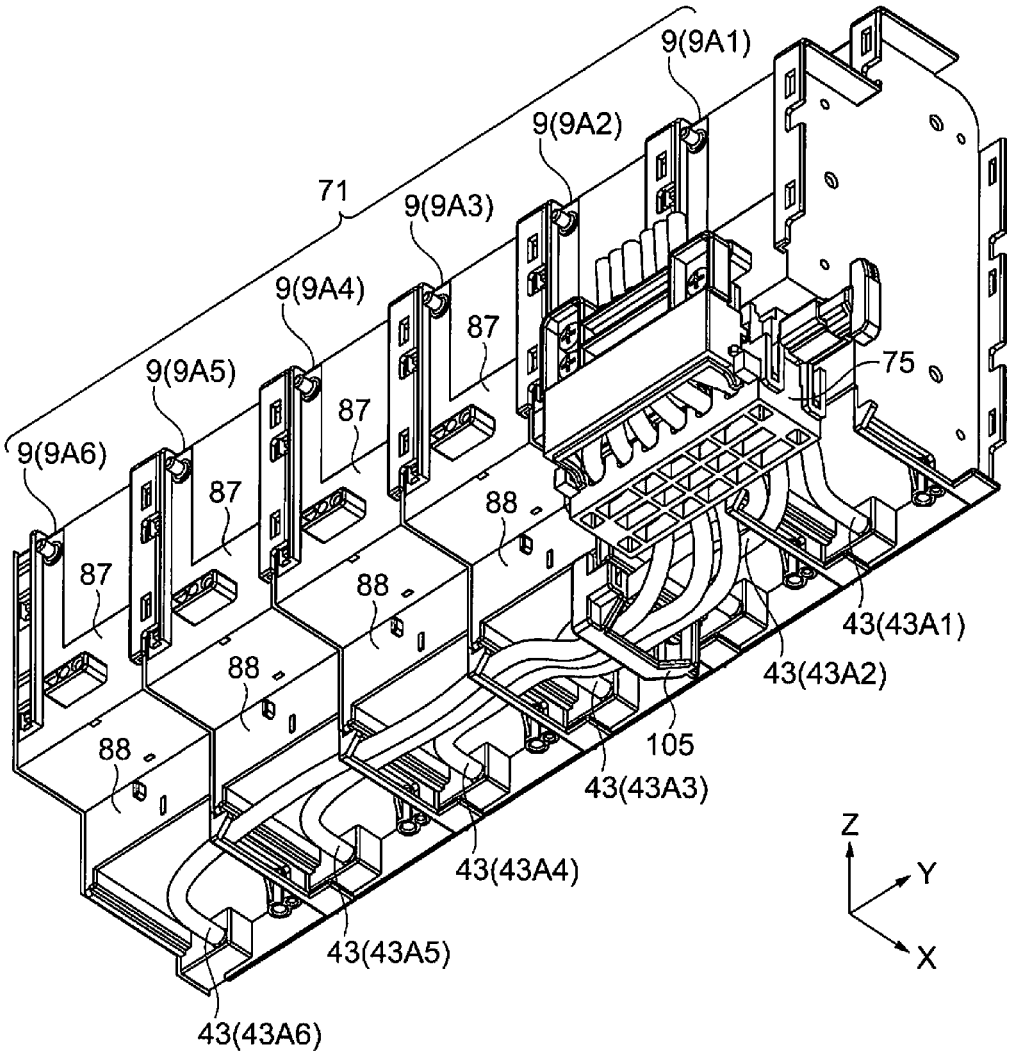
FIG. 18 is a perspective view showing the tank unit and a flow passage opening/closing device of Example 1.

The flow passage opening/closing device 75, as shown in FIG. 18, in a path of the supply tube 43A6, the supply tube 43A5, and the supply tube 43A4, is provided closer to an opposite side of tank 9 than the support member 105, namely closer to a side of the print head 47 (FIG. 5) than the support member 105. As mentioned above, at the six of the tanks 9 of the tank unit 71, the flow passage opening/closing device 75 is provided at a part of the space of the gap between the side wall 87 and the side wall 88. At the ink supply device 5A, the flow passage opening/closing device 75 is provided to lie astride the tank 9A2 to the tank 9A1 in the Y axis direction.

Figure 19:
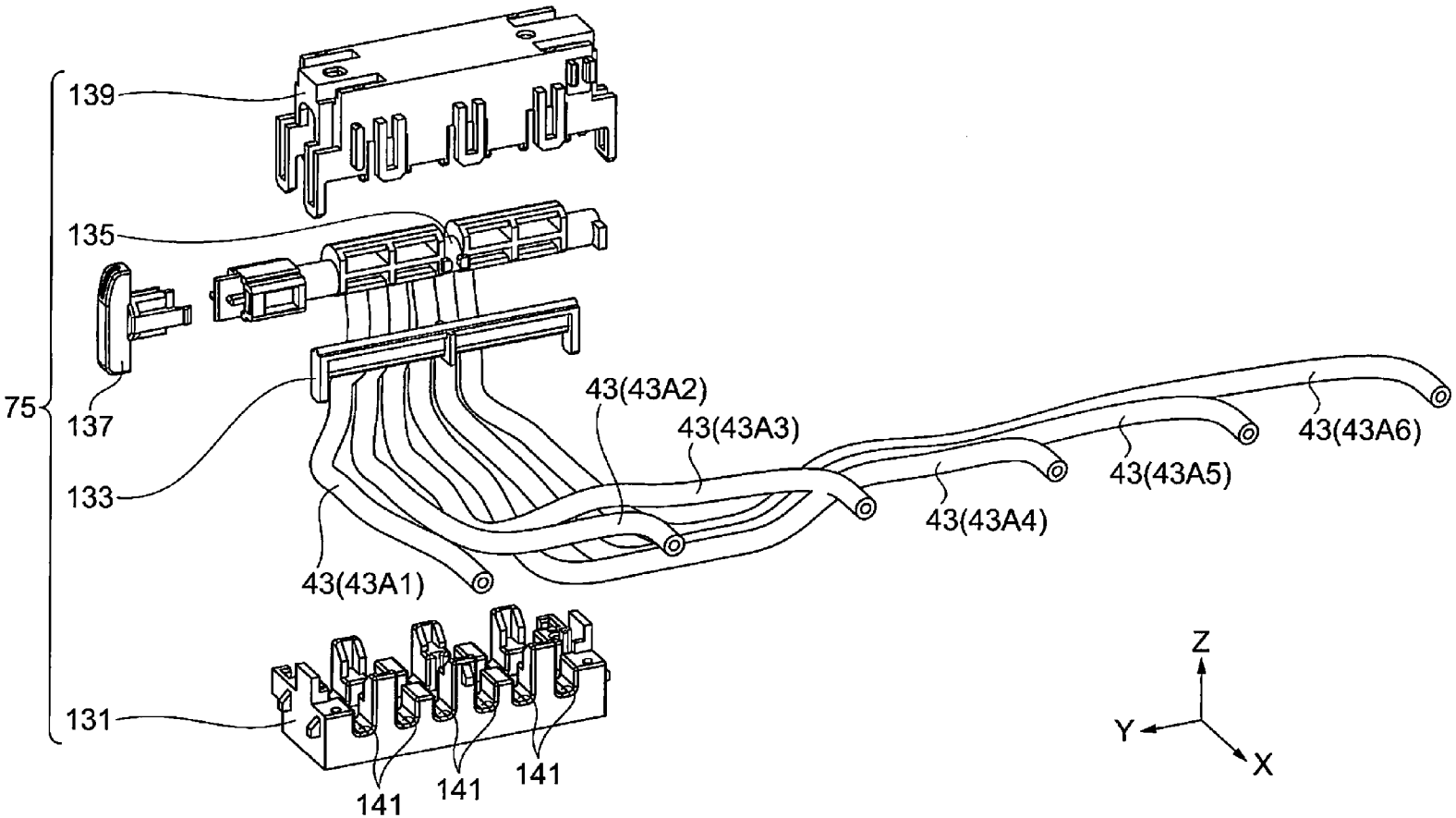
FIG. 19 is an exploded perspective view showing the flow passage opening/closing device of the example 1.

The flow passage opening/closing device 75, as shown in FIG. 19, includes a tube support section 131, a passing member 133, a cam member 135, an operation knob 137, and a cover 139. The tube support section 131 is provided closer to a side of the −Z axis direction than the six of the supply tubes 43. The pressing member 133 is provided on an opposite side of the tube support section 131 of the six of the supply tubes 43, namely provided closer to a side of the Z axis direction than the six of the supply tubes 43. The cam member 135 is provided on an opposite side of the tube support section 131 of the prepress member 133, namely provided closer to the side of the Z axis direction than the pressing member 133. The cover 139 is provided on an opposite side of the tube support section 131 of the cam member 135, namely closer to the side of the Z axis direction than the cam member 135.

Figure 20:
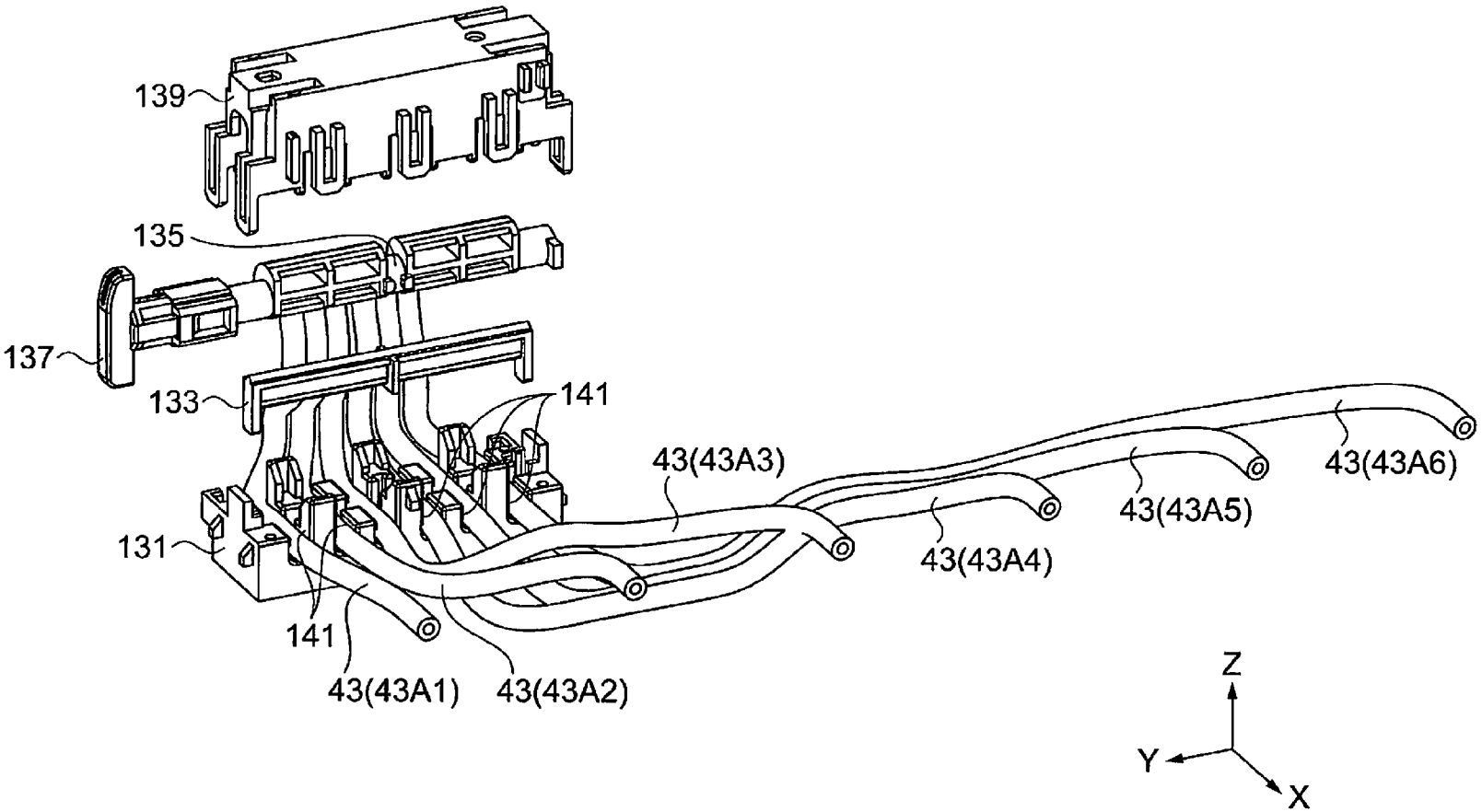
FIG. 20 is an exploded perspective view showing the flow passage opening/closing device of Example 1.

At the tube support section 131, a plurality of grooves 141 are arranged. The plurality of grooves 141 are aligned along the Y axis. In the groove 141, the supply tube 43 is inserted. The supply tube 43, as shown in FIG. 20, is deployed in the groove 141 along the groove 141. With this, the six of the supply tubes 43 are aligned at the tub support section 131 along the Y axis. The pressing member 133 has a length covering the plurality of grooves 141 of the tube support section 131. For this reason, the pressing member 133 has the length covering the six of the supply tubes 43 which are aligned along the Y axis at the tube support section 131. By the way, the operation knob 137 shown in FIG. 19 is provided attachably to the cam member 135. When the operation knob 137 is attached to the cam member 135, as shown in FIG. 20, the cam member 135 and the operation knob 137 are integrally arranged. The operation knob 137, as shown in FIG. 4, is exposed outside the tank case 7. When the user pinches the operation knob 137 by fingers and rotates the operation knob 137, the cam member 135 is rotated in conjunction with the rotation of the operation knob 137.

Figure 21:
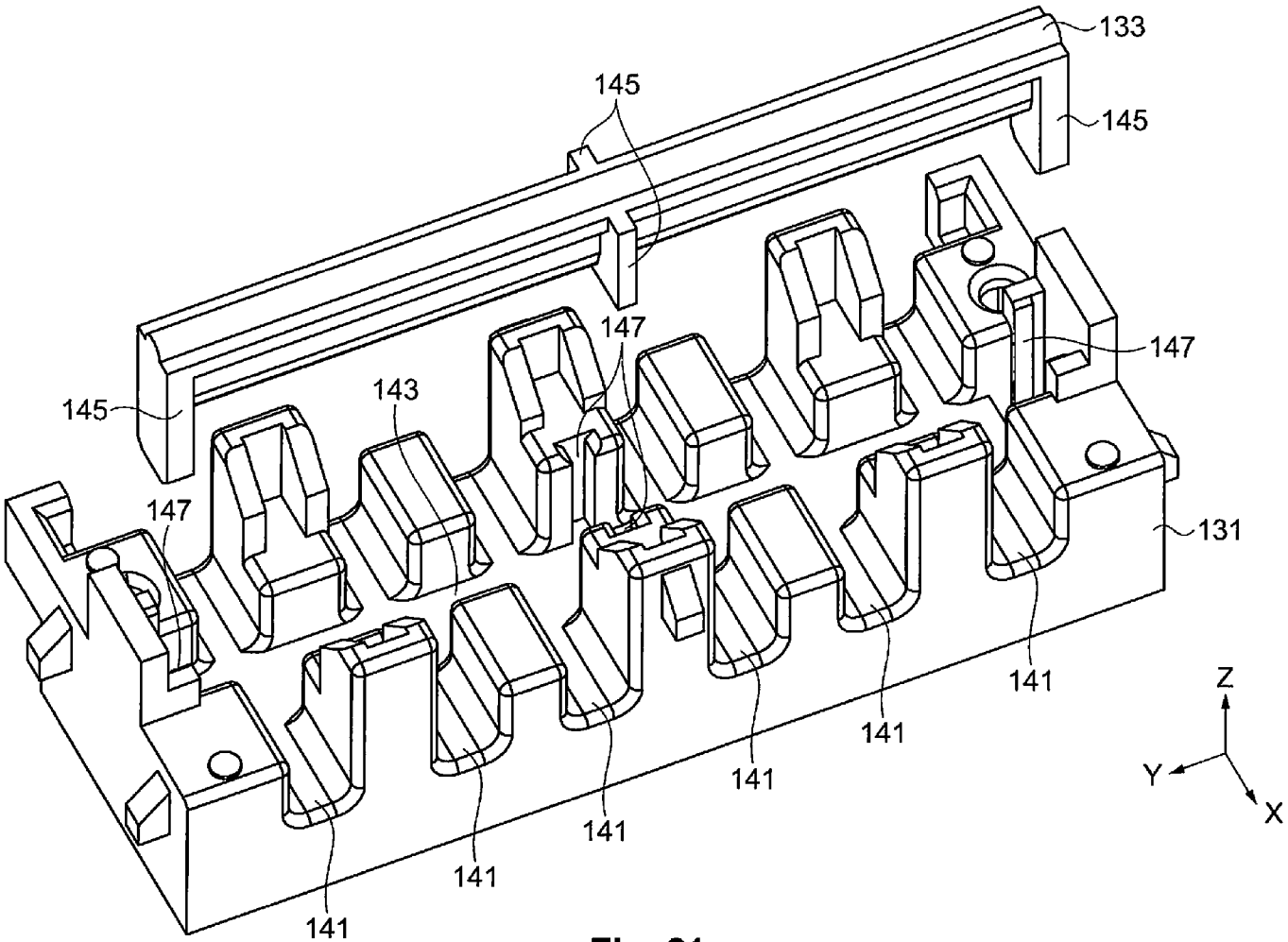
FIG. 21 is an exploded perspective view showing a tube support section and a pressing member of Example 1.

At the support section 131, as shown in FIG. 21, a recessed section 143, to which the pressing member 133 can be inserted, is provided. In the present embodiment, the pressing member 133 can be inserted in the recessed section 143 to a position at which the pressing member 133 abuts a bottom part of the recessed section 143. At the pressing member 133, a guided section 145 is provided. Also, at the tube support section 131, a guide section 147 to which the guided section 145 can be inserted is provided at a place opposing to the guided section 145 of the pressing member 133. By inserting the guided section 145 of the pressing member 133 to the guide section 147 of the tube support section 131, it is possible to insert the pressing member 133 in the recessed section 143 of the tube support section 131.

In a state in which the guided section 145 of the pressing member 133 is inserted in the guide section 147 of the tube support section 131, a space is formed between the guided section 145 and the guide section 147. Further, in the state in which the pressing member 133 is inserted in the recessed section 143, it is set to form the space between the pressing member 133 and the recessed section 143. For this reason, it is possible to insert smoothly the pressing member 133 in the recessed section 143, and to remove smoothly the pressing member 133 from the recessed section 143. Further, when inserting or removing the pressing member 133 in or from the recessed section 143, the guided section 145 of the pressing member 133 is guided by the guide section 147 of the tube support section 131. For this reason, it is possible to lower the misalignment of the pressing member 133 with respect to the tube support member 131 along the XY plane.

Figure 22:
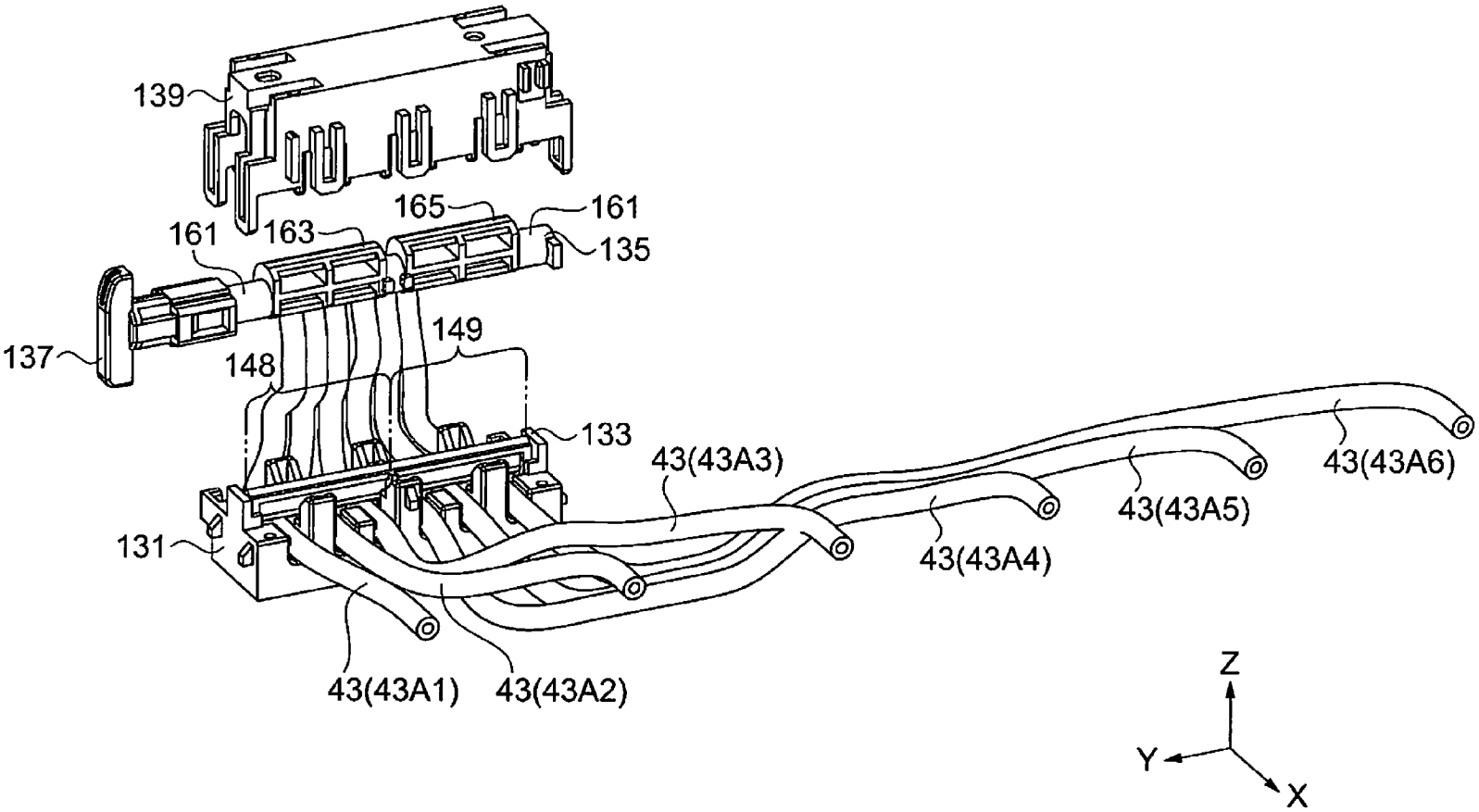
FIG. 22 is an exploded perspective view showing the flow passage opening/closing device of Example 1.

The pressing member 133, as shown in FIG. 22, in a state in which the supply tube 43 is deployed in the groove 141 of the tube support section 131, is provided to be opposing to the recessed section 143 (FIG. 21) across the supply tube 43. With this, the six of the supply tubes 43 are sandwiched by the tube support section 131 and the pressing member 133. Here, the pressing member 133 is sectionalized into a first region 148 and a second region 149. The first region 148 is a region which intersects the supply tube 43A1, the supply tube 43A2, and the supply tube 43A3 out of the six of the supply tubes 43 which are deployed in the tube support section 131. The second region 149 is a region which intersects the supply tube 43A4, the supply tube 43A5, and the supply tube 43A6 out of the six of the supply tubes 43 which are deployed in the tube support section 131.

Figure 23:
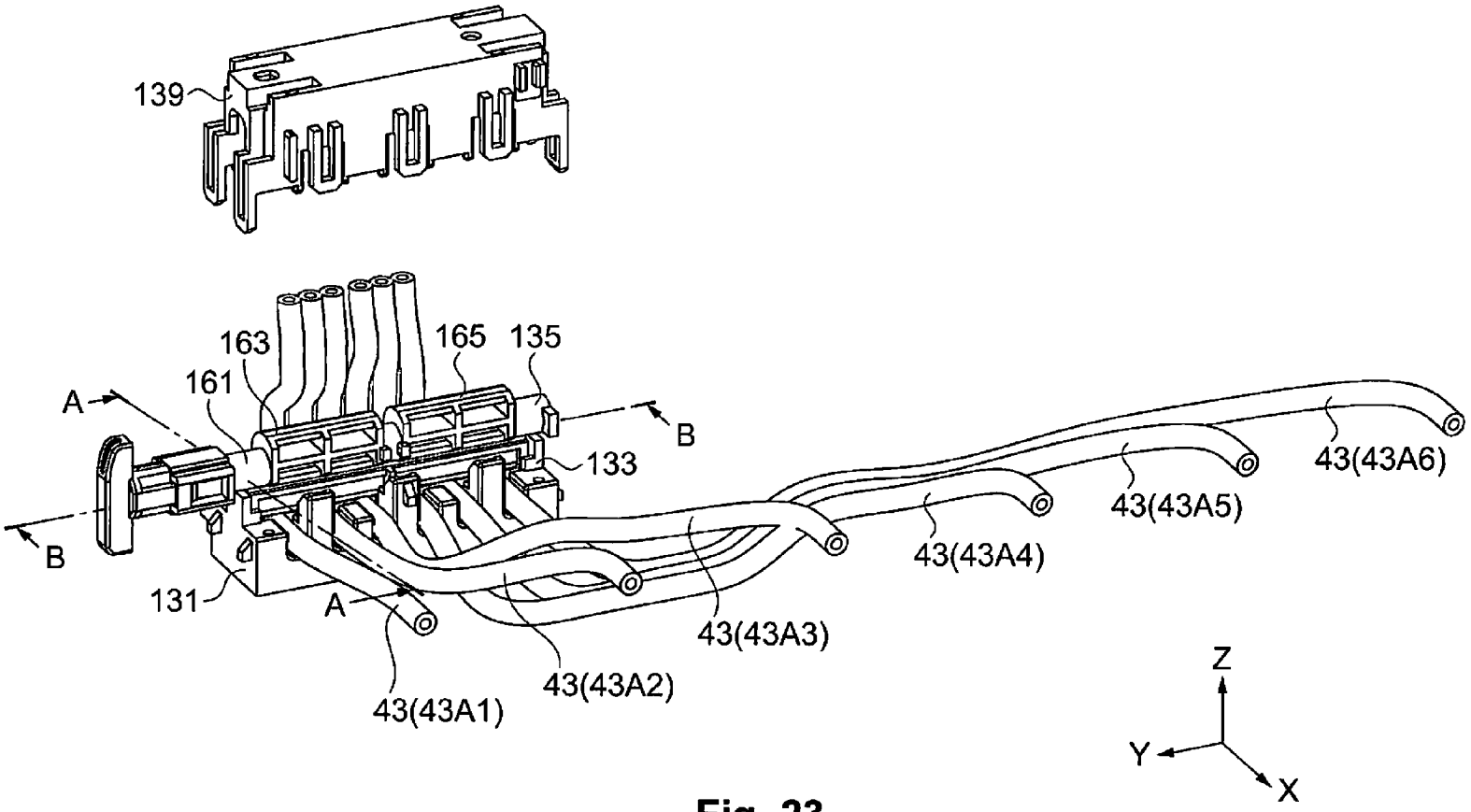
FIG. 23 is an exploded perspective view showing the flow passage opening/closing device of Example 1.

The cam member 135 includes, as shown in FIG. 22, a shaft section 161, a first cam 163, and a second cam 165. The shaft section 161 extends along the Y axis, and has a length covering, at the support section 131, the six of the supply tubes 43 along the Y axis. Each of the first cam 163 and the second cam 165 is provided on the shaft section 161. The first cam 163 and the second cam 165 are aligned along the Y axis. The first cam 163 is provided closer to a side of operation knob 137 than the second cam 165, namely provided closer to the side of the Y axis direction than the second cam 165. The first cam 163 is provided at a place opposing to the first region 148 of the pressing member 133. The second cam 165 is provided at a place opposing to the second region 149 of the pressing member 133. Further, the cam member 135, as shown in FIG. 23, is provided at a place where it is possible to abut the pressing member 133. At this time, the first cam 163 of the cam member 135 can abut the first region 148 (FIG. 22) of the pressing member 133. Further, the second cam 165 can abut the second region 149 (FIG. 22) of the pressing member 133.

Figure 24:
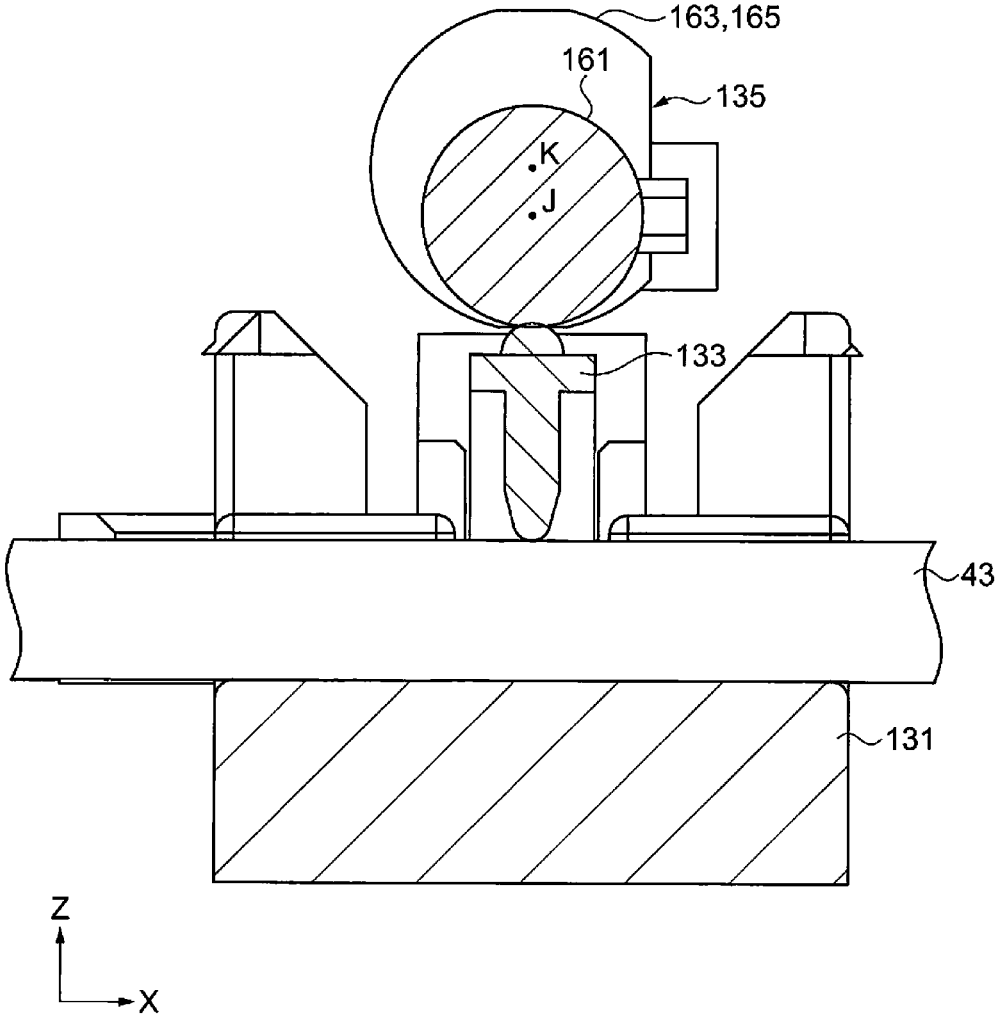
FIG. 24 is a cross-sectional view of A-A line in FIG. 23.

The shaft section 161 of the cam member 135 has an axial shape and, as shown in FIG. 24 which is a cross-sectional view of A-A line in the FIG. 23, has a circular outer periphery with a point J as the center. Each of the first cam 163 and the second cam 165 has an outer periphery including a profile of a circular arc with a point K as the center. The point J and the point K are mutually misaligned. In other words, the centers of the shaft section 161 and the first cam 163 are mutually misaligned (being eccentric). Also, the centers of the shaft section 161 and the second cam 165 are also mutually misaligned (being eccentric). The cam member 135 is rotated with the shaft section 161 as the center in conjunction with the rotation of the operation knob 137.

Figure 25:
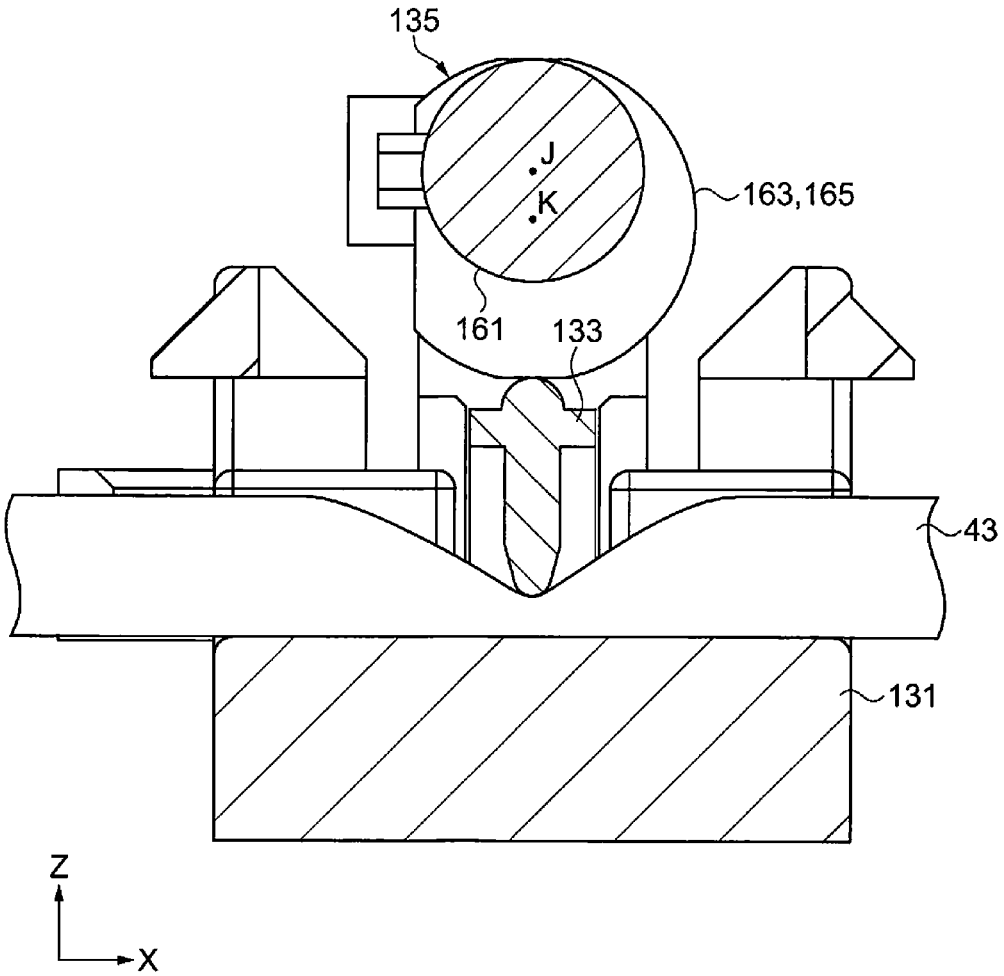
FIG. 25 is a cross-sectional view showing a state in which a first cam and a second cam of Example 1 come down.

At this time, since the point J and the point K are mutually misaligned, the outer peripheries of the first cam 163 and the second cam 165, as shown in FIG. 25, are being shifted in conjunction with the rotation of the shaft section 161. With this, the first cam 163 and the second cam 165 function as a cam by going up and down with the shaft section 161 as the center of rotation. In FIG. 24, a state in which the first cam 163 and the second cam 165 go up and down is shown. On the other hand, in FIG. 25, a state in which the first cam 163 and the second cam 165 are down is shown.

Figure 26:
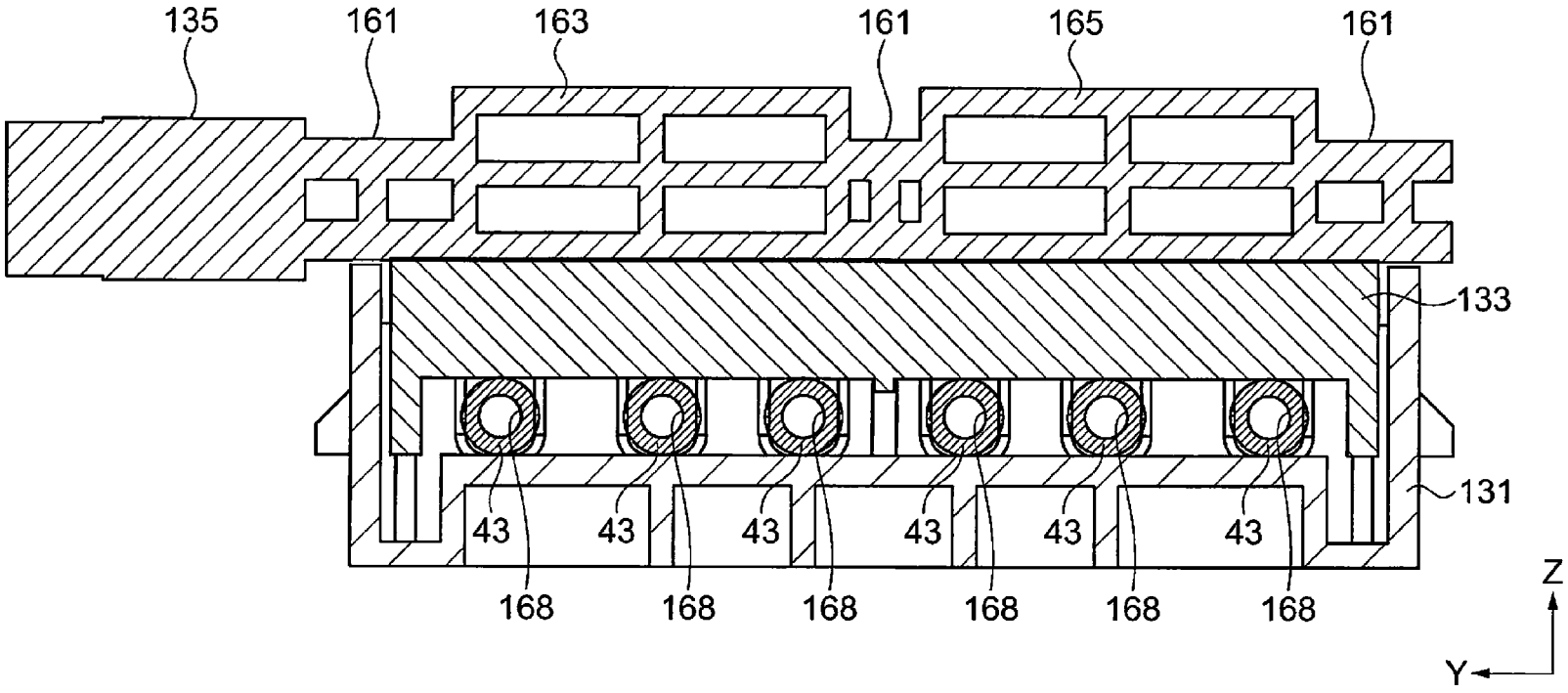
FIG. 26 is a cross-sectional view of B-B line in FIG. 23.
Figure 27:
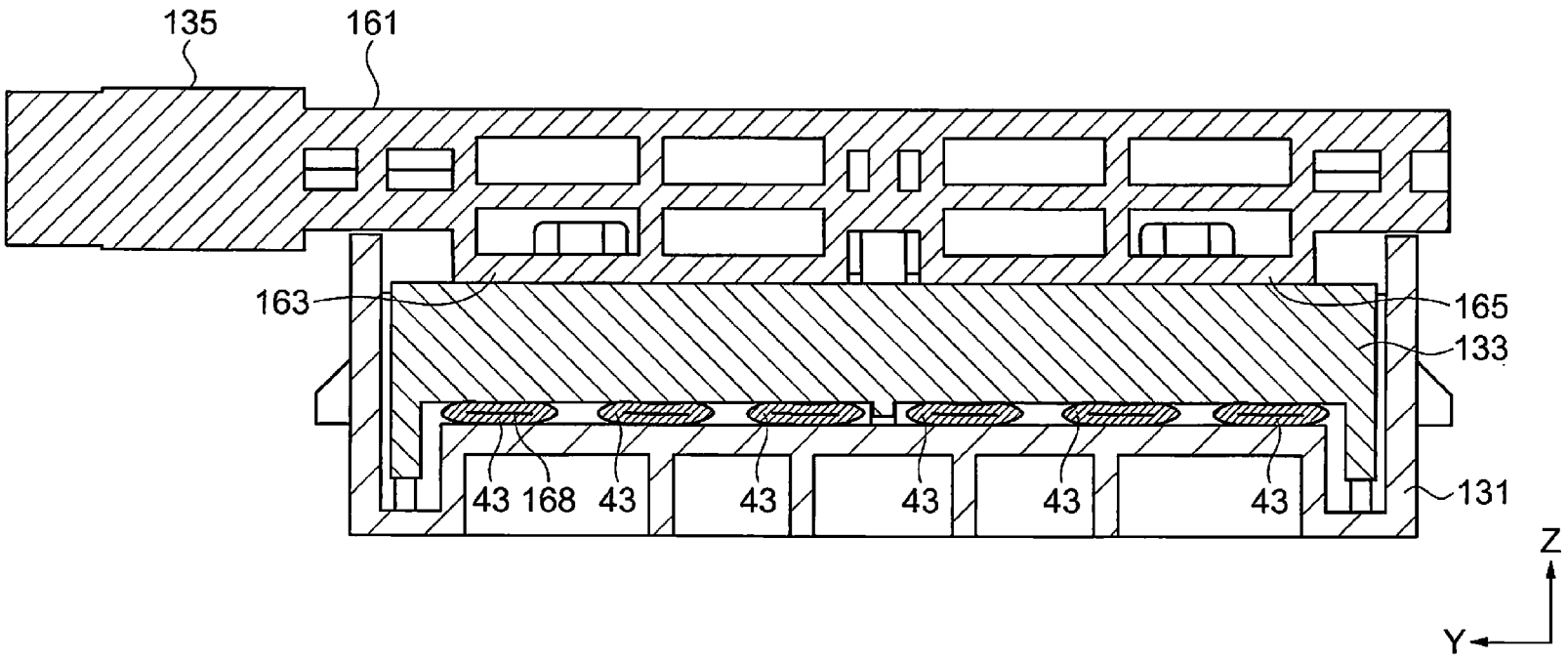
FIG. 27 is a cross-sectional view showing a state in which the first cam and the second cam of Example 1 come down.

The pressing member 133, as shown in FIG. 24, is provided on the outer periphery of the supply tube 43. At this time, as shown in FIG. 26 which is a cross-sectional view of B-B line in the FIG. 23, the channel 168 of the supply tube 43 is opened. When the first cam 163 and the second cam 165 go down, the pressing member 133, as shown in FIG. 25, comes down towards a side of the supply tube 43 in conjunction with the first cam 163 and the second cam 165 going down. With this, supply tube 43 is collapsed by the pressing member 133. Here, the supply tube 43 is made of a material having elasticity. As a result, the channel 168 of the supply tube 43, as shown in FIG. 27, is closed. By the way, at this time, the channel 168 of the supply tube 43 does not have to be completely closed. When the first cam 163 and the second cam 165 comes up after the first cam 163 and the second cam 165 go down, as shown in FIG. 24, the pressing member 133 goes up by the elasticity of the supply tube 43. With this, a passage of the supply tube 43 is opened (FIG. 26)

Figure 28:
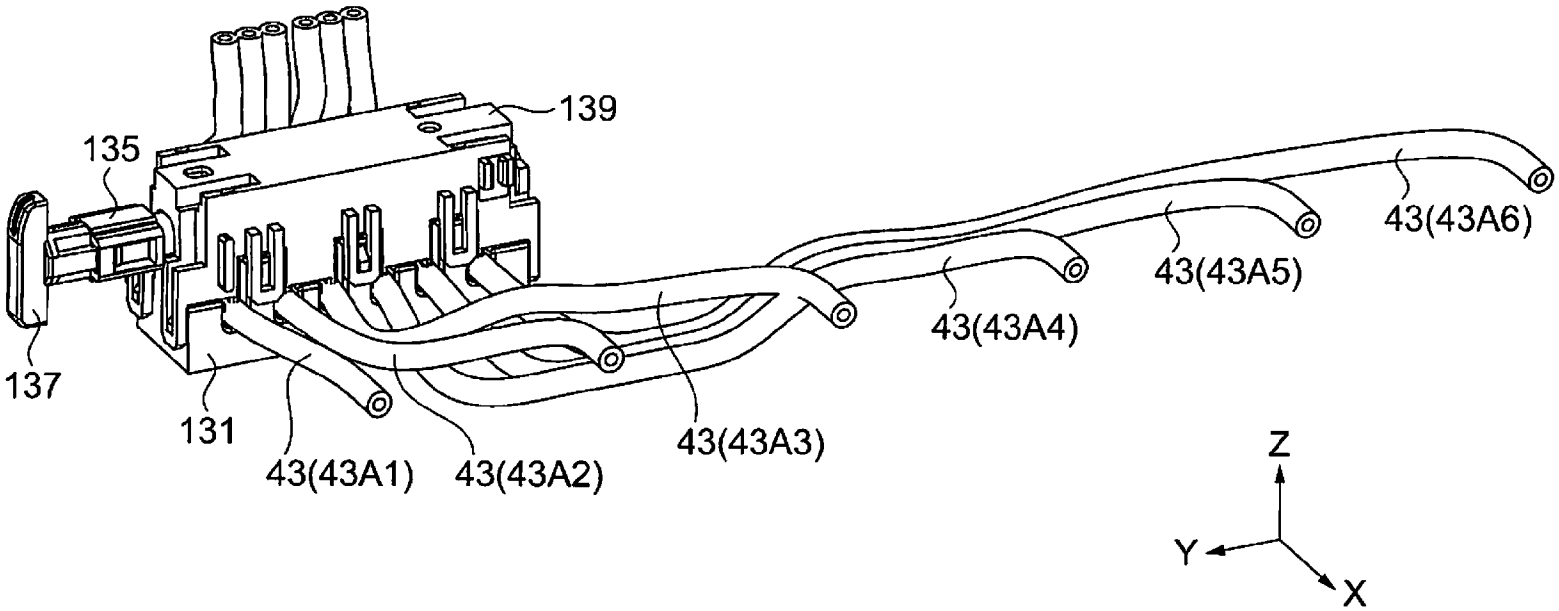
FIG. 28 is a perspective view showing the flow passage opening/closing device of Example 1.

The cover 139, as shown in FIG. 28, is arranged to be engageable with the tube support section 131, and covers the pressing member 133 (FIG. 22), the first cam 163, and the second cam 165 from the side of the Z axis. With this, the pressing member 133 (FIG. 22), the first cam 163, and the second cam 165 are protected by the cover 139.

It is possible to open and close the channel 168 of the six of the supply tubes 43 by the flow passage opening/closing device 75. With this, for example, when moving or transferring the liquid ejection device 1, it is easier to prevent the ink from leaking from the print head 47, as long as the channel 168 is closed by the flow passage opening/closing device 75. When moving or transferring the liquid ejection device 1, shakes or shocks are applied to the ink inside the supply tube 43 of the tank 9. When shakes or shocks are applied to the ink inside the supply tube 43 of the tank 9, pressure is applied to the ink in the print head 47. For this reason, when the liquid ejection device 1 is moved or transferred, the ink may be leaking from the print head 47. For things like this, the flow passage opening/closing device 75 is effective. As long as the channel 168 is closed by the flow passage opening/closing device 75 before moving to transferring the liquid ejection device 1, it is possible to keep pressure fluctuation applied to the ink in the print head 47. For this reason, it is possible to keep leakage of the ink low from the print head 47. Also, for example, it is also effective to close the channel 168 by the flow passage opening/closing device 75 before injecting the ink in the tank 9. This is because it is possible to keep the pressure fluctuation applied to the ink in the print head 47 low, when changing the tank 9 from the using posture to the injecting posture.

EXAMPLE 2

Figure 29:
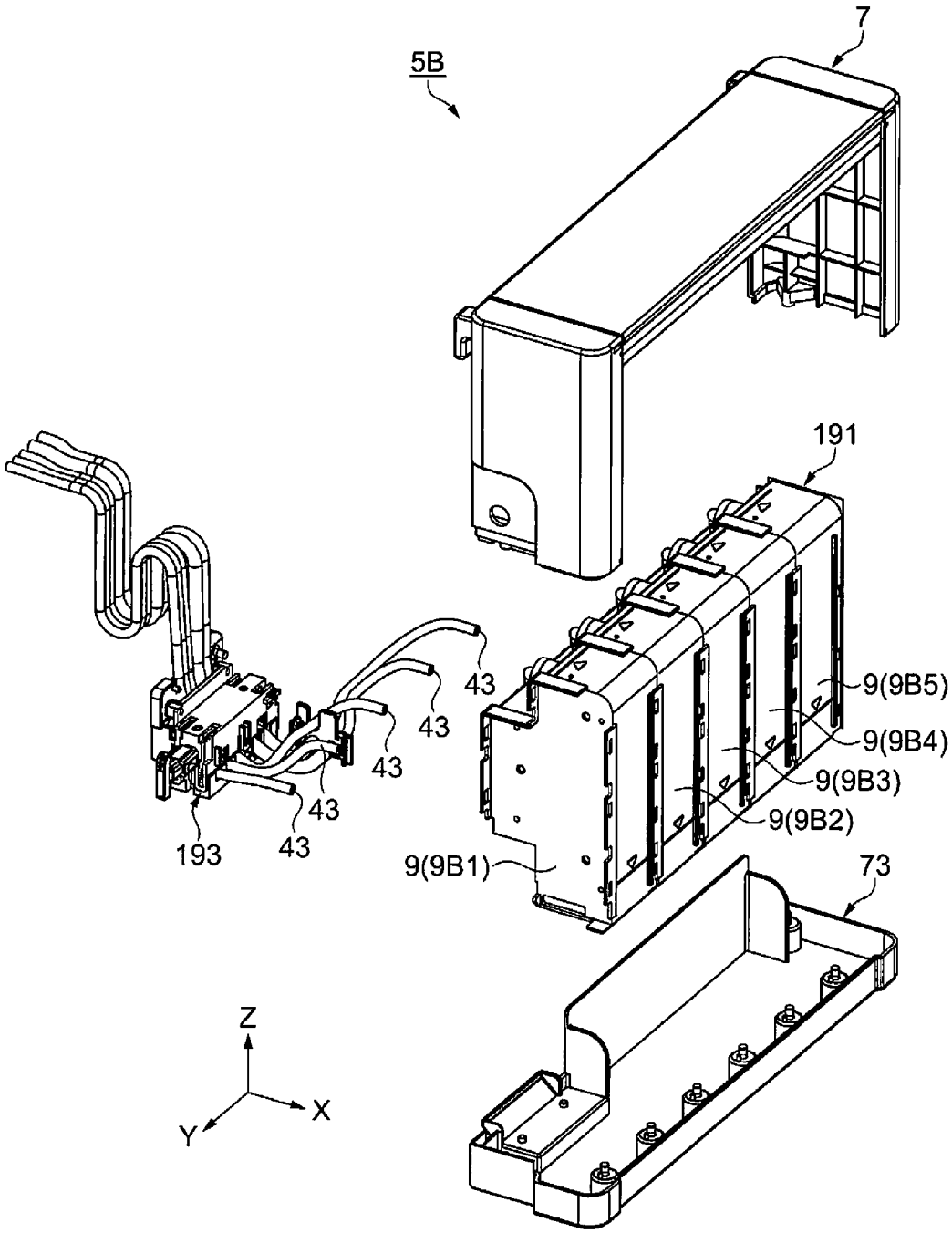
FIG. 29 is an exploded perspective view showing an ink supply device of Example 2.

An ink supply device 5B of Example 2 will be described. In Example 2, for the same arrangements which are described in Example 1, the same symbols as ones in Example 1 are used, and detailed descriptions are omitted. The ink supply device 5B of Example 2, as shown in FIG. 29, includes the tank case 7, the plurality of the supply tubes 43, the tank unit 191, the support frame 73, and the flow passage opening/closing device 193. The tank unit 191 includes the plurality of tanks 9 which are connected to each other. For the ink supply device 5B of Example 2, five of the tanks 9 are includes in the tank unit 191. In other words, of the tank unit 191 of Example 2, the five of the tanks 9 are connected.

Of the tank unit 191 shown in FIG. 29, a kind of the ink is different for each of the tanks 9. For the ink supply device 5B, four kinds of black, yellow, magenta, and cyan are employed as a kind of the ink. Black ink is stored in two of the tanks 9 out of five of the tanks 9. For each of other three of the tanks 9, yellow ink, magenta ink, or cyan ink is stored. The black ink is stored in the tank 9B4 which is fourth and in the tank 9B5 which is fifth from the tank 9B1 of the tank unit 191 in the −Y axis direction being located closest to the side of the Y axis direction. By the way, the arrangement of each of the tanks 9 is the same as one in Example 1; therefore, the detailed description is omitted.

For the ink supply device 5B, the supply tube 43 is provided for each of the tanks 9. For this reason, for the ink supply device 5B, five of the supply tubes 43 are provided. The tank unit 191 is supported by the support frame 73. Of the tank unit 191, each of the tanks 9 is secured to the support frame 73 by screws. Also, the tank case 7 is secured to the support frame 73 by screws. The tank unit 71 is stored in a region surrounded by the support frame 73 and the tank case 7.

Like in Example 1, the space 103 is formed between the bottom surface 89 (FIG. 11) of the tank 9 and the bottom surfaces 101 of the support frame 73. In Example 2, the supply tube 43 connected to the supply port 86 of the tank 9 is piped in the space 103 (FIG. 12). Further, in Example 2, at least a part of the supply tube 43 of the plurality of the supply tubes 43 is piped in a state of being inserted to the opening 93 of the side wall 91 having the frame shape. With this, it is possible to keep low the plurality of the supply tubes 43 from spreading in the space 103.

Figure 30:
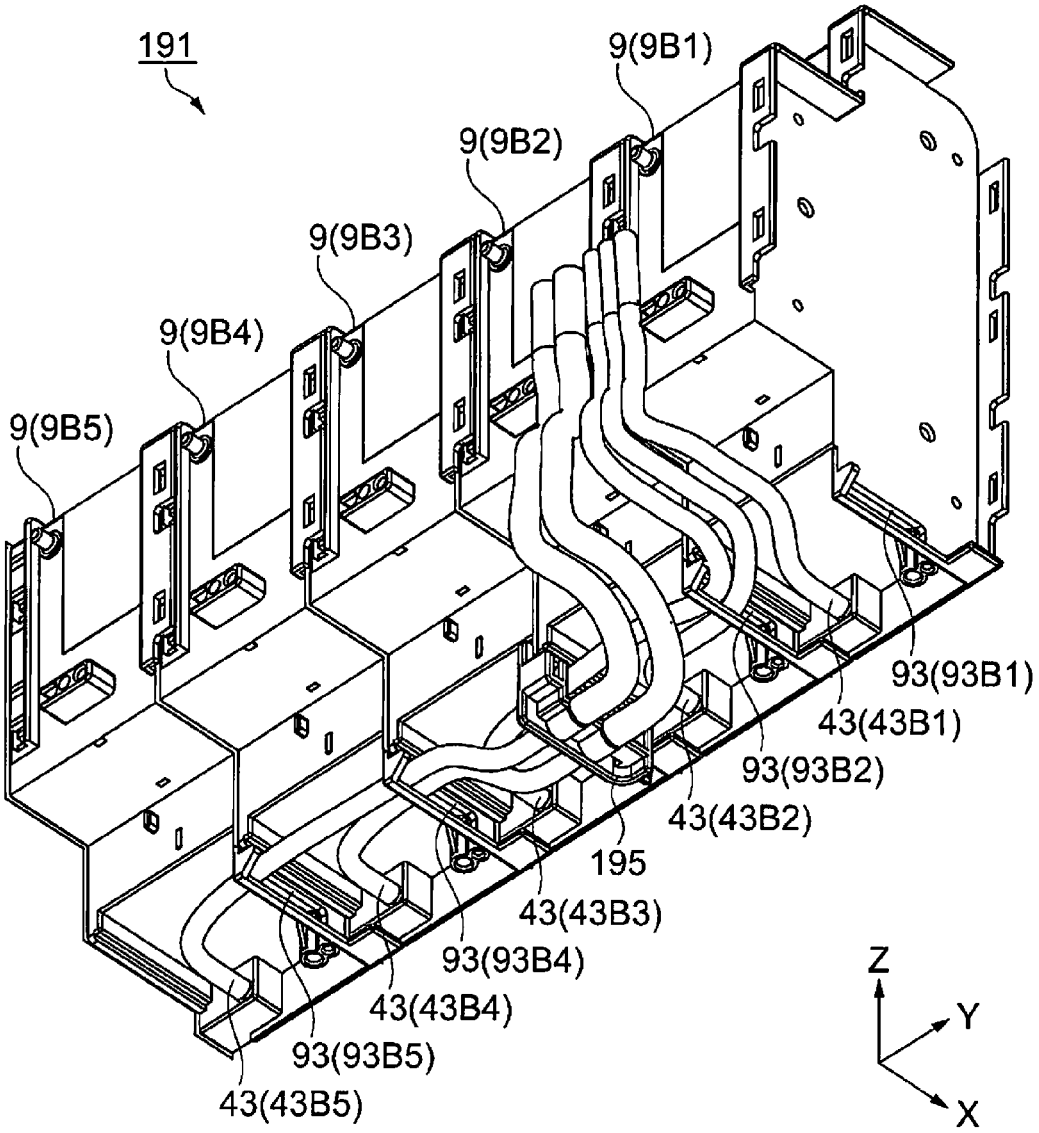
FIG. 30 is a perspective view showing a tank unit of Example 2.

In the tank unit 191, the support member 195 is provided, as shown in FIG. 30. The support member 195 supports three of the supply tubes 43 out of the five of the supply tubes 43 in the Z axis direction. The support member 195 is provided in the tank 9B3 which is third from the tank 981 of the tank unit 191 located closest to the side of the Y axis direction. The support member 195 supports the supply tube 43B5 connected to the tank 9B5, the supply tube 43B4 connected to the tank 9B4 next to the tank 9B5, and the supply tube 43B3 connected to the tank 9B3 next to the tank 9B4.

The supply tube 43B5 connected to the tank 9B5 extends to the support member 195 passing through the opening 93B5 of the tank 9B5 and the opening 9384 of the tank 9B4. The supply tube 43B4 extends to the support member 195 passing through the opening 93B4 of the tank 9B4. In the tank unit 191, one support member 195 is provided, but the number of the support member 195 is not limited to one. An arrangement in which, for example, the plurality of support members 195 are provided as the tank unit 191 can be employed.

Figure 31:
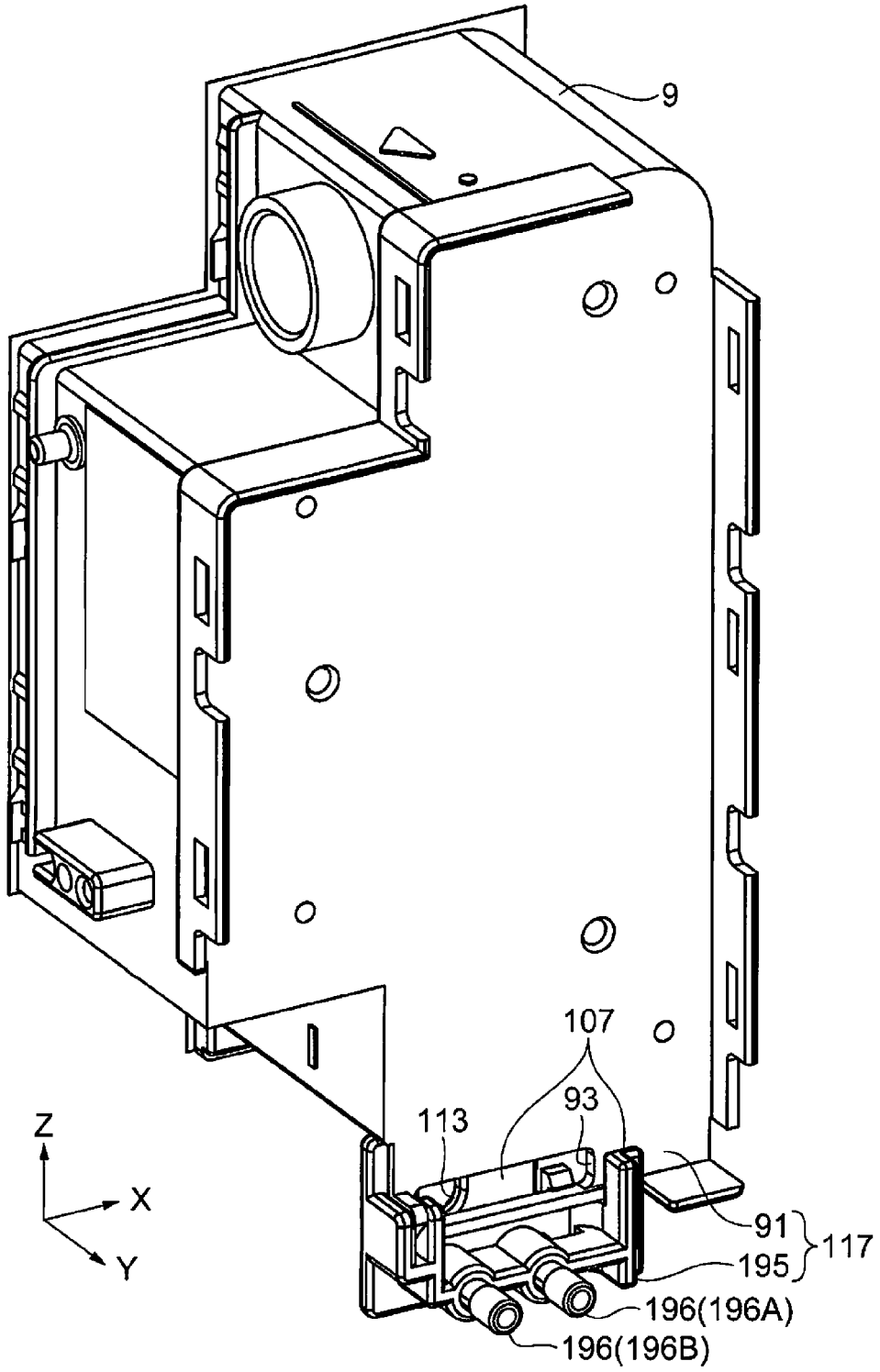
FIG. 31 is a perspective view showing the tank and a support member of Example 2.
Figure 32:
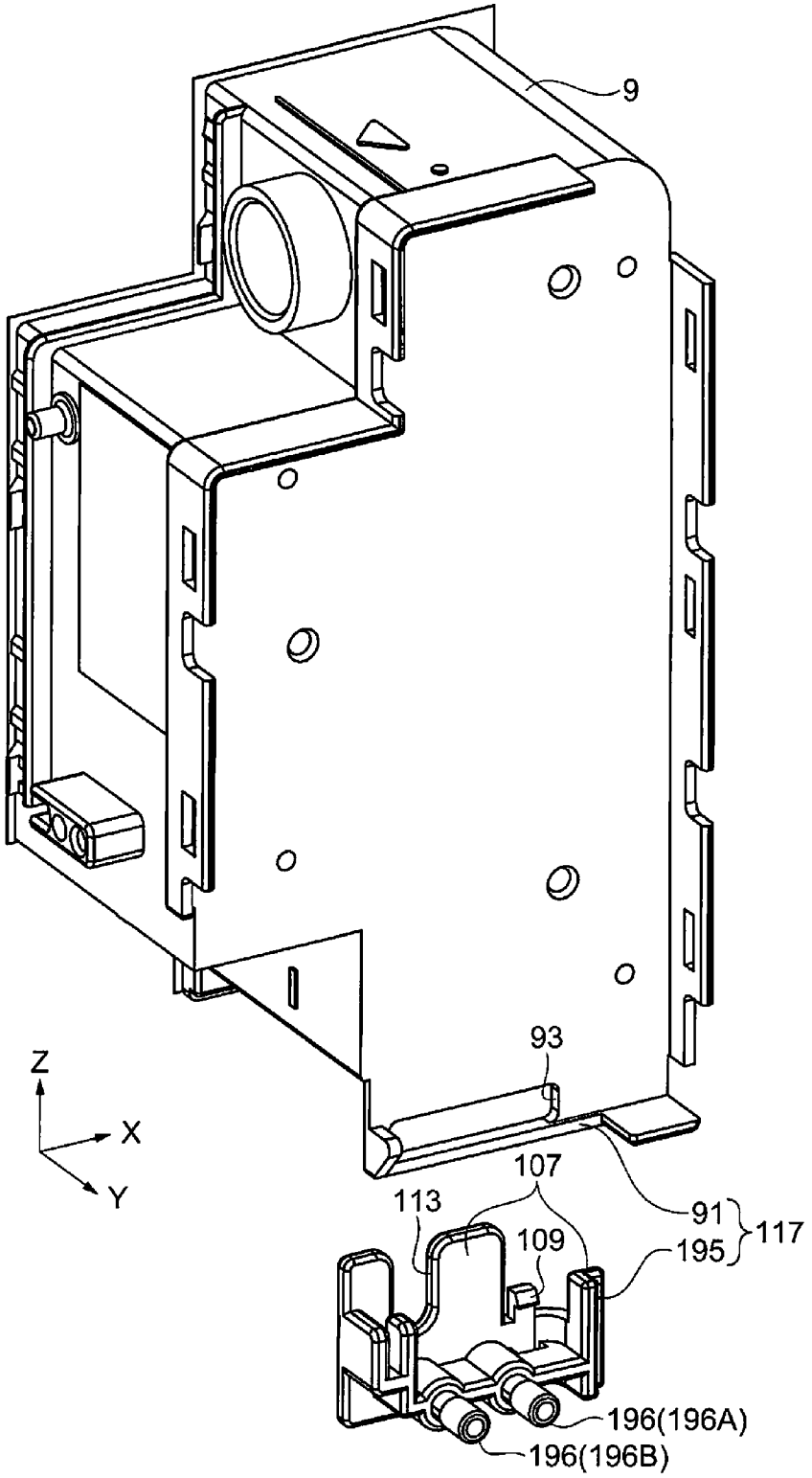
FIG. 32 is an exploded perspective view showing the tank and the support member of Example 2.

The support member 195, as shown in FIG. 31, is provided on the side wall 91 of the tank 9. The support member 195, as shown in FIG. 32, is arranged to be attachable to and detachable from the tank 9. The support member 195, like in Example 1, includes the pair of the fitting sections 107 and the engagement section 109. Also, like in Example 1, the notch 113 is provided at the support member 195. On the other hand, the support member 195 is different from one in Example 1 for including a joint section 196. At the support member 195, two of the joint sections 196 are provided. The number of the joint sections 196 is not limited to two, but can be one, or more than three. Hereinafter, in order to identify the two of the joint sections 196, each of the two of the joint sections 196 is shown as a joint section 196A and a joint section 196B.

Figure 33:
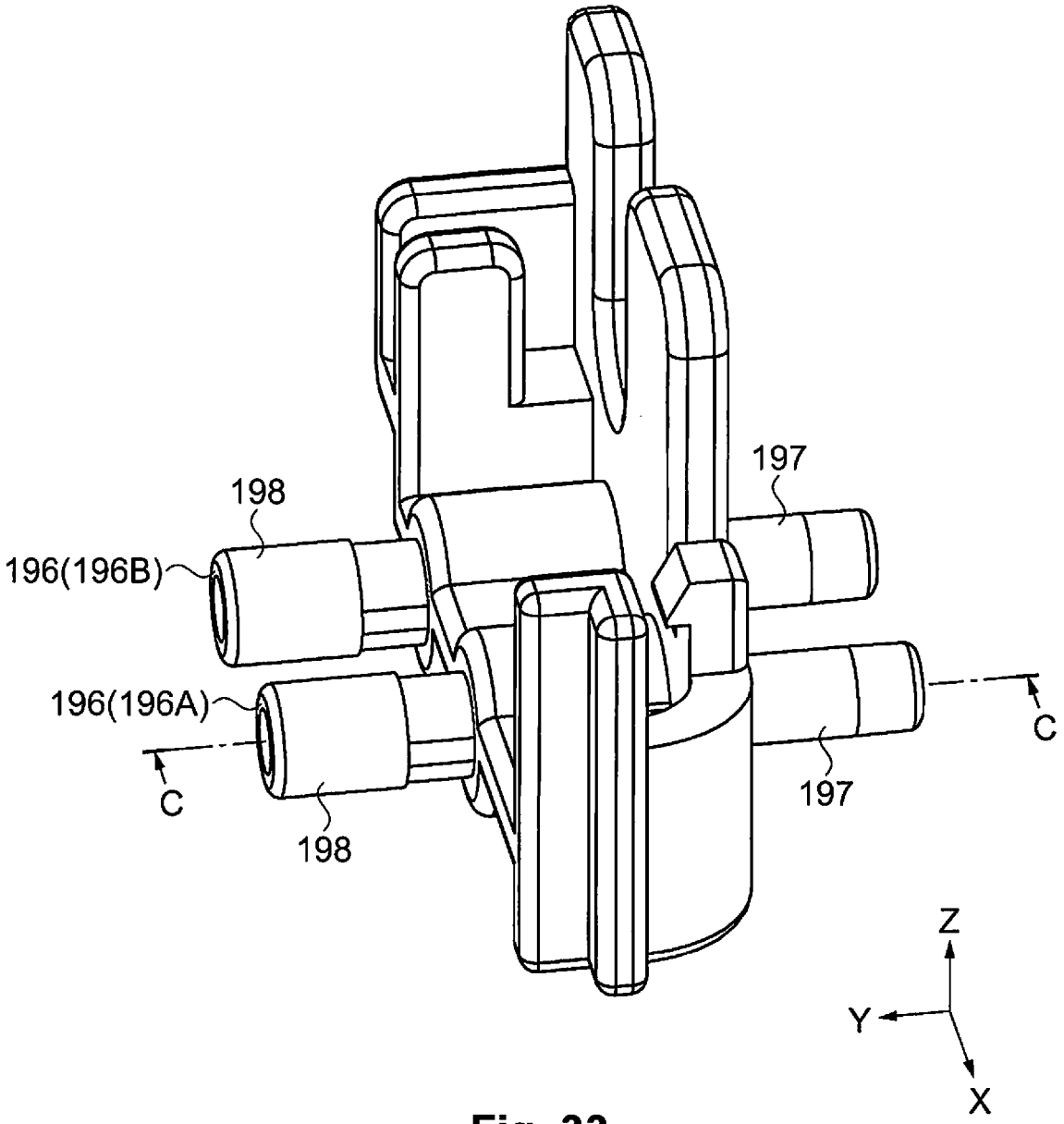
FIG. 33 is a perspective view showing the support member of Example 2.
Figure 34:
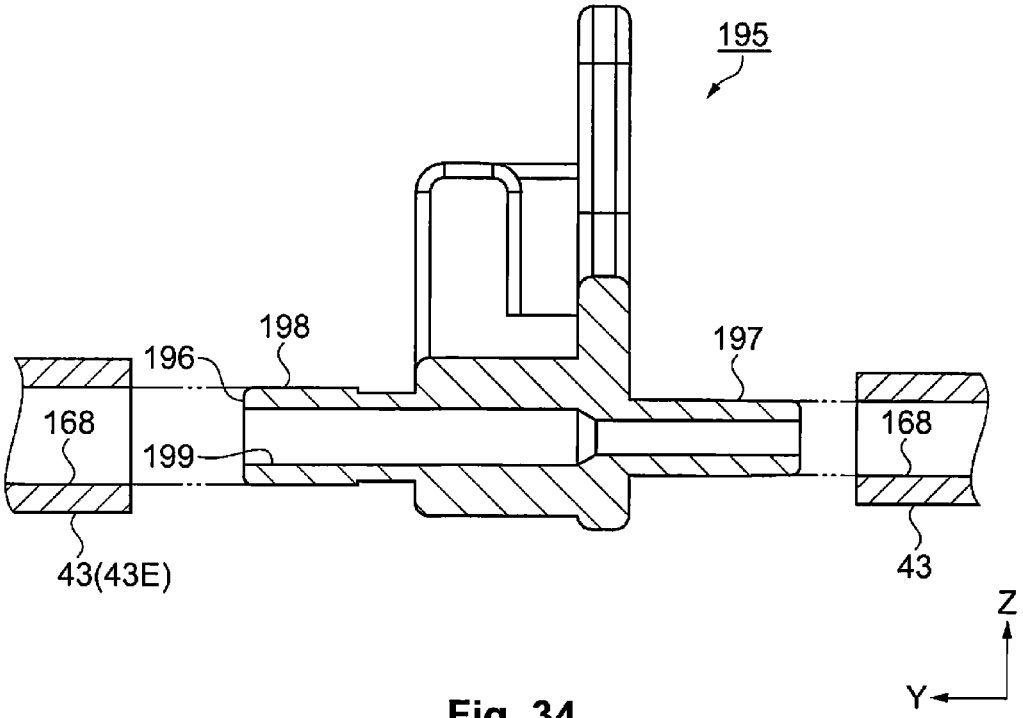
FIG. 34 is a cross-sectional view of C-C line in FIG. 33.

The joint section 196 extends, as shown in FIG. 33, along the Y axis. At the joint section 196, the first fitting section 197 and the second fitting section 198 are provided. As shown in FIG. 34 which is a cross-sectional view of C-C line in FIG. 33, at the joint section 196, a through-hole 199 penetrating through the joint section 196 along the Y axis. To each of the first fitting section 197 and the second fitting section 198, the supply tube 43 is coupled. The supply tube 43 coupled to the first fitting section 197 and the supply tube 43 coupled to the second fitting section 198 are communicated via the through-hole 199 to each other. With this, the joint section 196 is arranged to be capable of coupling the two of the supply tubes 43. Hereinafter, the supply tube 43 which is coupled with the second fitting section 198 is denoted as an extension tube 43E.

Figure 35:
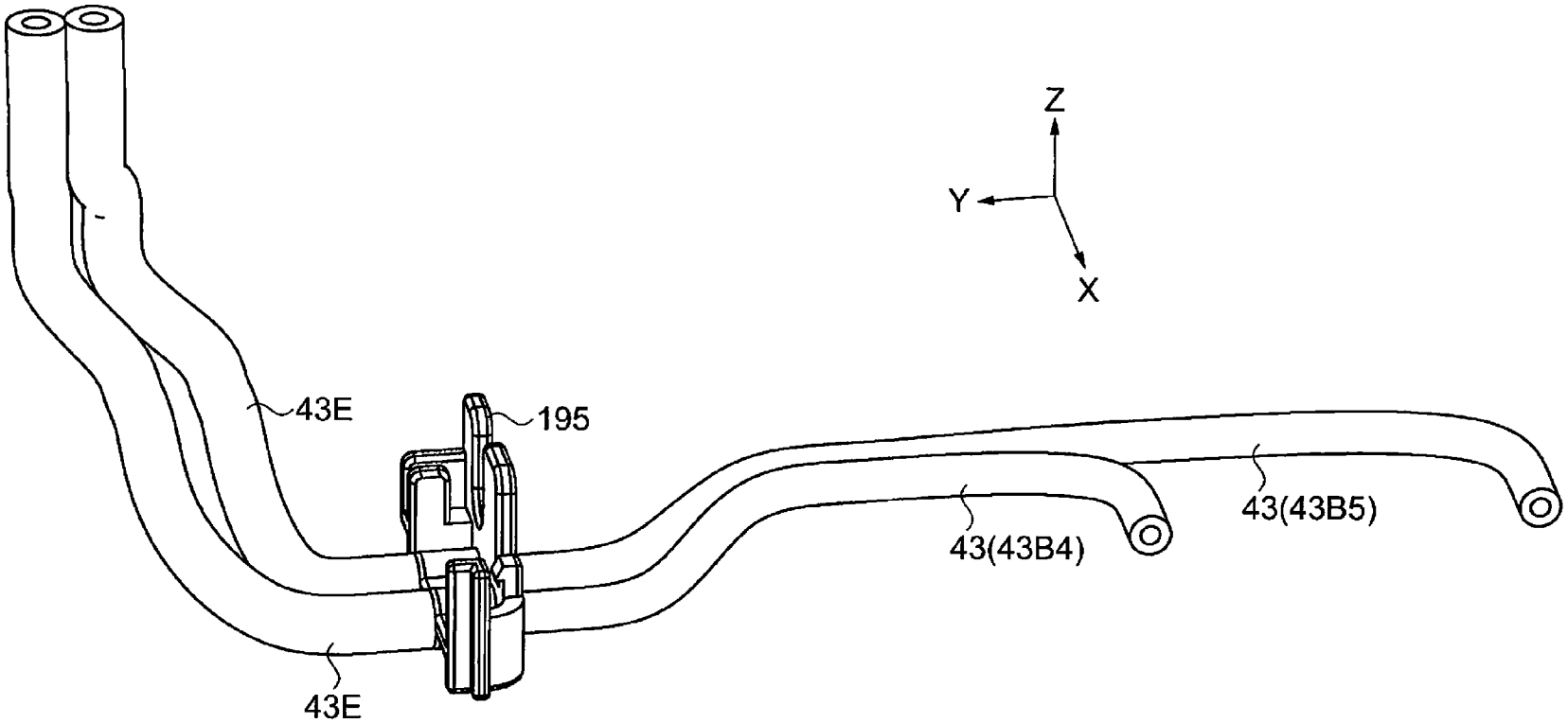
FIG. 35 is a perspective view showing the support member, a supply tube, and an extension tube of Example 2.

In Example 2, width of the first fitting section 197 and width of the second fitting section 198 are different to each other. In this example, the width of the second fitting section 198 is wider than the width of the first fitting section 197. For this reason, width of an extension tube 43E coupled to the second fitting section 198 is larger than the width of the supply tube 43 coupled to the first fitting section 197. For this reason, the channel 168 of the extension tube 43E coupled to the second fitting section 198 is wider than the channel 168 of the supply tube 43 coupled to the first fitting section 197. In Example 2, as shown in FIG. 35, each of the supply tube 43B4 and the supply tube 43B5 is connected to the extension tube 43E via the support member 195.

Figure 36:
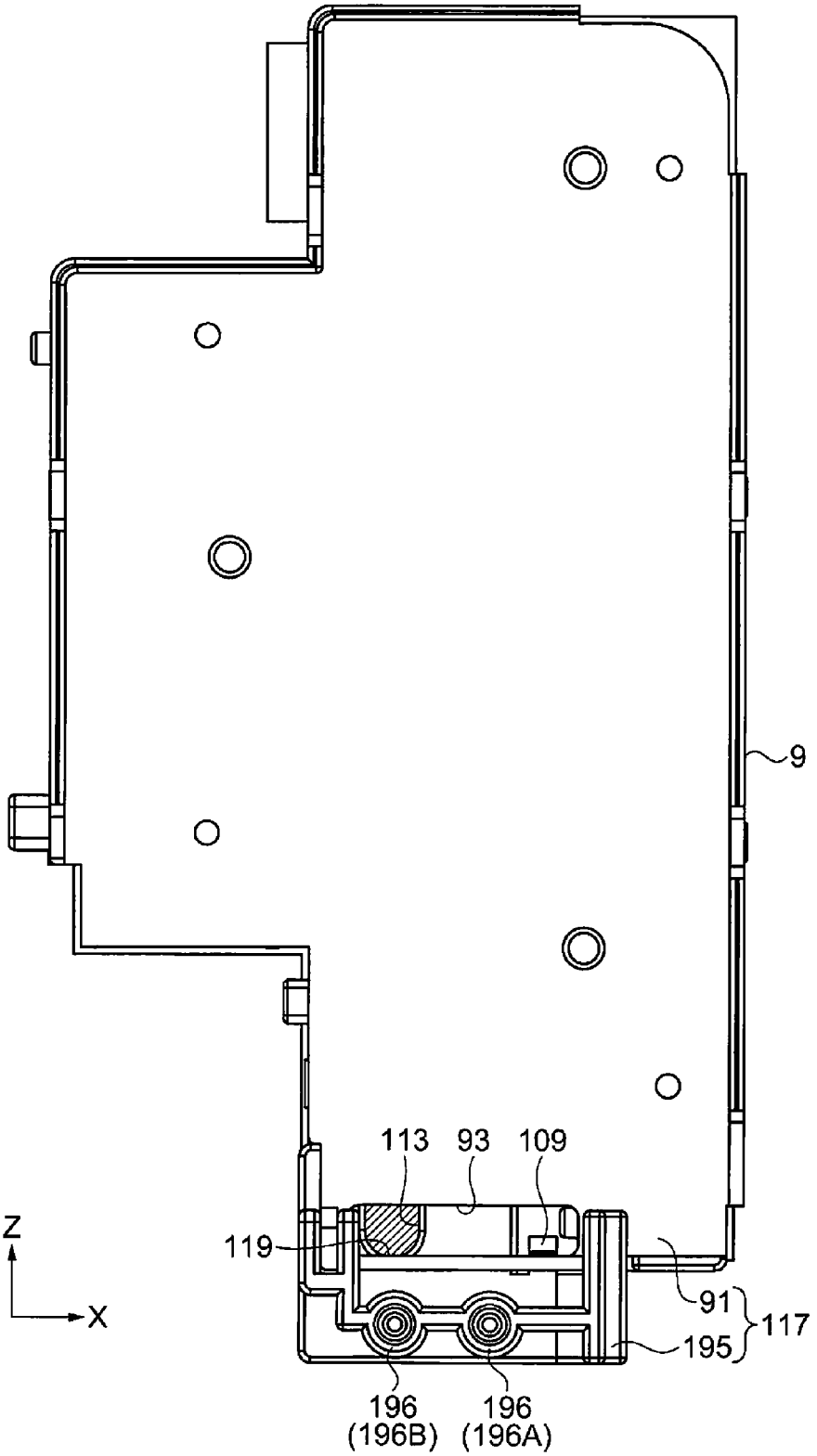
FIG. 36 is a side view showing the tank and the support member of Example 2.

The support member 195 having the above mentioned arrangements, as shown in FIG. 36, is equipped on the side wall 91 of the tank 9. In a state in which the support member 195 is equipped on the tank 9, the support member 195 and the side wall 91 constitute the support section 117. From a state in which the support member 195 is equipped to the tank 9, the engagement of the engagement section 109 is released, the support member 105 is moved in the −Z axis direction with respect to the tank 9, and therefore it is possible to remove the support member 195 from the tank 9.

In a state in which the support member 195 is equipped to the tank 9, the notch 113 overlaps the opening 93 of the tank 9. Then, the opening 93 and the notch 113 constitute the opening 119. In FIG. 36, in order to understand the arrangements better, a region of the opening 119 is hatched. The opening 119 is set to be in a size, such that the supply tube 43 can be inserted. The supply tube 43 inserted in the opening 119 is supported in the Z axis direction by the opening 119. Also, a change amount in the X and −X axis direction of the supply tube 43 inserted in the opening 119 is limited by the opening 93 and the support member 105.

Figure 37:
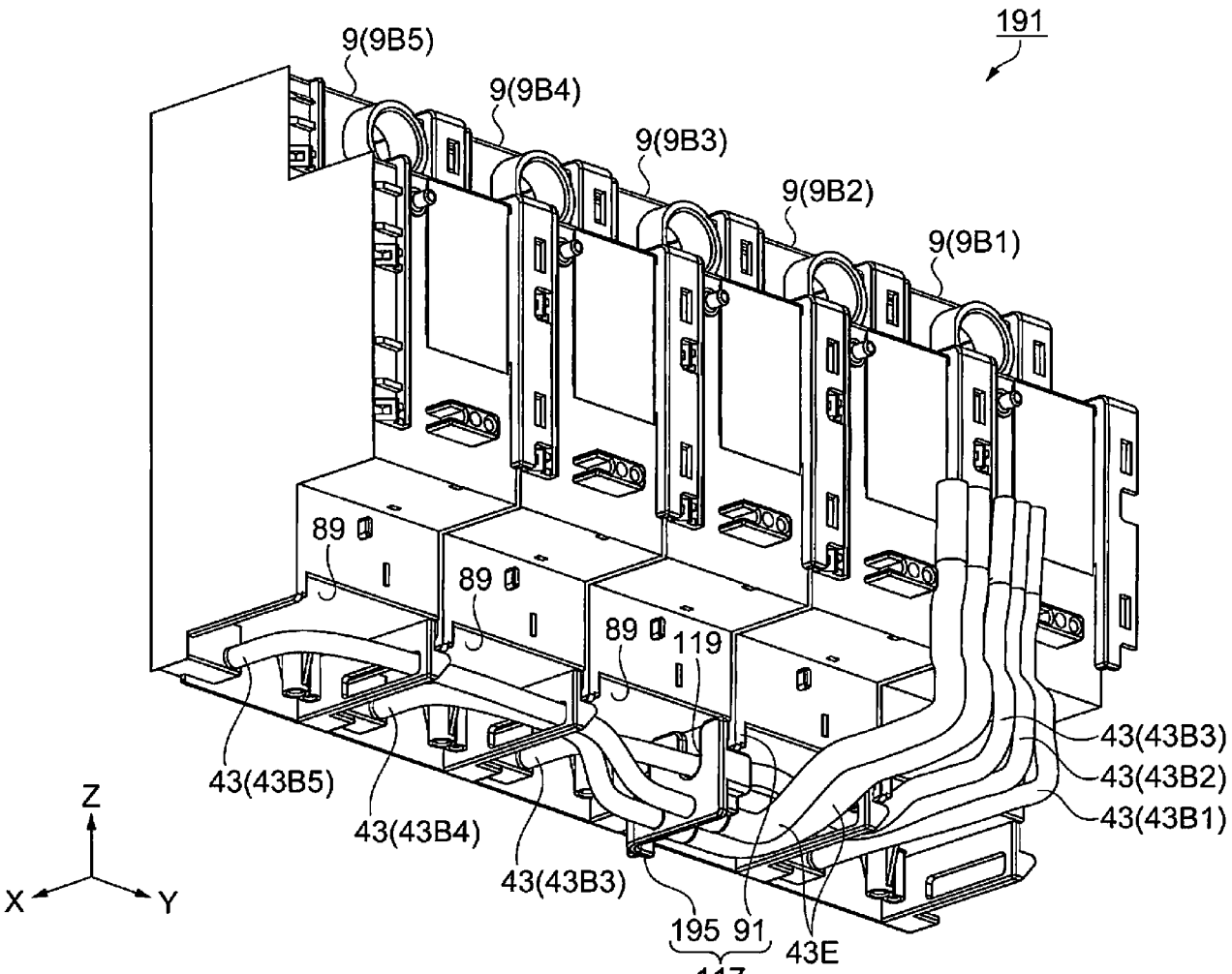
FIG. 37 is a perspective view showing the tank unit of Example 2.

In the opening 119, as shown in FIG. 37, the supply tube 4383 connected to the tank 9B3 is inserted. With this, the supply tube 43B5, the supply tube 43B4, and the supply tube 43B3 of the plurality of the supply tubes 43, and two of the extension tubes 43E are supported by the support section 117. The support section 117 supports on the bottom surface 89 the supply tube 43B5, the supply tube 43B4, the supply tube 43B3, and the two of the extension tube 43E. By the support section 117, the supply tube 43B3 is shifted towards the Z axis direction further than the supply tube 43B5 and the supply tube 43B4. In other words, the support section 117 aligns in the direction intersecting the bottom surface 89 the supply tube 43B5, the supply tube 43B4, and the supply tube 43B3, and supports thereon. In other words, the supply tube 43B5, the supply tube 43B4, and the supply tube 43B3 are aligned in the up-and-down direction. By this, it is easier to avoid the space 103 (FIG. 12) expanding, which is necessary for piping the supply tube 43, along the bottom surface 89 of the tank 9.

The support section 117 of Example 2 attains similar effects to the ones of the support section 117 of Example 1. The direction of aligning the supply tube 43B5, the supply tube 43B4, and the supply tube 43B3 is not limited to the up-and-down direction along the Z axis. The direction of aligning the supply tube 43B5, the supply tube 43B4, and the supply tube 43B3 can be zigzag, as long as the supply tube 43B5, the supply tube 43B4, and the supply tube 43B3 are not aligned in the up-and-down direction. Also, a surface on which the support section 117 supports the supply tube 43 is not limited to the bottom surface 89, but can be a different side plane. Also, the width of the supply tube 43 and the width of the extension tube 43E are not limited to the above, an arrangement in which the width of the supply tube 43 is wider than the width of the extension tube 43E can be employed. Further, an arrangement in which the width of the supply tube 43 as large as the width of the extension tube 43E can be employed.

Figure 38:
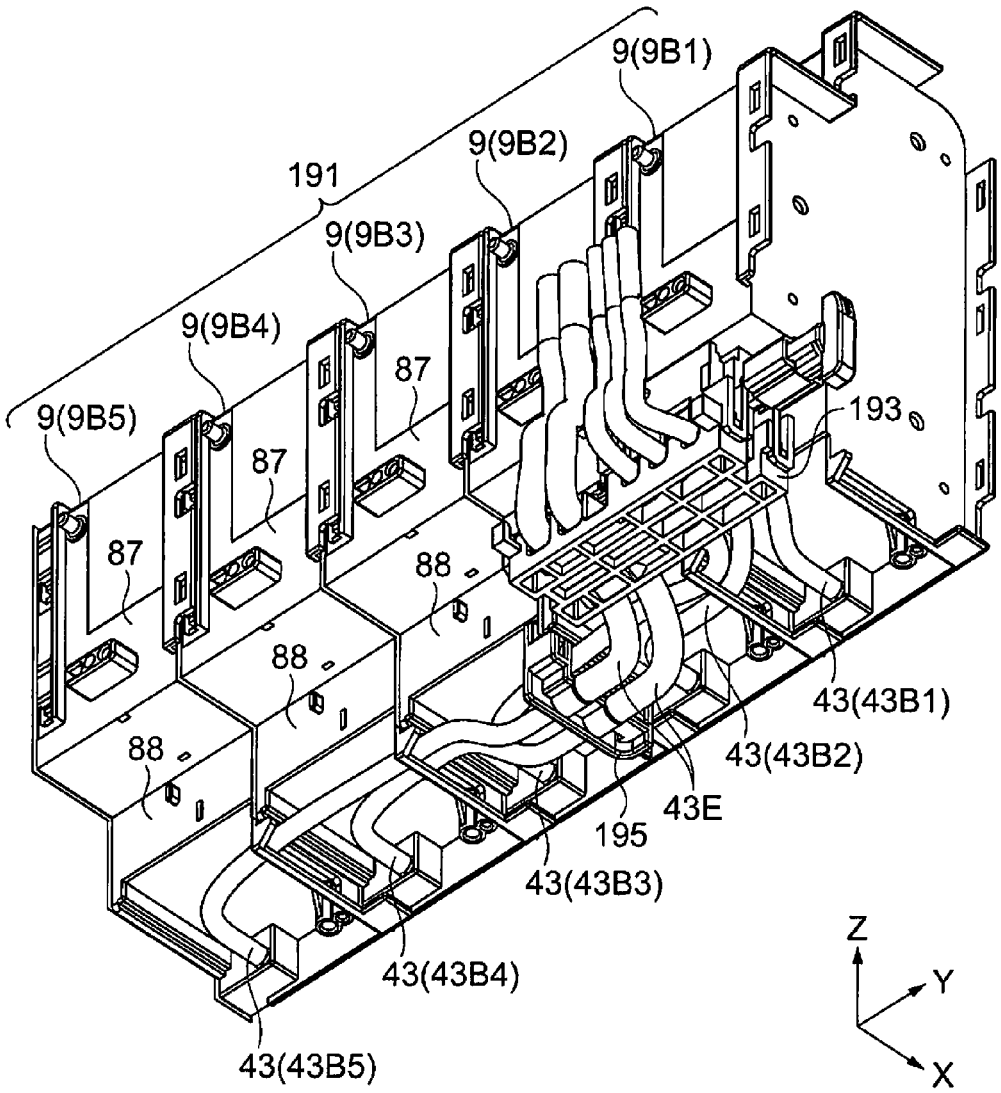
FIG. 38 is a perspective view showing the tank unit and a flow passage opening/closing device of Example 2.

The flow passage opening/closing device 193, as shown in FIG. 38, in the path of the supply tube 43B5, the supply tube 43B4, and the supply tube 43B3, is provided closer to an opposite side of the tank 9 than the support member 195, namely provided closer to the side of the print head 47 (FIG. 5) than the support member 195. Like in Example 1, the flow passage opening/closing device 193, at the five of the tanks 9 of the tank unit 191, is provided at a part of the space of the gap between the side wall 87 and the side wall 88. At the ink supply device 5B, the flow passage opening/closing device 193 is provided astride the tank 9B2 and the tank 9B 1 in the Y axis direction.

Figure 39:
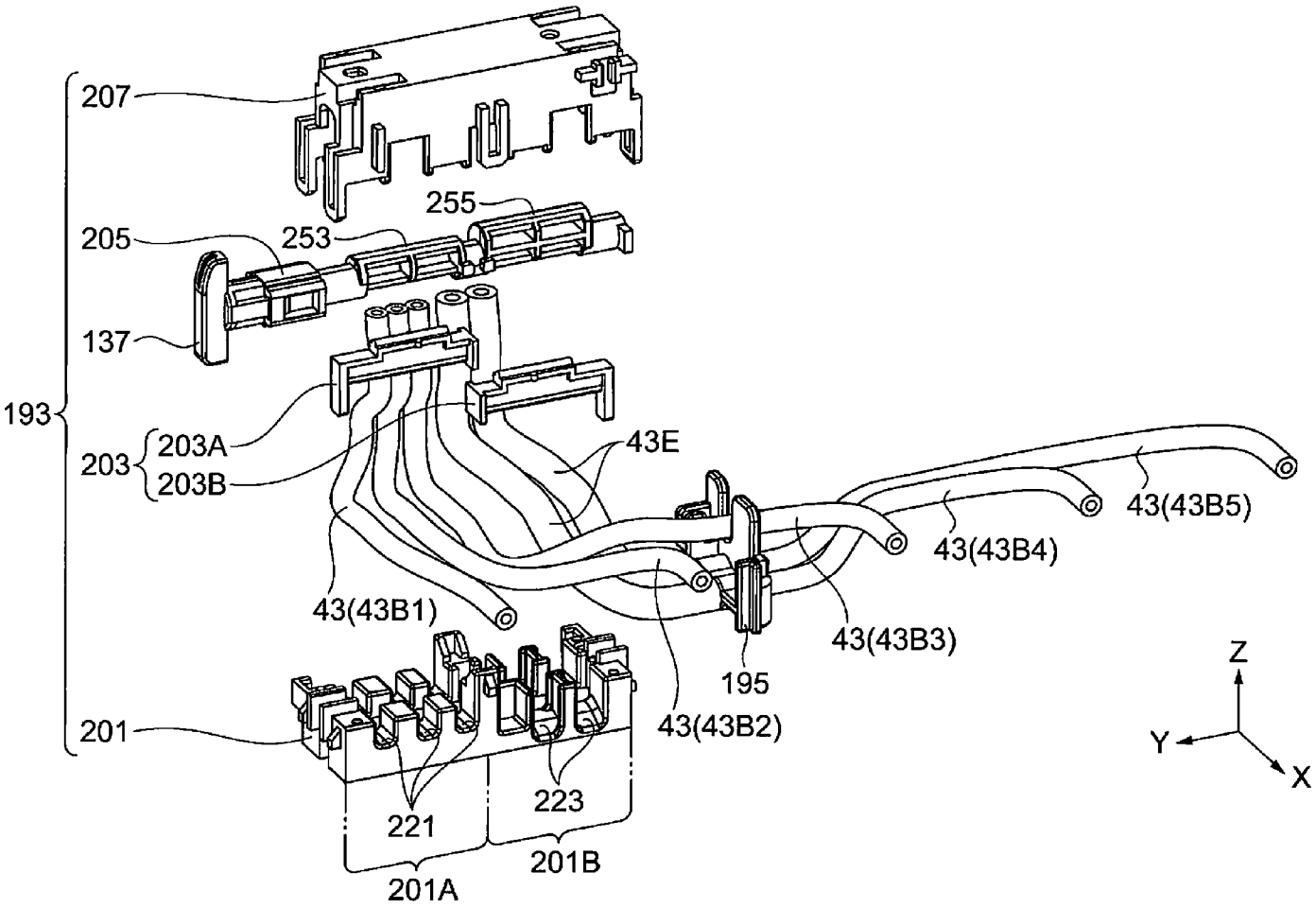
FIG. 39 is an exploded perspective view showing the flow passage opening/closing device of Example 2.

The flow passage opening/closing device 193, as shown in FIG. 39, includes a tube support section 201, a pressing member 203, a cam member 205, the operation knob 137, and a cove 207. The tube support section 201 is provided close to the −Z axis direction than the supply tube 43B1, the supply tube 43B2, the supply tube 43B1, and the two of the extension tubes 43E. The tube support section 201 is sectionalized into the first tube support section 201A, and a second tube support section 201B. The pressing member 203 is provided closer to the opposite side of the tube support section 201 than the supply tube 43B1, the supply tube 43B2, the supply tube 43B1, and the two of the extension tubes 43E. The pressing member 203 includes a first pressing member 203A and a second pressing member 203B. The first pressing member 203A and the second pressing member 203B are mutually independently provided. The cam member 205 is provided on the opposite side of the tube support section 201 of the pressing member 203, namely on the side of the Z axis direction of the pressing member 203. The cover 207 is provided on the opposite side of the tube support section 201 of the cam member 205, namely on the side of the Z axis of the cam member 205.

At the first support section 201 A of the tube support section 201, a plurality of grooves 221 are provided. At the second tube support section 201B, a plurality of grooves 223 are provided. The first tube support section 201*a* is a region in which the plurality of grooves 221 are provided. The second tube support section 201B is a region in which the plurality of groove 223 are provided. The plurality of grooves 221 are aligned at the first tube support section 201A along the Y axis. The plurality of grooves 223 are aligned at the second tube support section 201B along the Y axis. In each of the grooves 221, each of the supply tube 43B1, the supply tube 43B2, and supply tube 43B1 of the plurality of the supply tubes 43 is inserted. The extension tube 43E is inserted in each of the grooves 223.

Figure 40:
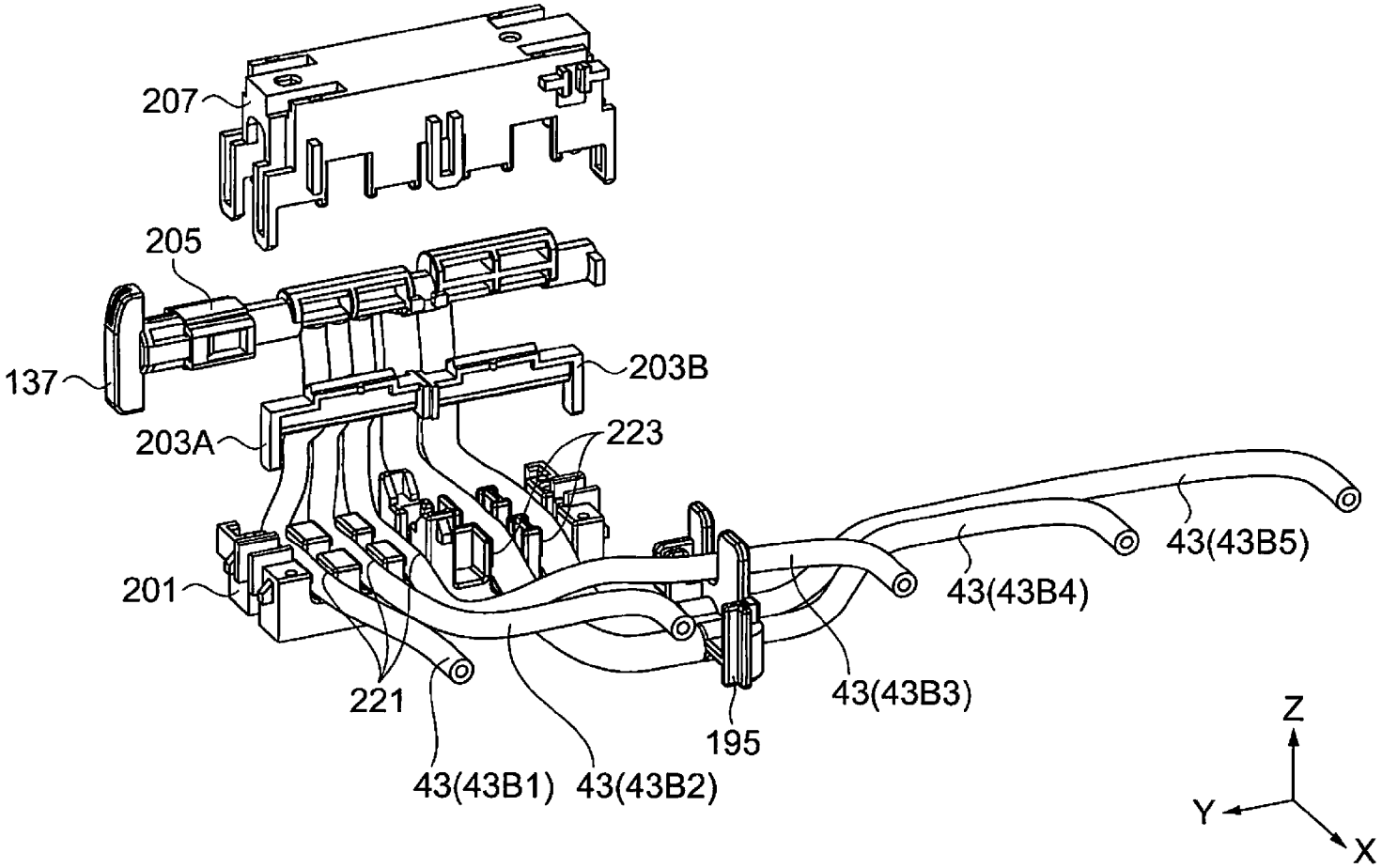
FIG. 40 is an exploded perspective view showing the flow passage opening/closing device of Example 2.

The supply tube 43B1, the supply tube 43B2, and the supply tube 43B1, as shown in FIG. 40, are deployed in the groove 221 along the groove 221. For this reason, the supply tube 43B1, the supply tube 43B2, and the supply tube 43B1 are supports by the first tube support section 201A (FIG. 39) of the tube support section 201. Also, each of the extension tubes 43E is deployed in the groove 223 along the groove 223. For this reason, each of the extension tubes 43E is supported by the second tube support section 201B (FIG. 39) of the tube support section 201. By the above, the supply tube 43B1, the supply tube 43B2, the supply tube 43B1, and the two of the extension tubes 43E are aligned at the tube support section 201 along the Y axis.

The first pressing member 203A, as shown in FIG. 40, extends along the Y axis, and at the tube support section 201 intersects the supply tube 43B1, the supply tube 43B2, and the supply tube 43B1. The first pressing member 203A has length to stride the supply tube 43B1, the supply tube 43B2, and the supply tube 43B1 along the Y axis. The second pressing member 203B extends along the Y axis, and on the tube support section 201 intersects with the two of the extension tubes 43E. The second pressing member 203B has length to stride the two of the extension tubes 43E along the Y axis.

Figure 41:
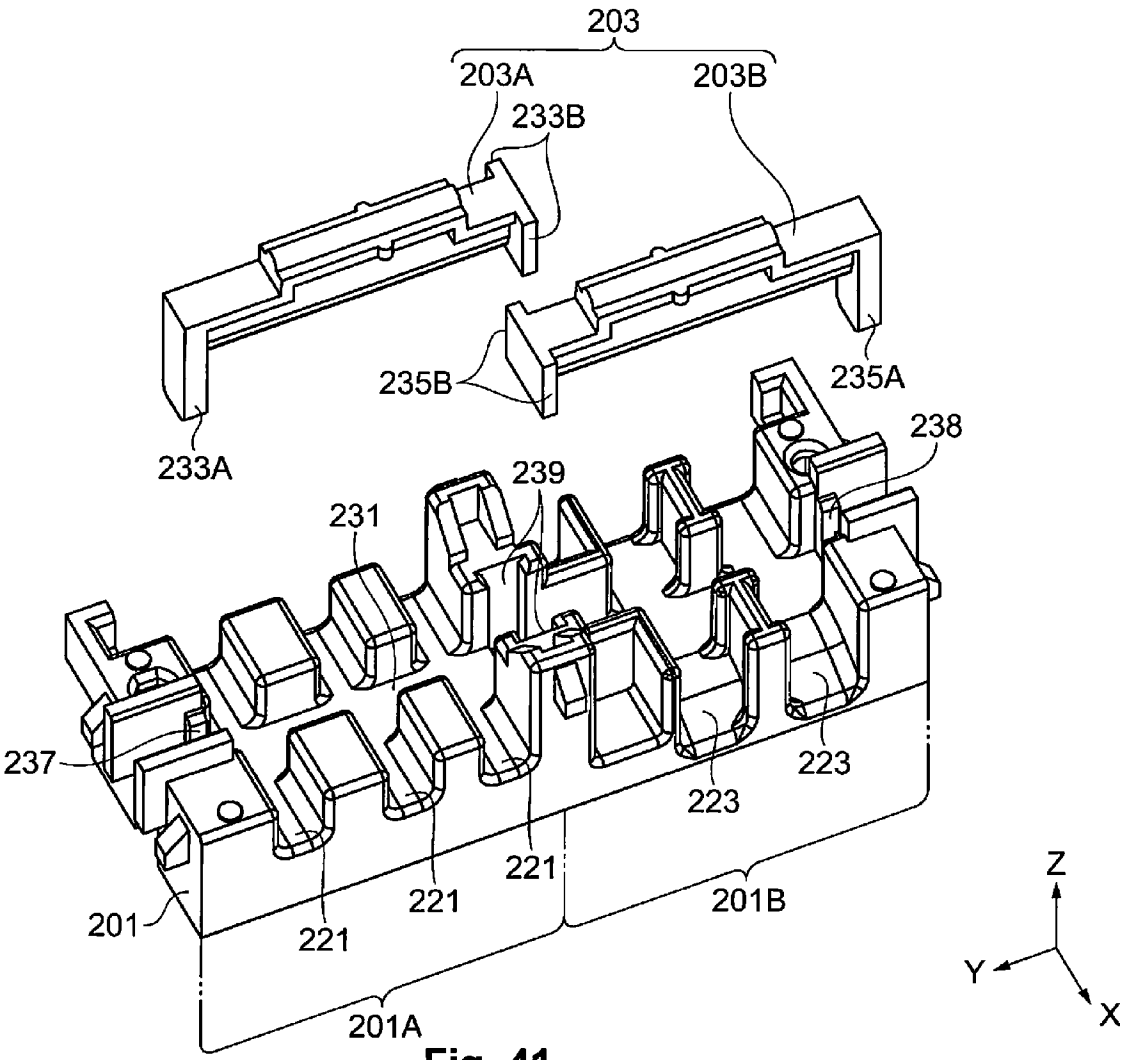
FIG. 41 is an exploded perspective view showing a tube support section and a pressing member of Example 2.

At the tube support section 201, as shown in FIG. 41, a recessed section 231 to which the pressing member 203 can be inserted is provided to stride the first tube support section 201A and the second tube support section 201B. In the present example, at the first tube support section 201A, the first pressing member 203A can be inserted in the recessed section 231 until a position at which the first pressing member 203A abuts a bottom part of the recessed section 231. Also, at the second tube support section 201B, the second pressing member 203B can be inserted in the recessed section 231 until a position at which the second pressing member 203B abuts a bottom part of the recessed section 231. At the first pressing member 203A, a guide section 233A and a guided section 233B are provided. At the second pressing member 203B, a guided section 235A and a guided section 235B are provided.

Also, at the tube support section 201, a guide section 237 in which the guided section 233A can be inserted is provided at a position opposing to the guided section 233A of the first pressing member 203A. At the tube support section 201, a guide section 238 in which the guided section 235A can be inserted is provided at a position opposing to the guided section 235A of the second pressing member 203B. Then, at the tube support section 201, a guide section 239 in which the guided section 233B and the guided section 235B can be inserted is provided at a position opposing to the guided section 233B of the first pressing member 203A and the guided section 235B of the second pressing member 203B.

At the first pressing member 203A and the tube support section 201, the first pressing member 203A can be inserted in the recessed section 231 of the tube support section 201 by inserting the guided section 233A in the guide section 237. Further, at the second pressing member 203B and the tube support section 201, the second pressing member 203B can be inserted in the recessed section 231 of the tube support section 201 by inserting the guided section 235A in the guide section 238 and inserting the guided section 235B in the guide section 239.

In a state in which the first pressing member 203A is inserted in the recessed section 231, it is set to form a space between the first pressing member 203A and the recessed section 231. Further, in a state in which the first pressing member 203A is inserted in the recessed section 231, spaces are formed between the guided section 233A and the guide section 237, and between the guided section 233B and the guide section 239. In a state in which the second pressing member 203B is inserted in the recessed section 231, it is set to form a space between the second pressing member 203B and the recessed section 231. Further, in a state in which the second pressing member 203B is inserted in the recessed section 231, spaces are formed between the guided section 235A and the guide section 238, and between the guided section 235B and the guide section 239.

For this reason, it is possible to insert the pressing member 203 in the recessed section 231 smoothly, and removing the pressing member 203 from the recessed section 231 smoothly. Also, when inserting and removing the pressing member 203 in and from the recessed section 231, the guided section 233A is guided by the guide section 237, the guided section 235A is guided by the guide section 238, and the guided section 233B and the guided section 235B are guided by the guide section 239. For this reason, it is possible to keep lower the misalignment of the pressing member 203 with respire to the tube support section 201 along the XY plane.

Figure 42:
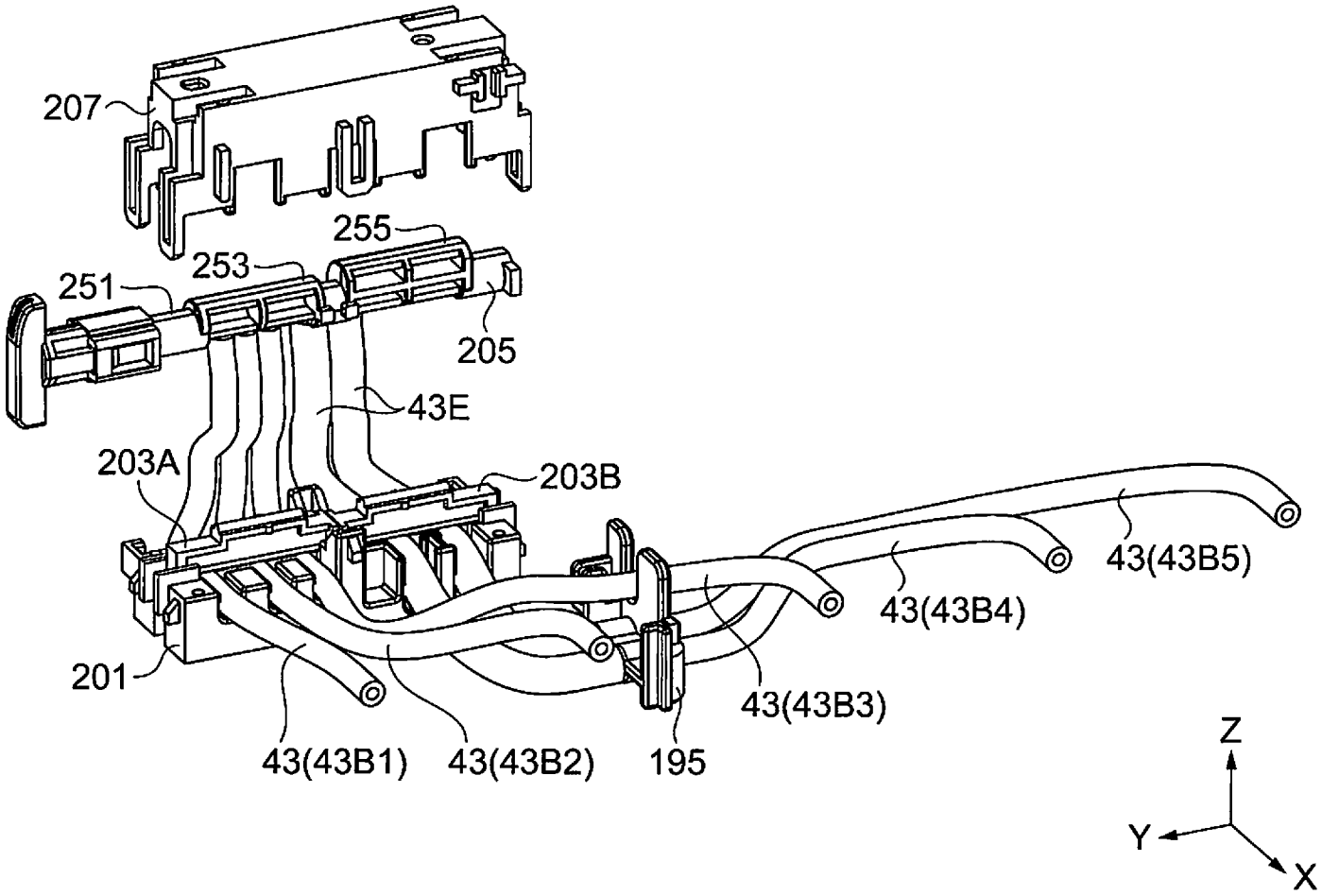
FIG. 42 is an exploded perspective view showing the flow passage opening/closing device of Example 2.

The first pressing member 203A, as shown in FIG. 42, in a state in which the supply tube 43 is deployed in the groove 221 of the tube support section 201 (FIG. 41), is provided at a position opposing to the recessed section 231 (FIG. 41) across the supply tube 43. With this, three of the supply tubes 43 are sandwiched by the tube support section 201 and the first pressing member 203A. The second pressing member 203B, as shown in FIG. 42, in a state in which the extension tube 43E is deployed in the groove 223 (FIG. 41) of the tube support section 201, is provided at a position oppose to the recessed section 231 (FIG. 41) across the extension tube 43E. With this, the two extension tubes 43E are sandwiched by the tube support section 201 and the second pressing member 203B. The length of the first pressing member 203A along the Y axis and the length of the second pressing member 203B along the Y axis are set to be substantially same to each other. With this, it is easy to align in response to the supply tube 43 and the extension tube 43E, and manufacturing becomes easy.

Figure 43:
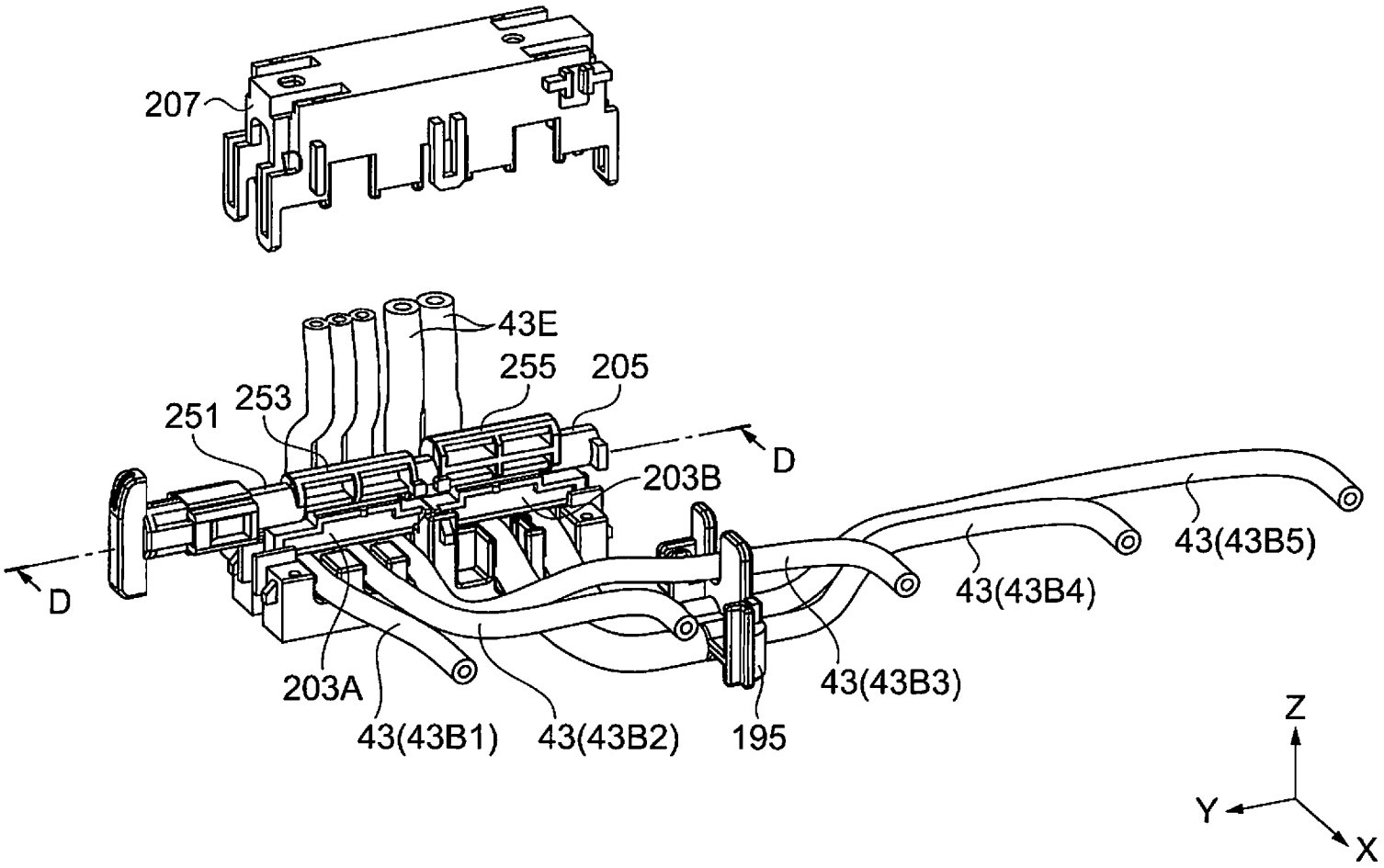
FIG. 43 is an exploded perspective view showing the flow passage opening/closing device of Example 2.

The cam member 205, as shown in FIG. 42, includes a shaft section 251, a first cam 253, and a second cam 255. The shaft section 251 extends along the Y axis, and has length covering, at the tube support section 201, the three of the supply tubes 43 and the two of the extension tubes 43E along the Y axis. Each of the first cam 253 and the second cam 255 is provided on the shaft section 251. The first cam 253 and the second cam 255 are aligned along the Y axis. The first cam 253 is provided closer to the side of the operation knob 137 than the second cam 255, namely closer to the side of the Y axis direction than the second cam 255. The first cam 253 is provided at a position opposing to the first pressing member 203A. The second cam 255 is provided at a position opposing to the second pressing member 203B. Then, the cam member 205, as shown in FIG. 43, is provided at a position at which the first pressing member 203A and the second pressing member 203B can be abutted. At this time, the first cam 253 of the cam member 205 can abut the first pressing member 203A. Also, the second cam 255 can abut the second pressing member 203B.

Figure 44:
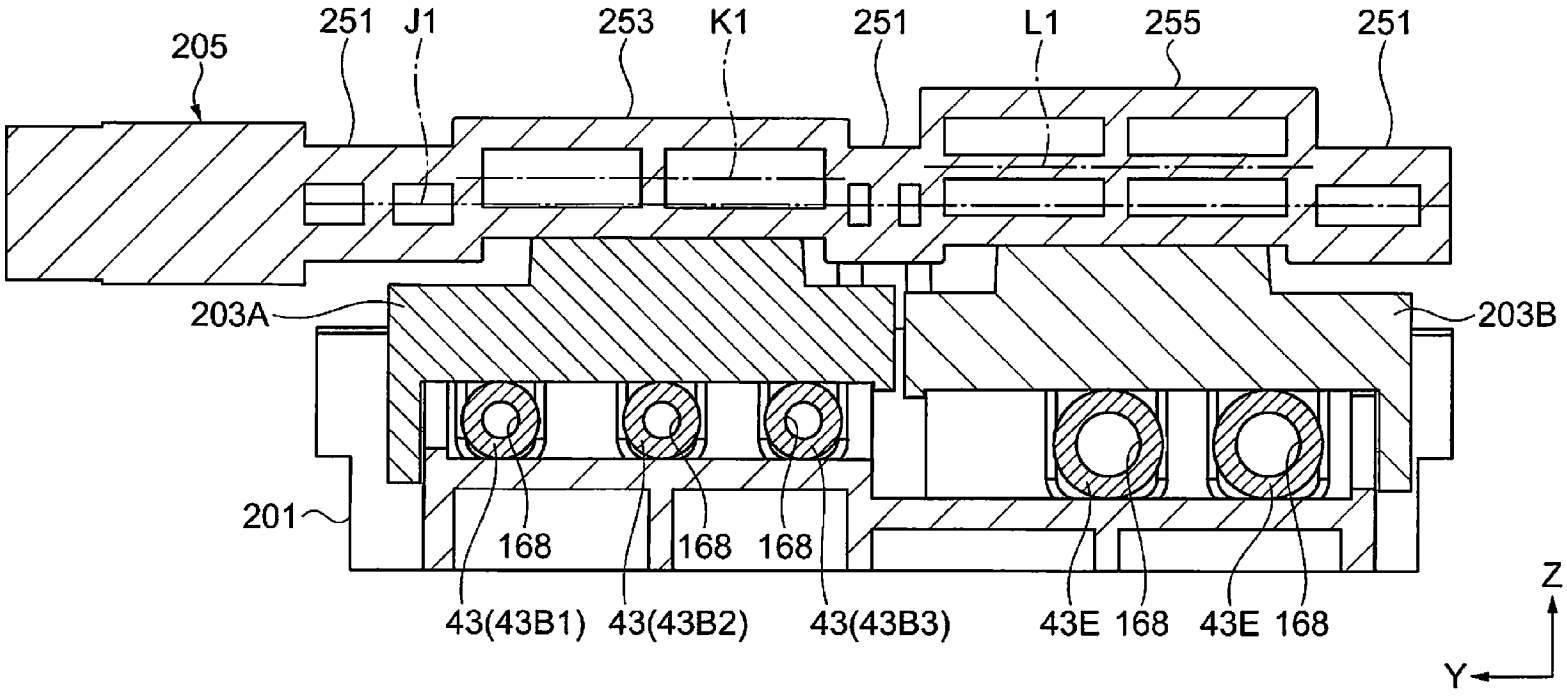
FIG. 44 is a cross-sectional view of D-D line in FIG. 43.
Figure 45:
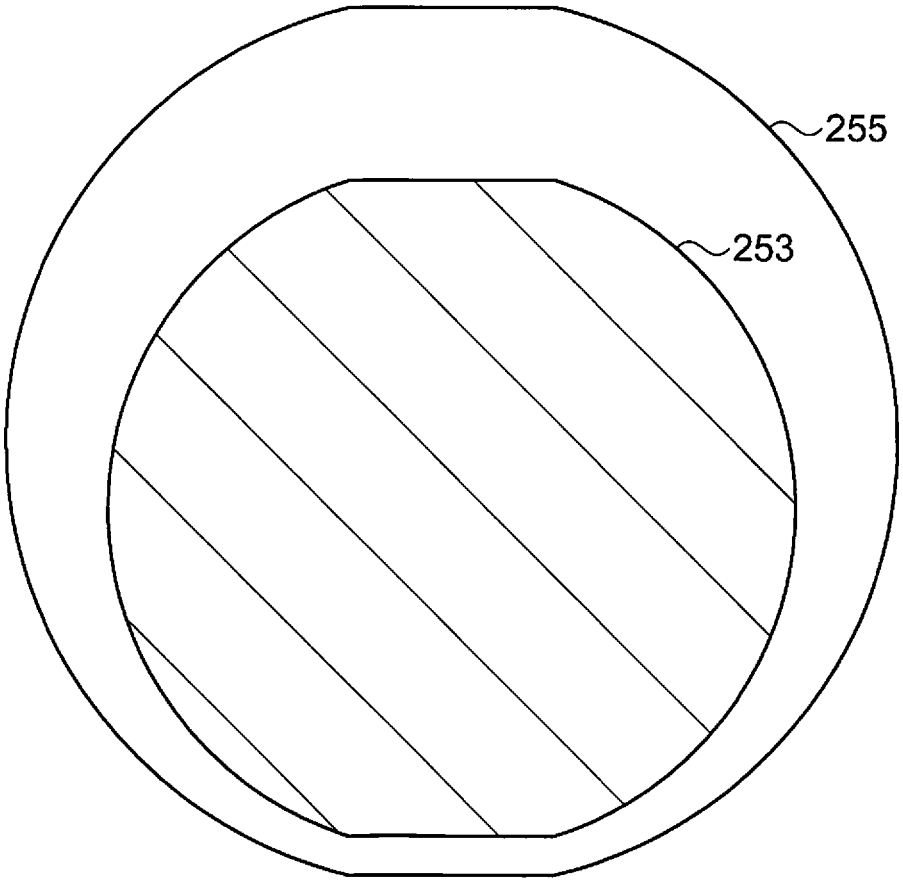
FIG. 45 is a perspective view showing a cross-section of an XZ plane formed by a first cam and a second cam of Example 2.

The shaft section 251 of the cam member 205, as shown in FIG. 44 which is a cross-sectional view of D-D line in FIG. 43, has an axial shape, and a circular outer periphery with a line J1 as the center. The first cam 253 has an outer periphery including a profile of a circular arc with a line K1 as the center. The second cam 255 has an outer periphery including a profile of circular arc with a line L1 as the center. The line J1, the lien K1, and the line L1 are mutually misaligned. In other words, the centers of the shaft section 251 and the first cam 253 are mutually misaligned (being eccentric). Further, the centers of the shaft section 251 and the second cam 255 are mutually misaligned (being eccentric). Further, the centers of the first cam 253 and the second cam 255 are mutually misaligned (being eccentric). The first cam 253 and the second cam 255, as shown in FIG. 45 which shows schematically a cross-section of the first cam 253 and the second cam 255 in the XZ plane, have cross-sections which are substantially homologous and are different in size. The cross-section of the second cam 255 is larger than the cross-section of the first cam 253.

Figure 46:
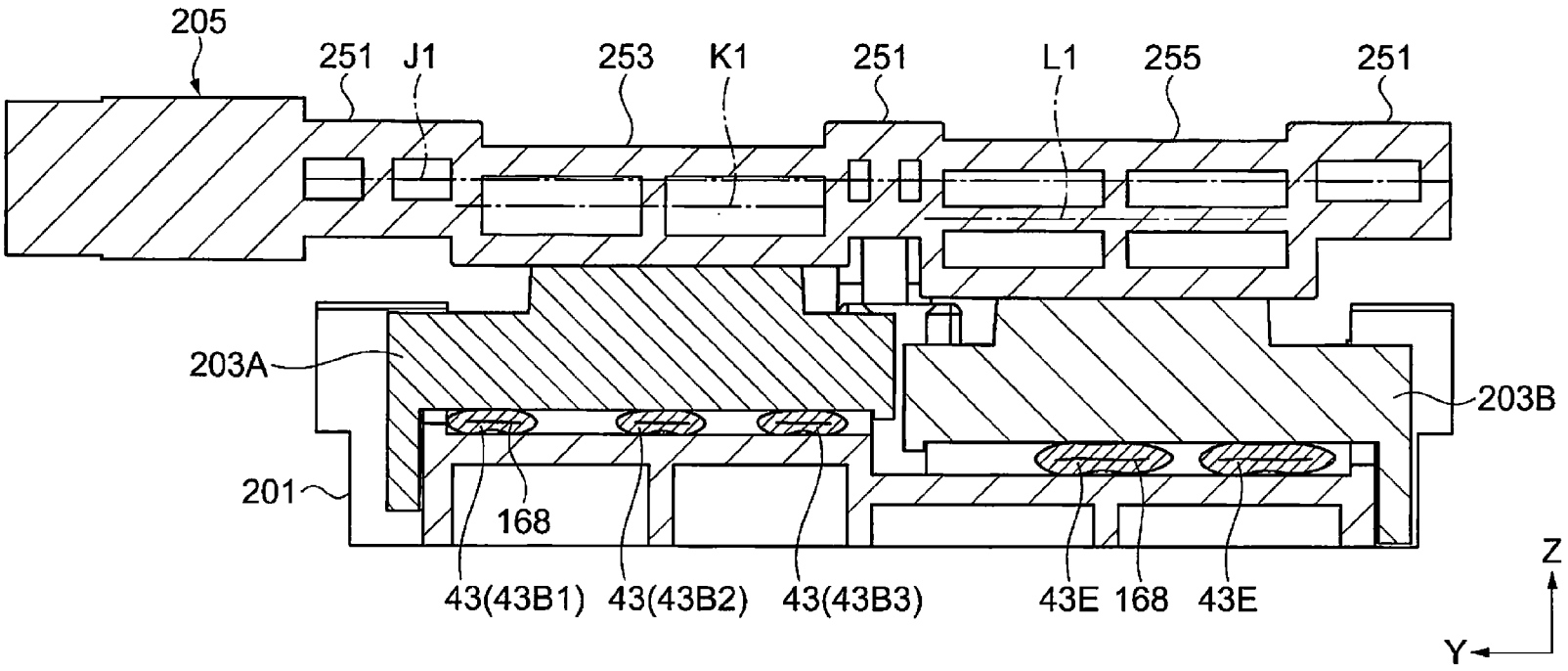
FIG. 46 is a cross-sectional view showing a state in which the first cam and the second cam of Example 2 come down.

The cam member 205 is rotated with the shaft section 251 as the center in conjunction with the rotation of the operation knob 137 (FIG. 43). At this time, because the line J1, the line K1, and the line L1 are misaligned, the outer peripheries of the first cam 253 and the second cam 255 are moved in conjunction with the rotation of the shaft section 251, as shown in FIG. 46. With this, the first cam 253 and the second cam 255 function as a cam by going up and down with the shaft section 251 as the center of rotation. As mentioned above, because the cross-section of the second cam 255 is larger than the cross-section of the first cam 253, and because the line K1 and the line L1 are misaligned, the change amount of the second cam 255 is larger than the change amount of the first cam 253. In other words, the change mount in going up and down of the second cam 255 is larger than the change amount in going up and down of the first cam 253. By the way, FIG. 44 shows a state of the first cam 253 and the second cam 255 in going up and down. On the other hand, FIG. 46 shows a state of the first cam 253 and the second cam 255 are down.

The first pressing member 203A, as shown in FIG. 44, is provided on the outer peripheries of the supply tube 43B1, the supply tube 43B2, and the supply tube 43B3. At this time, the channel 168 of each of the supply tube 43B1, the supply tube 43B2, and the supply tube 43B3 is opened. Also, the second pressing member 203B is provided on the outer peripheries of the two extension tubes 43E. At this time, the channel 168 of each of the two extension tubes 43E is opened.

When the first cam 253 goes down, the first pressing member 203A, as shown in FIG. 46, goes down towards the side of the supply tube 43 in conjunction with the first cam 253 going down. With this, the supply tube 43B 1, the supply tube 43B2, and the supply tube 43B3 are collapsed by the first pressing member 203A. Further, when the second cam 255 goes down, the second pressing member 203B goes down towards the side of the extension tube 43E in conjunction with the second cam 255 going down. With this, the two extension tubes 43E are collapsed by the second pressing member 203B. As a result of this, the channel 168 (FIG. 44) of each of the supply tube 43B1, the supply tube 43B2, the supply tube 43B3, and the two extension tubes 43E is closed. By the way, at this time, the channel 168 does not have to be completely closed.

Then, when the first cam 253 and the second cam 255 go up after the first cam 253 and the second cam 255 go down, each of the first pressing member 203A and the second pressing member 203B goes up, as shown in FIG. 44, by elasticity of the supply tube 43 and the extension tube 43E. With this, the passage of the supply tube 43B1, the supply tube 43B2, the supply tube 43B3, and the two of the extension tubes 43E is opened.

Figure 47:
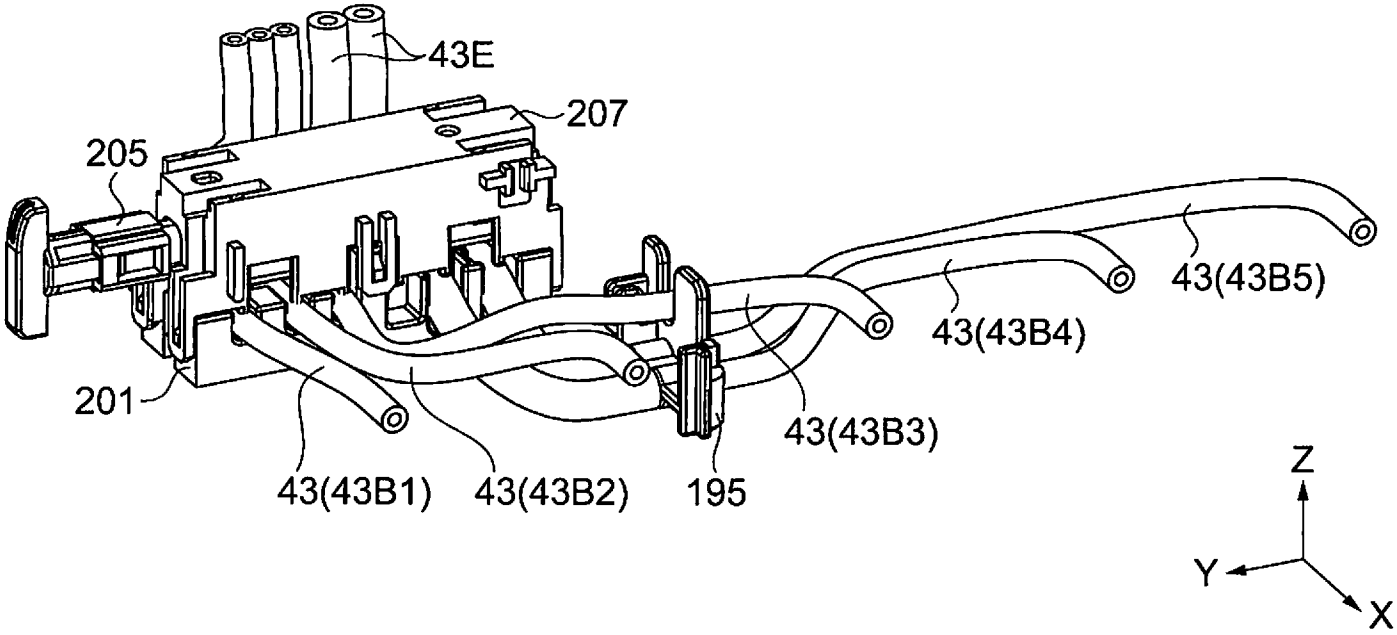
FIG. 47 is a perspective view showing the flow passage opening/closing device of Example 2.

The cover 207, as shown in FIG. 47, is arranged to be engageable with the tube support section 201, and covers the pressing member 203 (FIG. 39), the first cam 253, and the second cam 255 from the side of the Z axis direction. With this, the pressing member 203 (FIG. 39), the first cam 253, and the second cam 255 are protected by the cover 207. Example 2 which is mentioned above attains the same effect as in Example 1. In Example 1, each of the supply tube 43B1, the supply tube 43B2, and the supply tube 43B3 corresponds to a first tube, and the extension tube 43E corresponds to a second tube. Also, the shaft section 251 corresponds to a motion section, the operation knob 137 corresponds to a control section, the guide section 239 corresponds to a guide section, and the cover 207 corresponds to a protection cover. The flow passage opening/closing device 193 in Example 2 can attain the same effect as the flow passage opening/closing device 75 of Example 1.

EXAMPLE 3

For the flow passage opening/closing device 75 of Example 1, an arrangement of driving the passage member 133 by the cam member 135 is employed. Also, for the flow passage opening/closing device 193 of Example 2, an arrangement of driving the pressing member 203 by the cam member 205 is employed. However, the arrangements of the flow passage opening/closing device 75 and the flow passage opening/closing device 193 are not limited to these. For the arrangements of the flow passage opening/closing device 75 and the flow passage opening/closing device 193, an arrangement in which the cam member 135 and the cam member 205 are omitted can be employed. For the arrangement in which the cam member 135 and the cam member 205 are omitted from the flow passage opening/closing device 75 and the flow passage opening/closing device 193, the flow passage opening/closing device 75 as an example in Example 3 will be described. In Example 3, detailed description of the same arrangements which are described in Example 1 and Example 2 will be omitted by using the same symbols as in Example 1 and Example 2.

Figure 48:
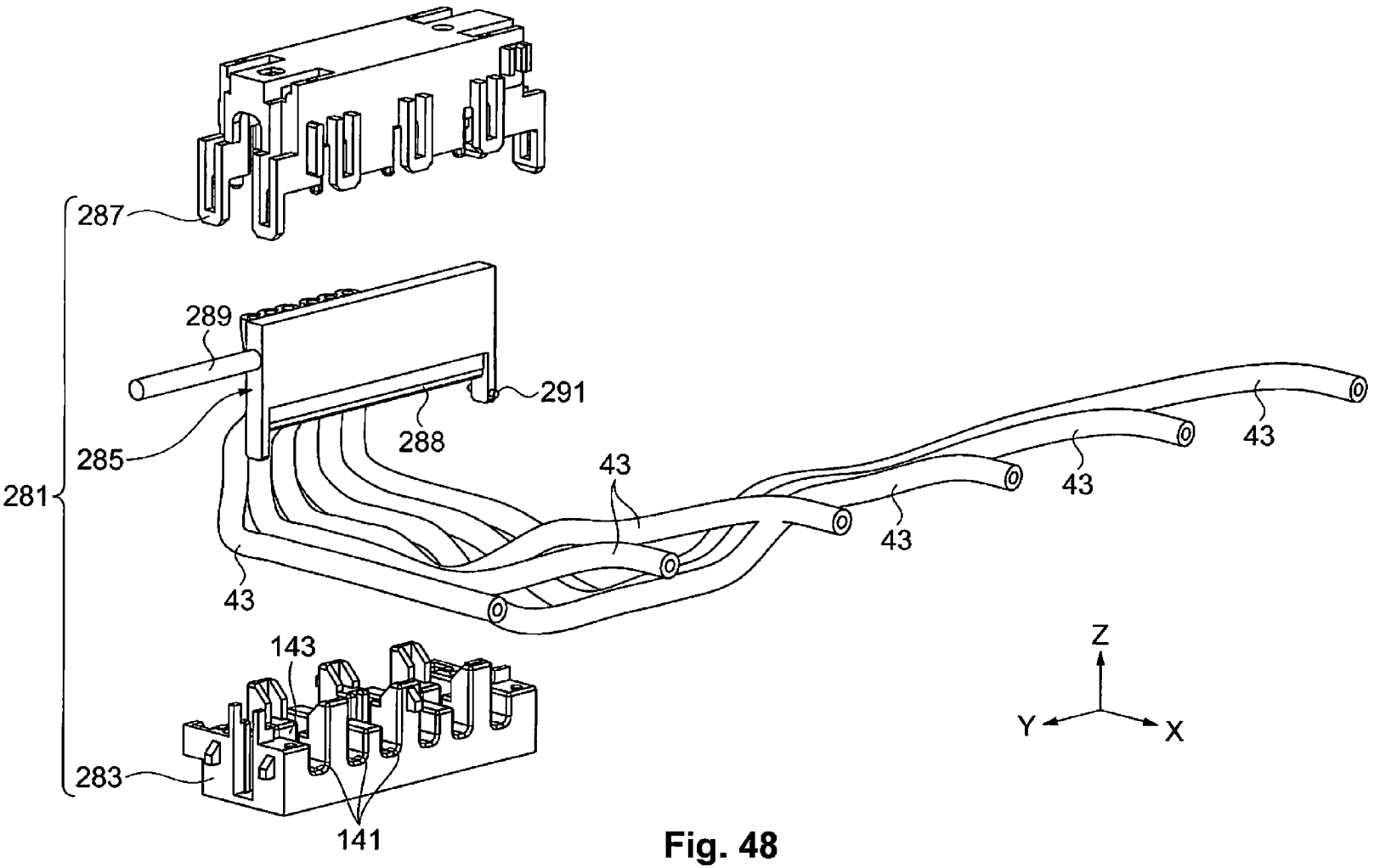
FIG. 48 is an exploded perspective view showing a flow passage opening/closing device of Example 3.

The flow passage opening/closing device 281 of Example 3, as shown in FIG. 48, includes a tube support section 283, a pressing member 285, and a cover 287. For the flow passage opening/closing device 281, the cam member 135 of the flow passage opening/closing device 75, and the cam member 205 of the flow passage opening/closing device 193 are omitted. In the tube support section 283, the plurality of grooves 141 are provided, like in Example 1. The plurality of grooves 141 can be grooves 221 or the grooves 223 of Example 2. The pressing member 285 is provided on the opposite side of the tube support section 283 of the six of the supply tubes 43, namely provided closer to the side of the Z axis direction than the supply tube 43. The cover 287 is provided on the opposite side of the tube support section 283 of the pressing member 285, namely provided closer to the side of the Z axis direction than the pressing member 285. The cover 287 is same as the cover 139 of Example 1 and the cover 207 of Example 2, and therefore the detailed description is omitted.

The pressing member 285 includes a pressing section 288, a control section 289, and a locking pin 291. At the tube support section 283, the recessed section 143 to which the pressing member 285 can be inserted is provided, like in Example 1. The pressing section 288 of the pressing member 285 is inserted in the recessed section 143. The control section 289 of the pressing member 285 protrudes from the pressing section 288 in the Y axis direction. The locking pin 291 is provided at an end of the pressing member 285 and protrudes along the X axis. At the tube support section 283, a bearing (now shown in figures) in which the locking pin 291 of the pressing member 285 is inserted is provided. The pressing member 285 is arranged to be rotatable with respect to the tube support section 283 with the locking pin 291 as the center which is inserted in the bearing of the tube support section 283.

Figure 49:
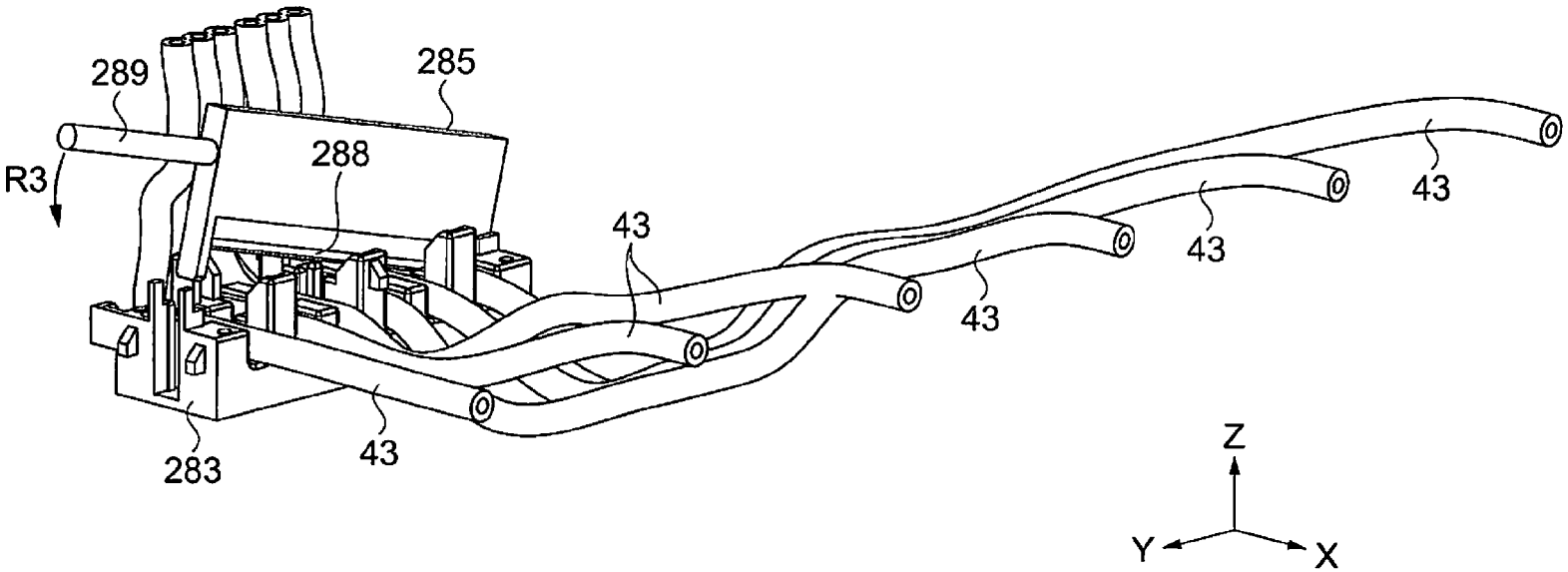
FIG. 49 is a perspective view showing a tube support section and a pressing member of Example 3.
Figure 50:
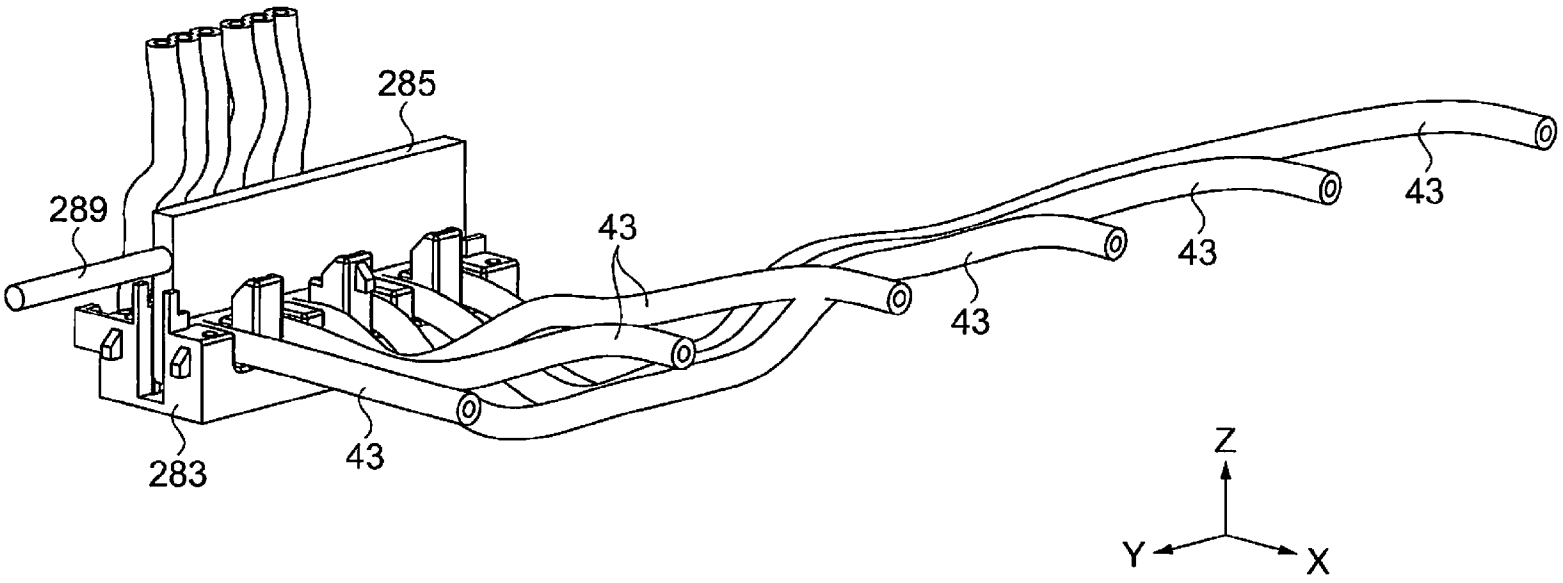
FIG. 50 is a perspective view showing the tube support section and the pressing member of Example 3.

When the supply tube 43 is deployed in the groove 141 and the locking pin 291 of the pressing member 285 is inserted in the bearing of the tube support section 283, as shown in FIG. 49, of the pressing member 285, the pressing section is provided on the supply tube 43 and stands still in a state of inclining with respect to the tube support section 283. Then, when rotating the pressing member 285 in R3 direction in the figure by operating a force of the control section 289, as shown in FIG. 50, the supply tube 43 is collapsed by the pressing member 285. With this, the channel 168 (FIG. 26, FIG. 44) of the supply tube 43 is closed. Like this, for the flow passage opening/closing device 281 of Example 3, the channel 168 can be opened and closed, like Example 1 or Example 2.

Figure 51:
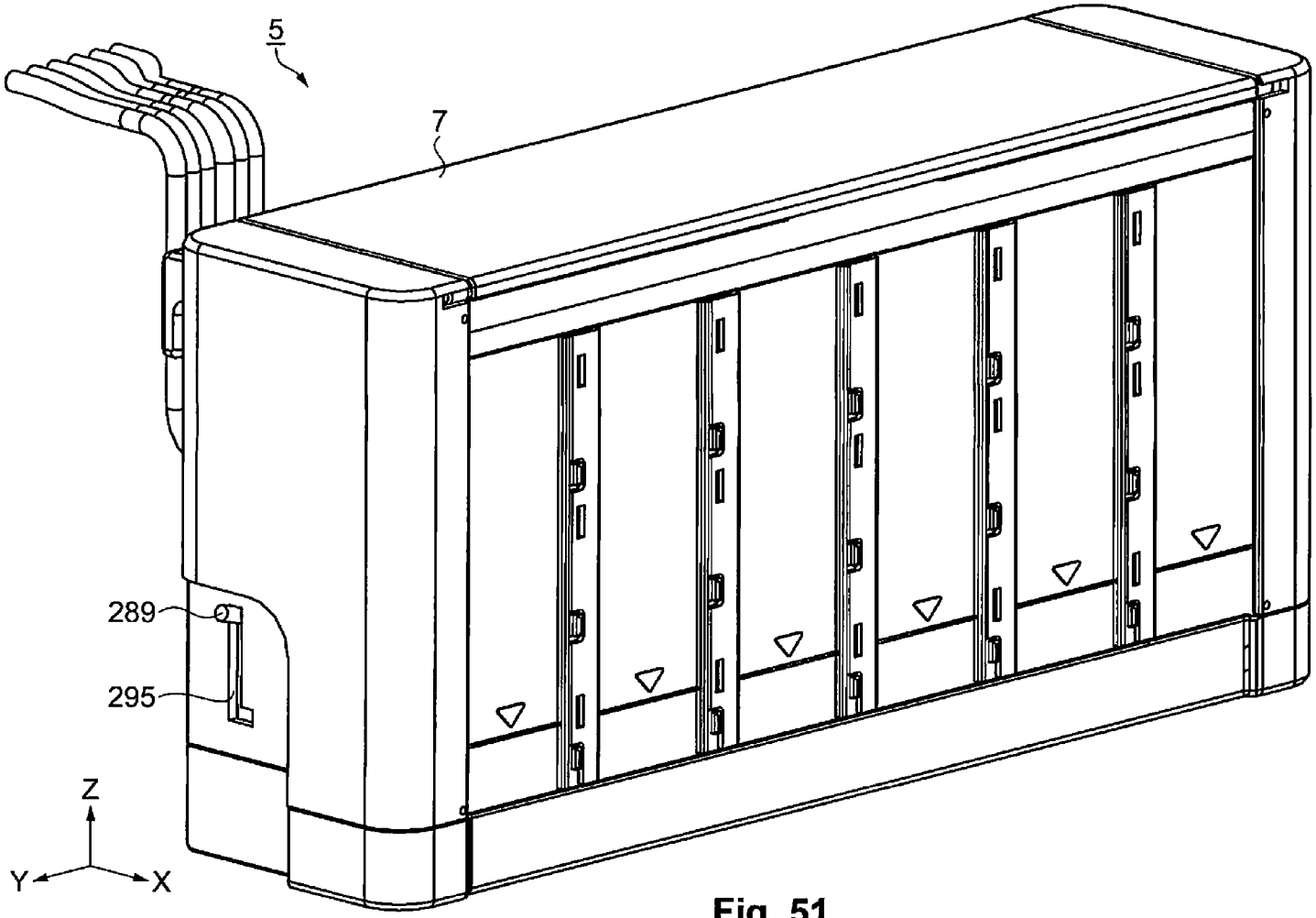
FIG. 51 is a perspective view showing an ink supply device to which the flow passage opening/closing device of Example 3 can be applied.
Figure 52:
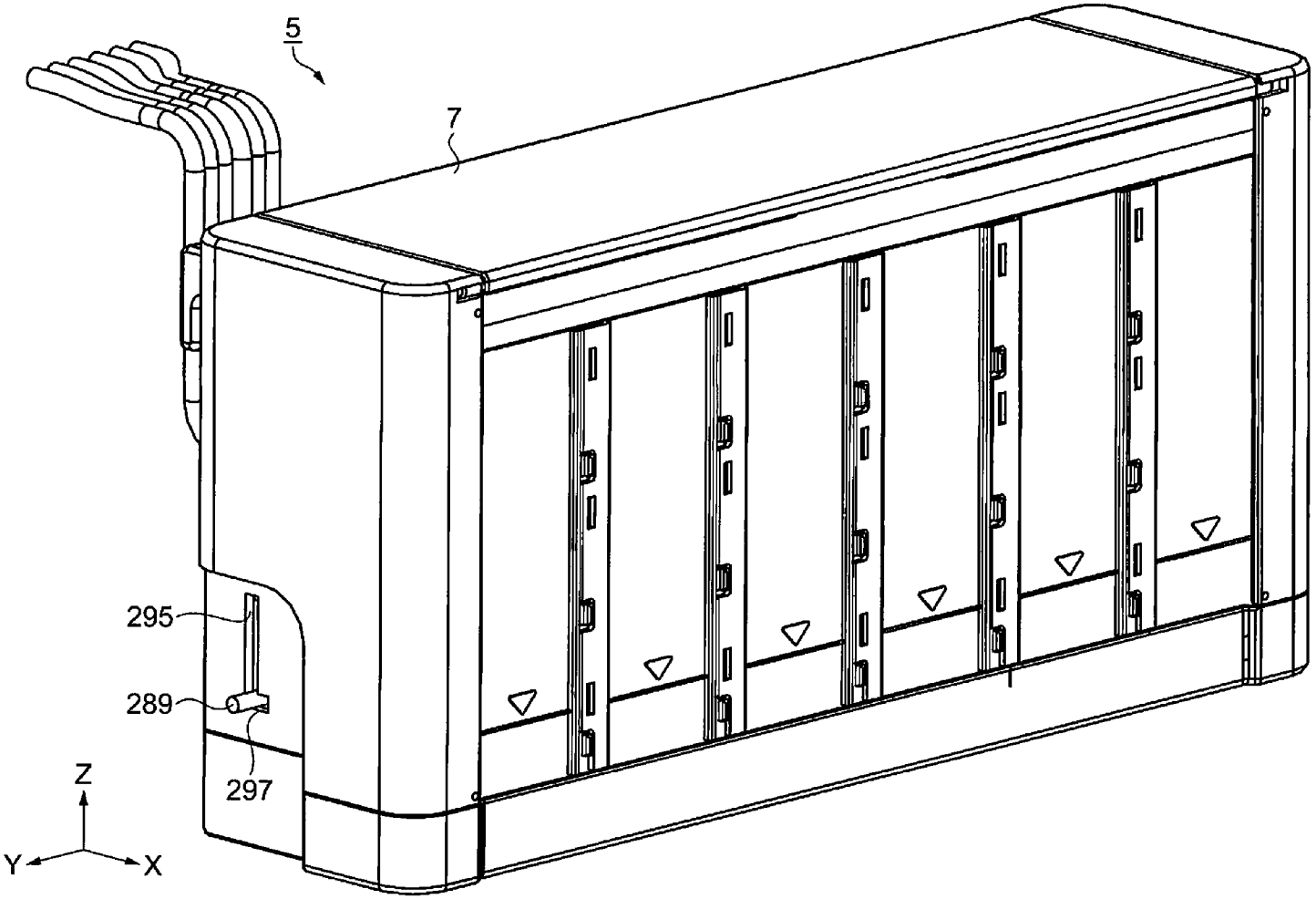
FIG. 52 is a perspective view showing the ink supply device to which the flow passage opening/closing device of Example 3 can be applied.
Figure 53:
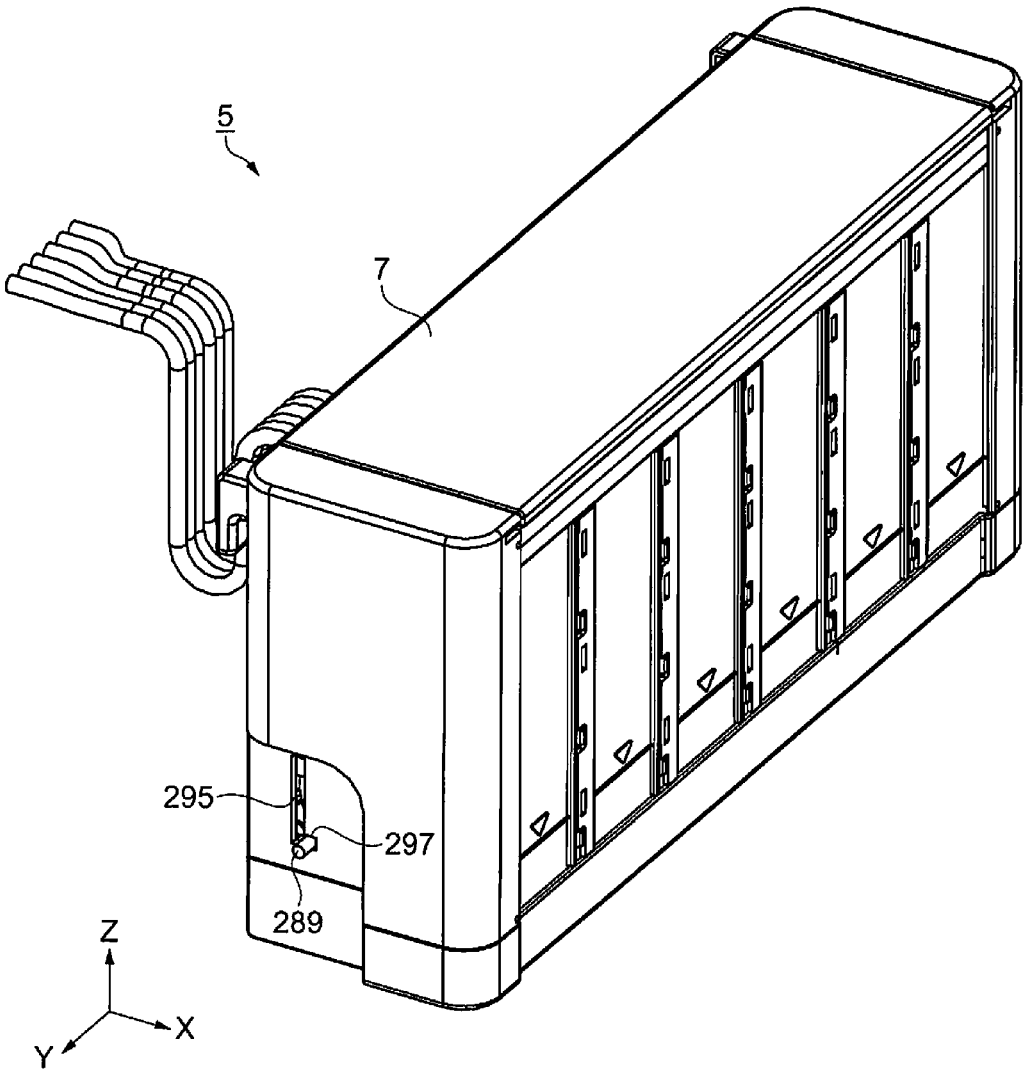
FIG. 53 is a perspective view showing the ink supply device to which the flow passage opening/closing device of Example 3 can be applied.
Figure 54:
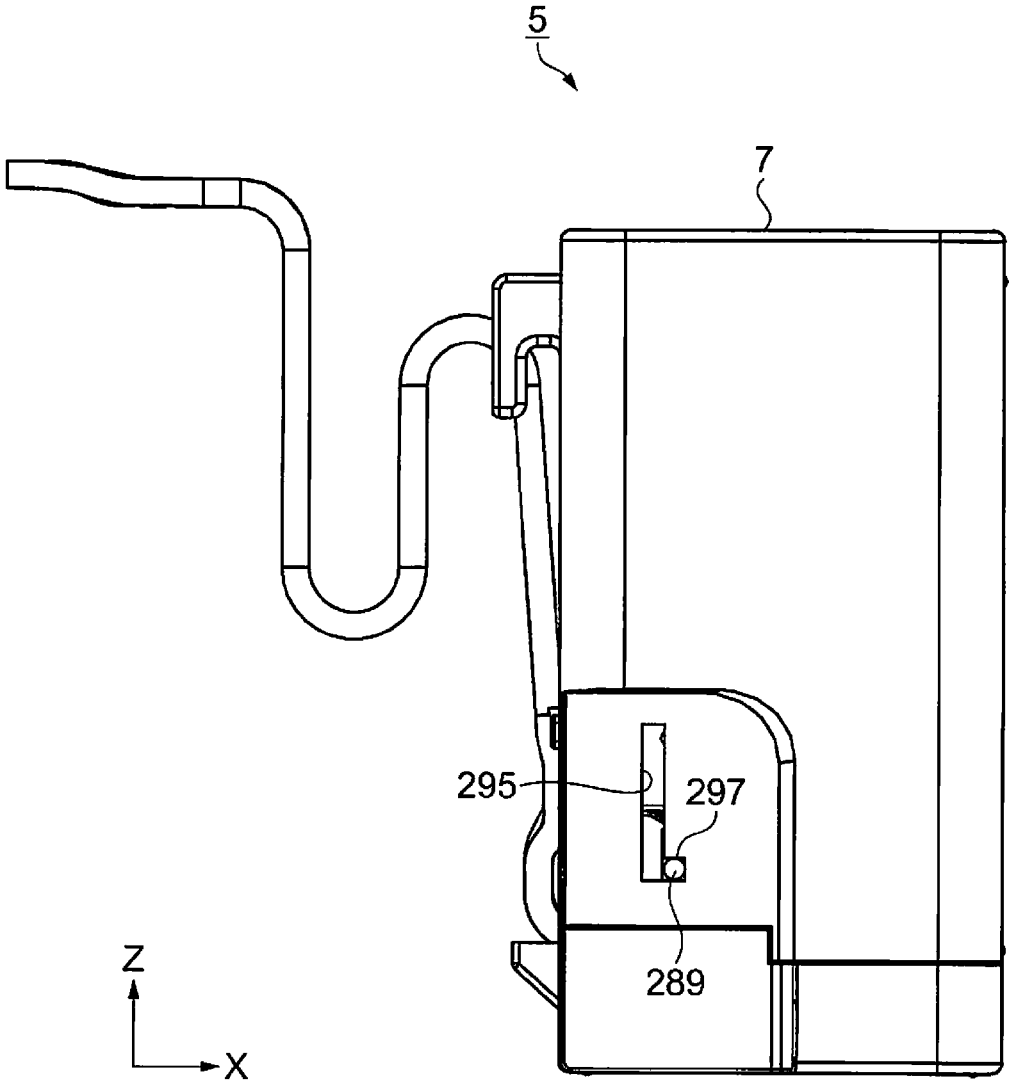
FIG. 54 is a front surface view showing the ink supply device to which the flow passage opening/closing device of Example 3 can be applied.

For the ink supply device 5 which is applicable to the flow passage opening/closing device 281 of Example 3, as shown in FIG. 51, the control section 289 is exposed from the tank case 7. At the tank case 7, the opening section 295 which extends along the Z axis is provided. The control section 289 is exposed from the tank case 7 via the opening section 295. The operator or the user, as shown in FIG. 52, urges the control section 289 downwardly in the −Z axis direction along the opening section 295. At the opening section 295, a bending section 297 is provided. At the bending section 297, the opening section 295 is bent in the X axis direction. Then, as shown in FIG. 53, the control section 289 can be inserted in the bending section 297. With this, as shown in FIG. 54, the control section 289 can be secured (locked) to the bending section 297.

In each of Example 1-Example 3, the tank unit 71 or the tank unit 191 has arrangements in which the plurality of tanks 9 are connected. However, the arrangements of the tank unit 71 or the tank unit 191 are not limited to this. For the arrangements of the tank unit 71 or the tank unit 191, for example, an arrangement in which a liquid storing container is sectionalized into a plurality of ink storage sections (liquid storage sections) can be employed.

EXAMPLE 4

The tank 9D of Example 4 will be described. The tank 9D of Example 4 has an arrangement same as the ones of the tank 9 in each of Example 1-Example 3, except the arrangement of the vent portion 85 (FIG. 9) of the tank 9 being different. For this reason, hereinafter, for the same arrangement of the tank 9, description will be omitted by using the same symbols of each of Example 1-Example 3. The vent portion 85 of the tank 9D of Example 4 is noted as the vent portion 85D for differentiating from the vent portion 85 of the tank 9 for each Example 1-Example 3.

Figure 55:
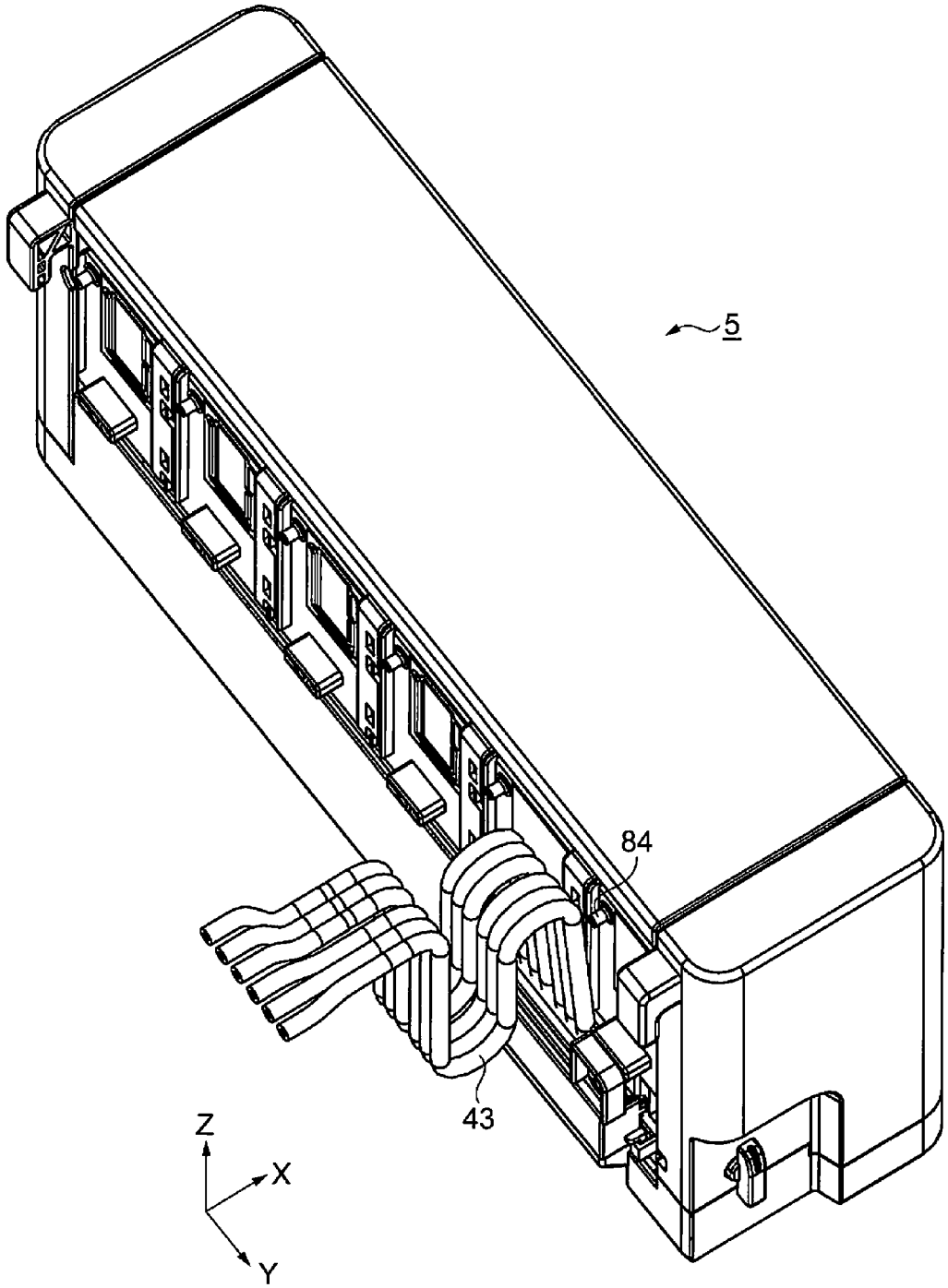
FIG. 55 is a perspective view showing the ink supply device of the present embodiment.

At the liquid ejection system 1, as shown in FIG. 3, a slack is formed at the supply tube 43 between the ink supply device 5 and the printer 3. Because the slack is formed at the supply tube 43, as shown in FIG. 6, it is possible to overturn to the side with respect to the printer 3 of the ink supply device 5. By the way, when the ink supply device 5 is equipped on the printer 3 (a state shown in FIG. 1), the supply tube 43 which extends towards the print head 47 from the ink supply device 5, as shown in FIG. 55, is stored between the ink supply device 5 and the printer 3 in a state of being bent.

At this time, the supply tube 43 and the vent 84 may be overlapped. When the supply tube 43 and the vent 84 are overlapped, the vent 84 may be closed by the supply tube 43. When things like this happen, because it is difficult for the air to come in the tank 9, and because the pressure in the tank 9 is decreased, it is difficult for the ink in the tank 9 to be supplied to the print head 47. As a result, because printing is impeded, the liquid ejection system 1 does not perform the functions, and the reliability of the liquid ejection system 1 is possibly deteriorated.

Figure 56:
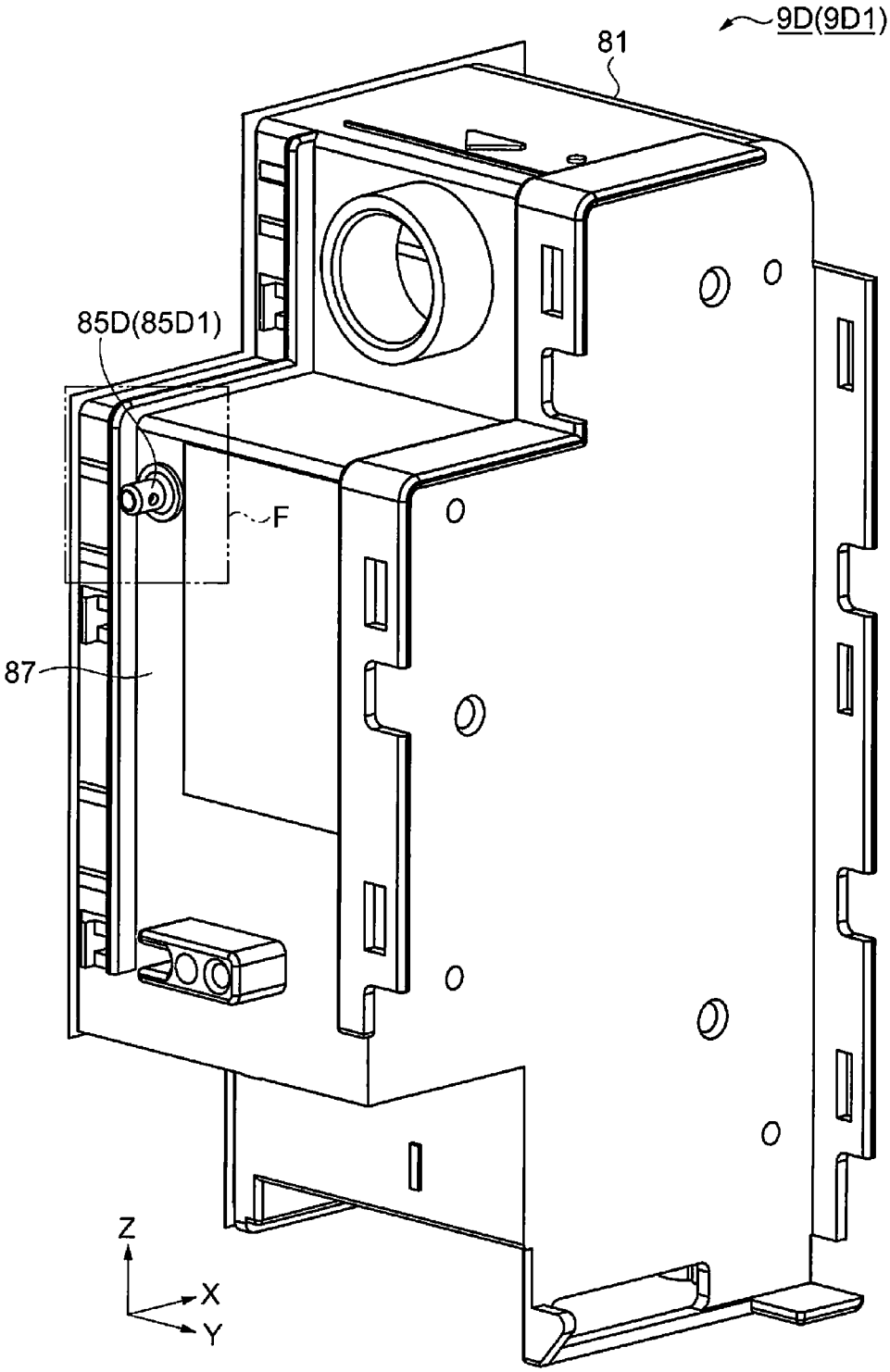
FIG. 56 is a perspective view showing a tank of Example 4-1.

The tank 9D of Example 4, as shown in FIG. 56, includes a vent portion 85D. The vent portion 85D protrudes in the −X axis direction from the side wall 87 of the storage 81. The vent portion 85D is cylindrically formed. Hereinafter, the tank 9D of Example 4 is described by showing some examples. Hereinafter, in order to identify some examples of the tank 9D, different numbers are used for each example.

Example 4-1

Figure 57:
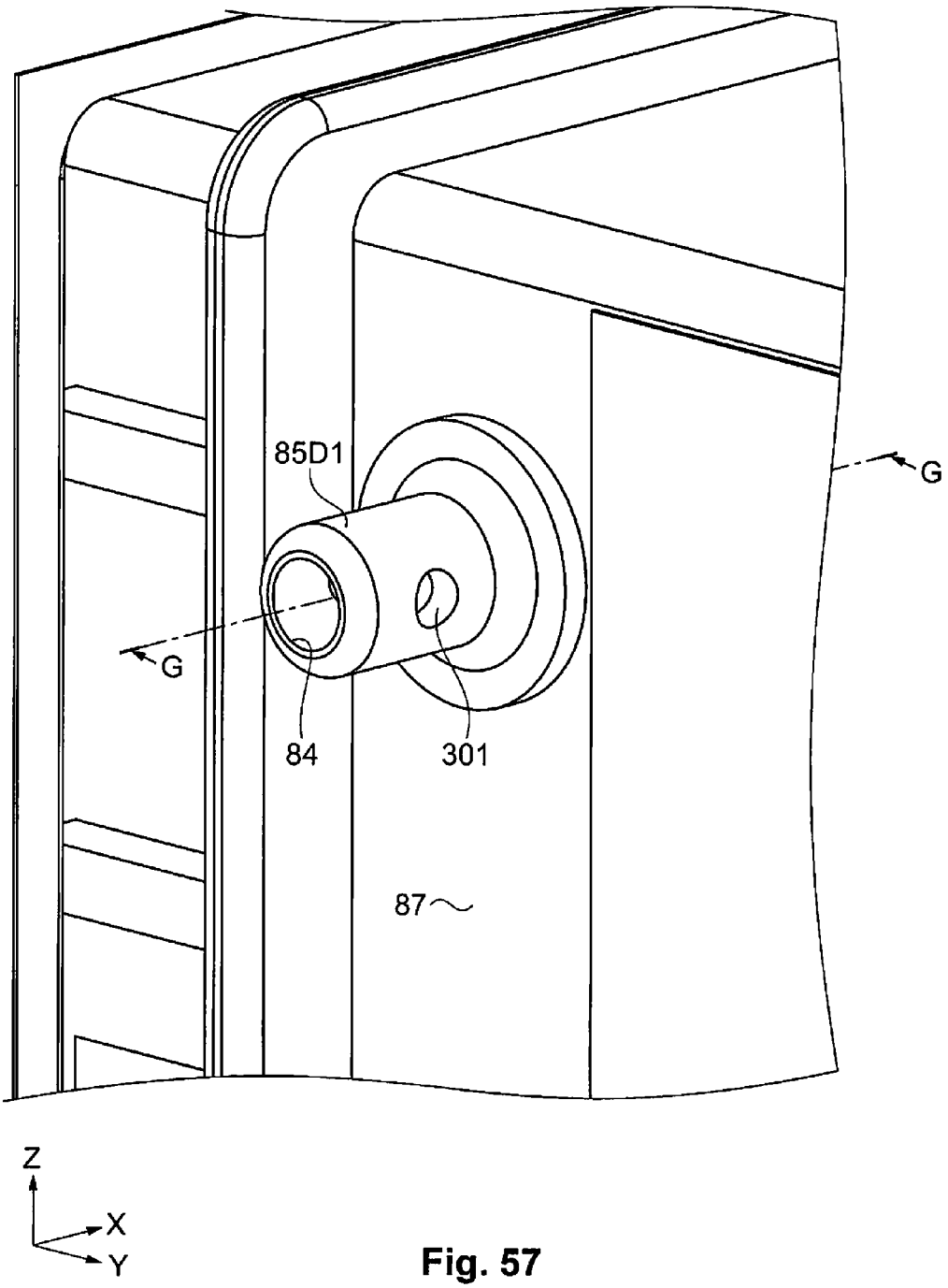
FIG. 57 is an enlarged view of a part F in FIG. 56.
Figure 58:
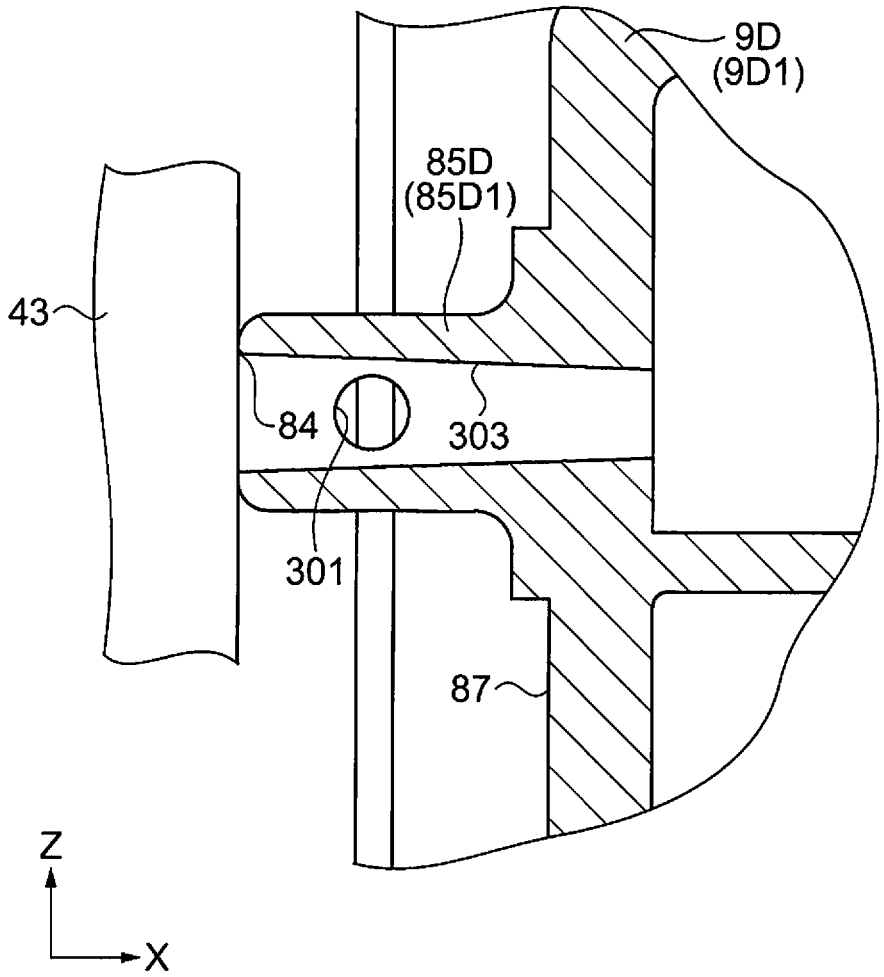
FIG. 58 is a cross-sectional view on G-G line in FIG. 57.

The tank 9D1 of Example 4-1, as shown in FIG. 56, includes a vent portion 85D1. At the vent portion 85D1, as shown in FIG. 57 which is an enlarged view of a part F in FIG. 56, an opening 301 which opens in a direction different from a protruding direction (in the present example, −X axis direction) in which the vent portion 85D1 protrudes. As shown in FIG. 58 which is a cross-sectional view of G-G line in FIG. 57, even if the vent 84 is closed by the supply tube 43, the vent channel 303 of the vent portion 85D1 communicates with the outside air via the opening 301 provided on the vent portion 85D1. The vent channel 303 is a passage communicating from the vent 84 to the inside of the tank 9D. With this, the inside of the tank 9D 1 communicates the outside air. For this reason, because it is easier to maintain the pressure inside the tank 9D1 at the air pressure outside, it is easier to prevent lowering of the printing function. Therefore, it is easier to maintain the reliability of the liquid ejection system 1. The number of openings 301 can be one, or more than one.

Example 4-2

Figure 59:
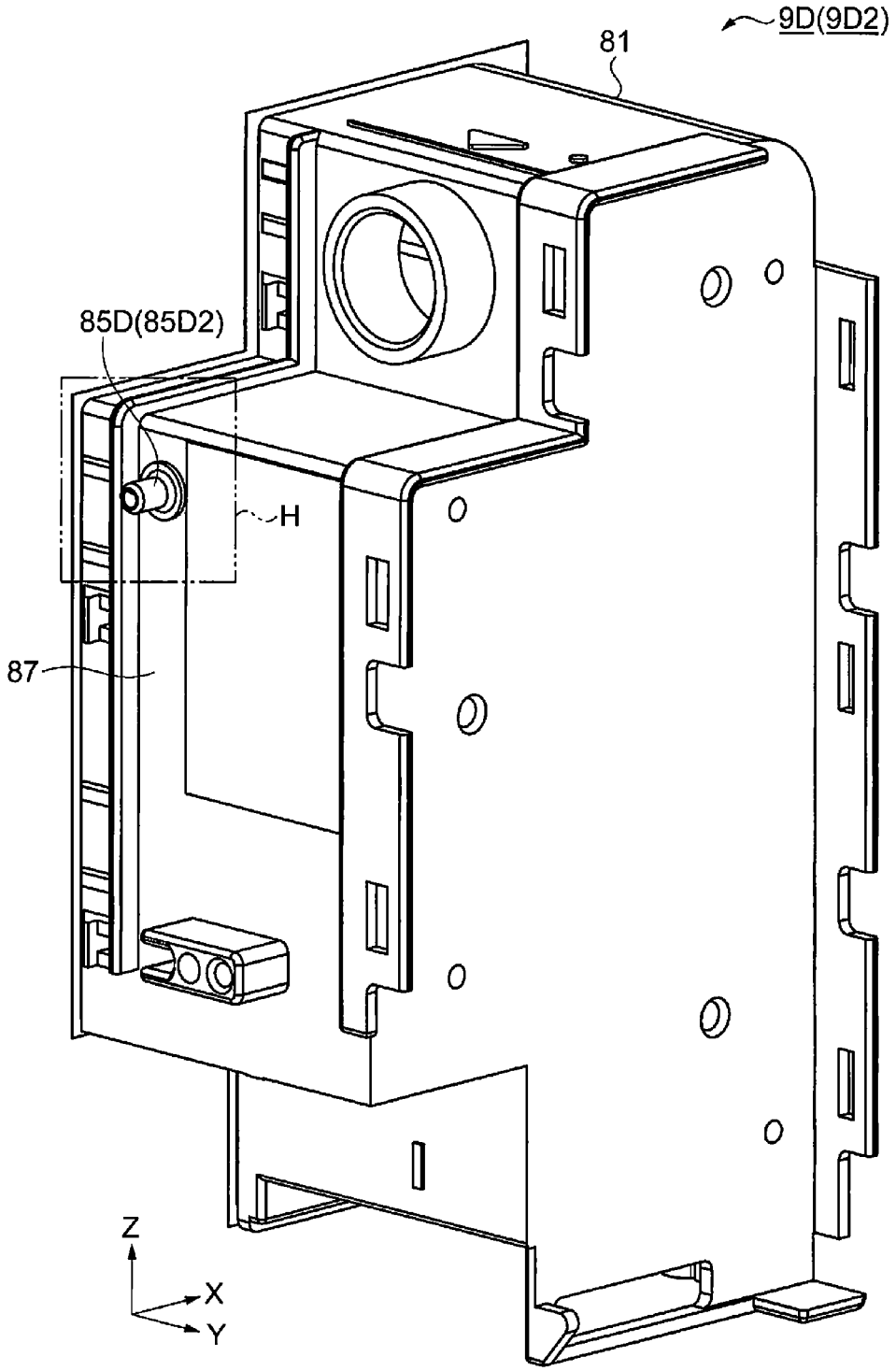
FIG. 59 is a perspective view showing a tank of Example 4-2.
Figure 60:
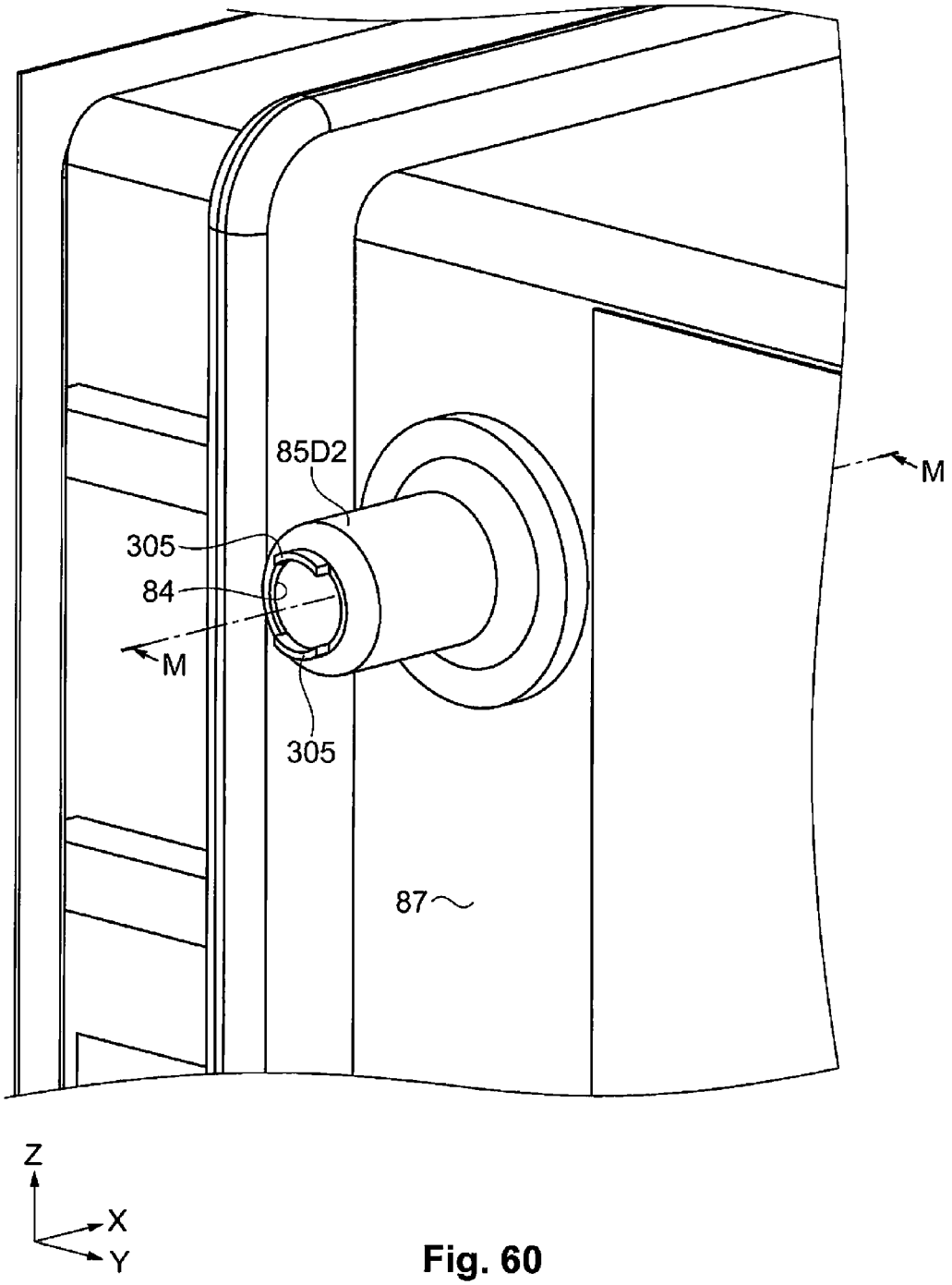
FIG. 60 is an enlarged view of a part H in FIG. 59.
Figure 61:
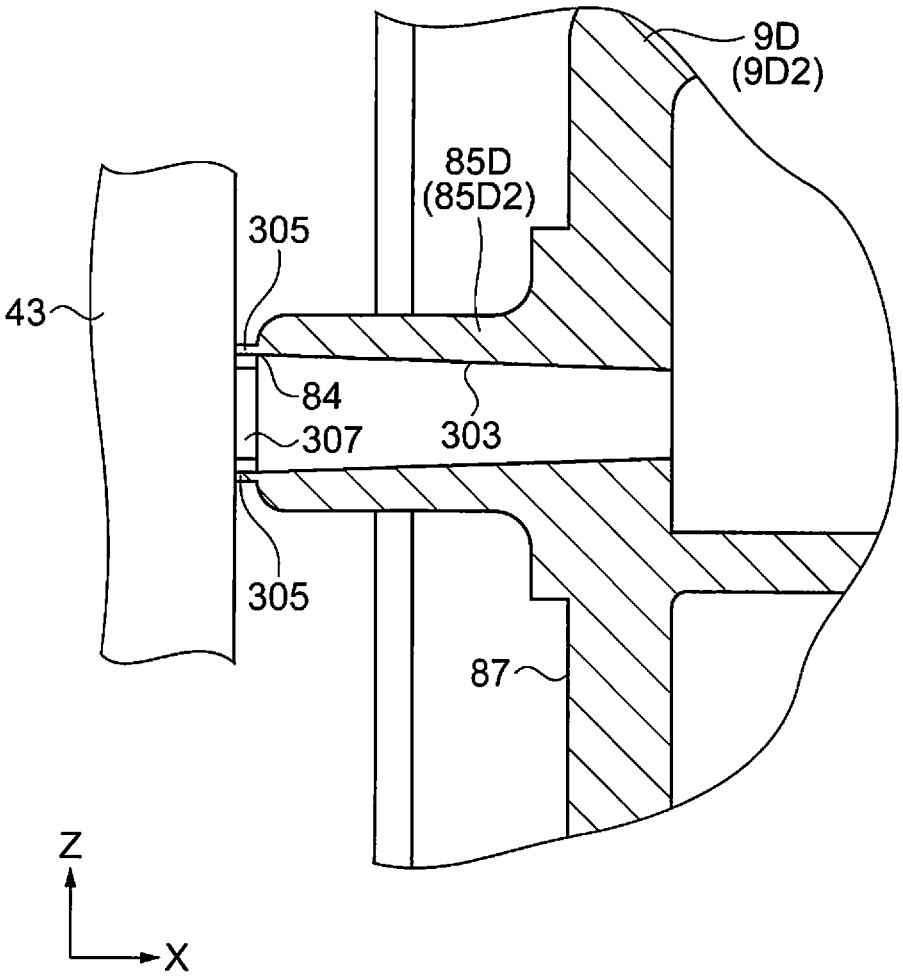
FIG. 61 is a cross-sectional view of M-M line in FIG. 59.

The tank 9D2 of Example 4-2, as shown in FIG. 59, includes a vent portion 85D2. At the vent portion 85D2, as shown in FIG. 60 which is an enlarged view of a part H in FIG. 59, a plurality of projection section 305 protruding towards the opposite side of the side wall 87 from an end of the vent portion 85D2. As shown in FIG. 61 which is a cross-sectional view of M-M line in FIG. 60, even if the supply tube 43 overlaps the vent 84, the opening 307 is kept between the plurality of projections 305. Via the opening 307, the vent channel 303 of the vent portion 85D2 communicates with the outside air. With this, the inside of the tank 9D2 communicates with the outside air. For this reason, because it is easier to maintain the pressure inside the tank 9D2 at the outside air pressure, it is easier to prevent lowering the printing function. Therefore, it is easier to maintain the reliability of the liquid ejection system 1. The number of the projections 305 can be one, as long as a space is ensured when the supply tube 43 overlaps the vent 84.

Example 4-3

Figure 62:
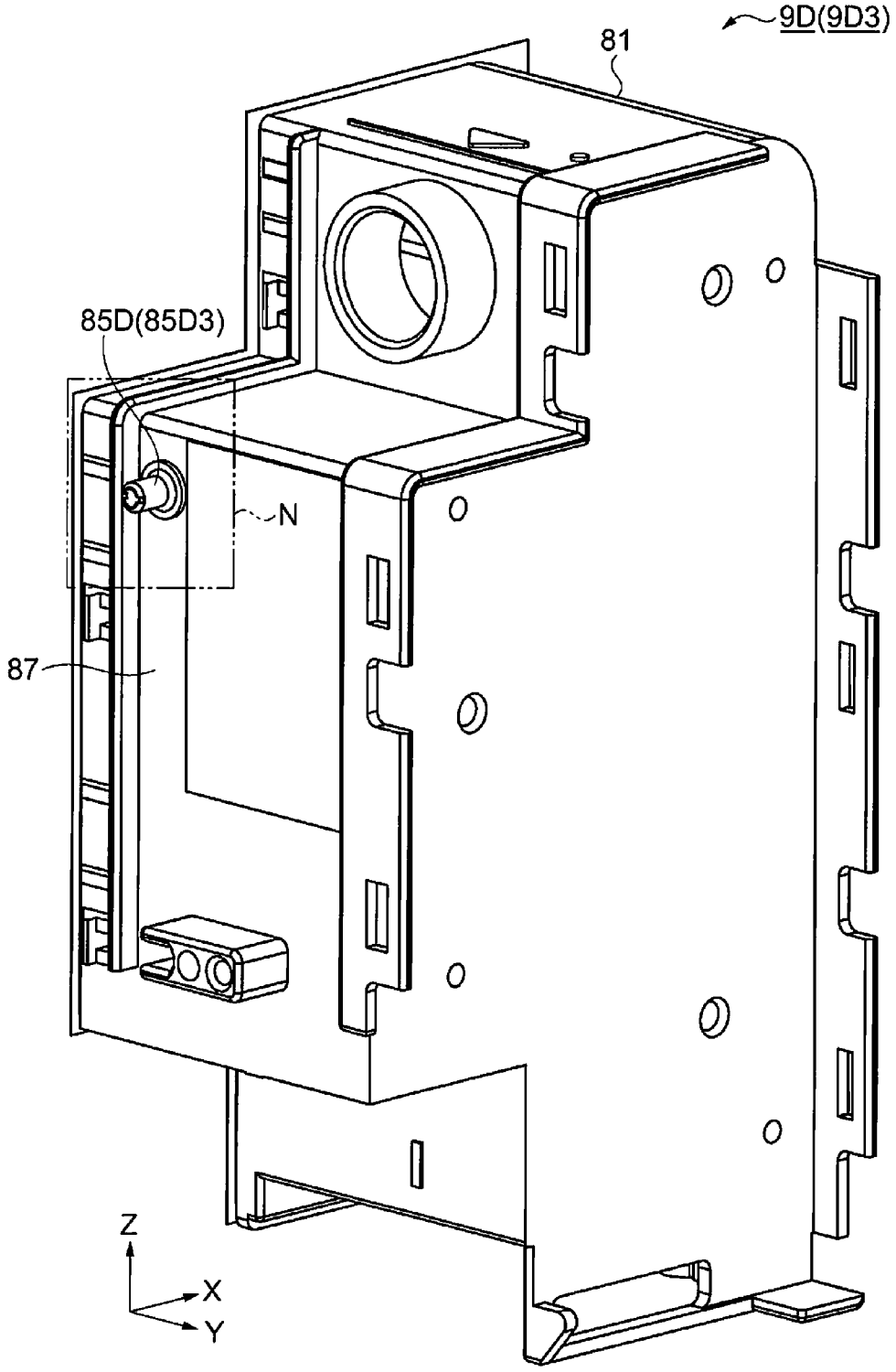
FIG. 62 is a perspective view showing a tank of Example 4-3.
Figure 63:
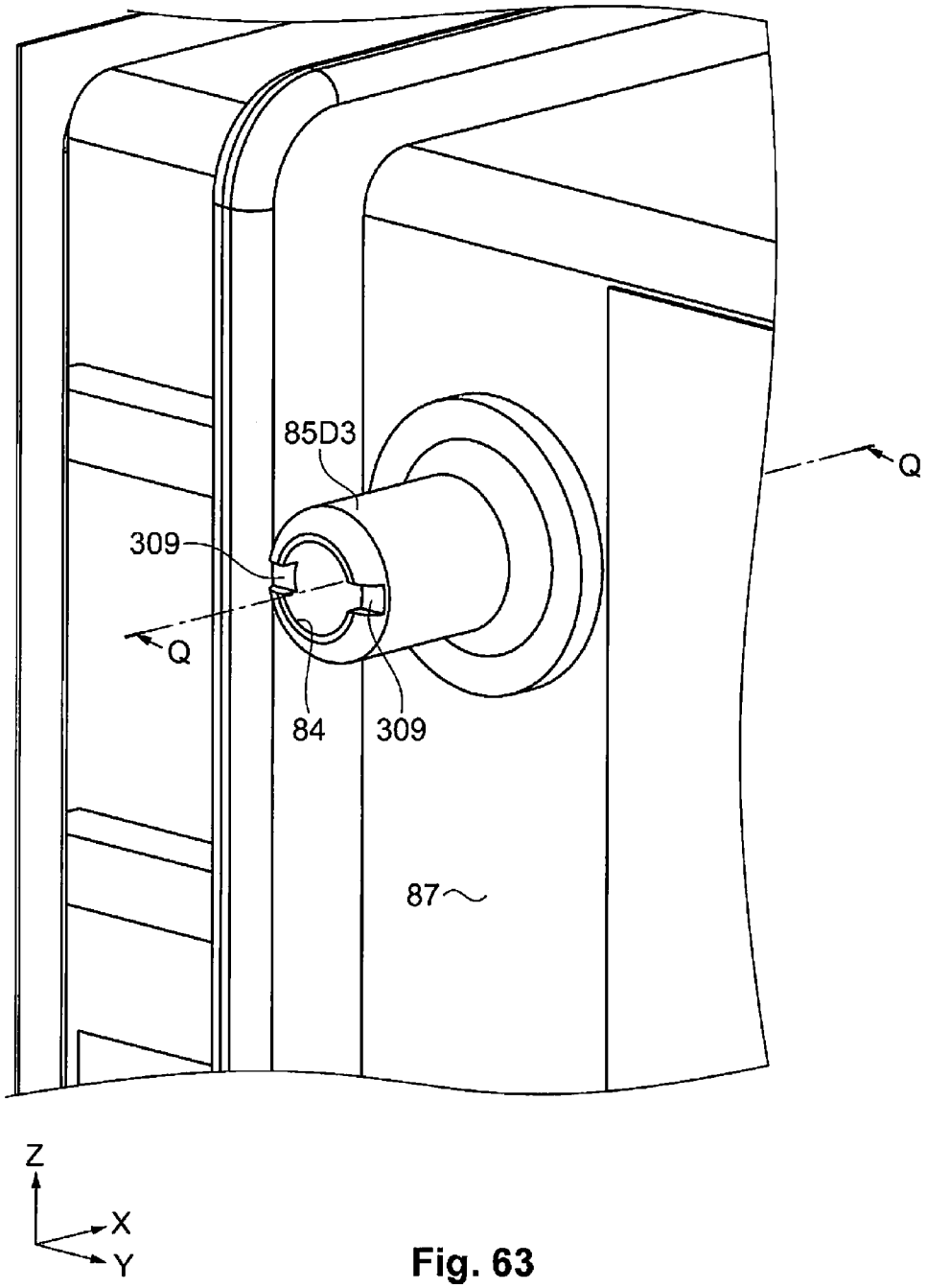
FIG. 63 is an enlarged view of a part N in FIG. 62.
Figure 64:
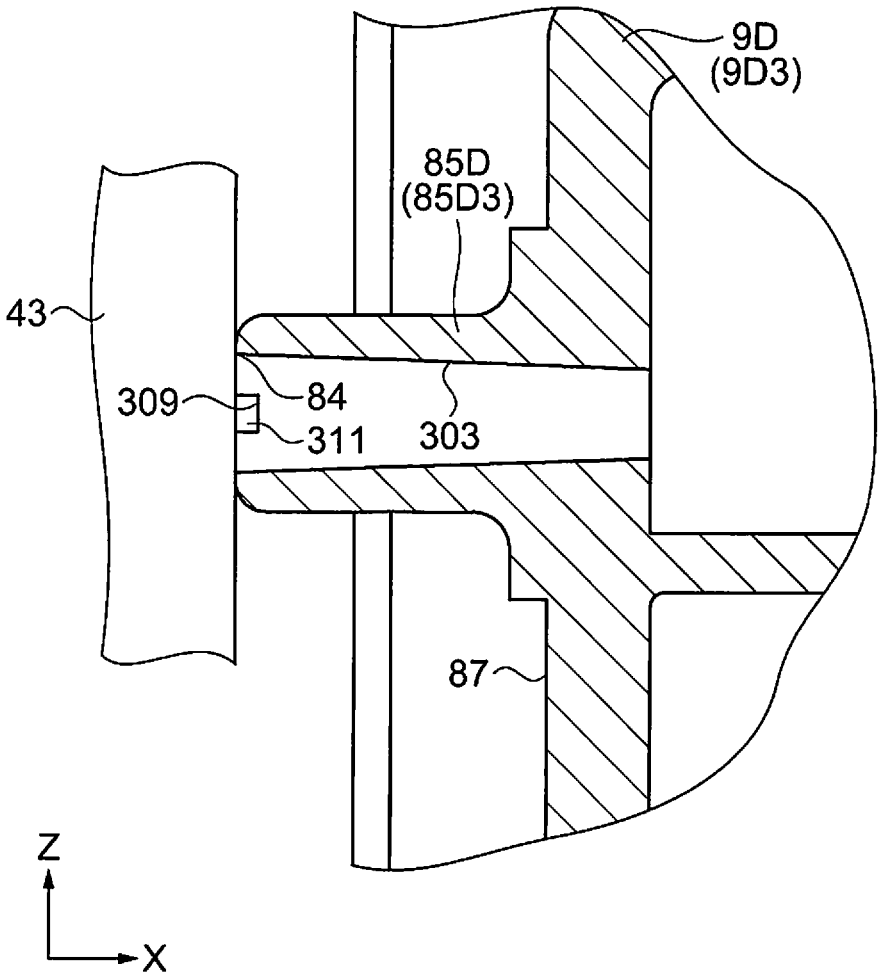
FIG. 64 is a cross-sectional view of Q-Q line in FIG. 63.

The tank 9D3 of Example 4-3, as shown in FIG. 62, includes a vent portion 85D3. At the vent portion 85D3, as shown in FIG. 63 which is an enlarged view of a part N in FIG. 62, a plurality of notches 309 which is cut in towards the side of the side wall 87 from an end of the vent portion 85D3. As shown in FIG. 64 which is a cross-sectional view of Q-Q line in FIG. 63, even if the supply tube 43 overlaps the vent 84, the opening 311 is maintained by the plurality of notches 309. The vent channel 303 of the vent portion 85D3 communicates with the outside air via the opening 311. With this, the inside of the tank 9D3 communicates with the outside air. For this reason, because it is easier to maintain the pressure inside the tank 9D3 at the outside air pressure, it is easier to prevent lowering the printing function. Thus, it is easier to maintain the reliability of the liquid ejection system 1.

Example 4-4

Figure 65:
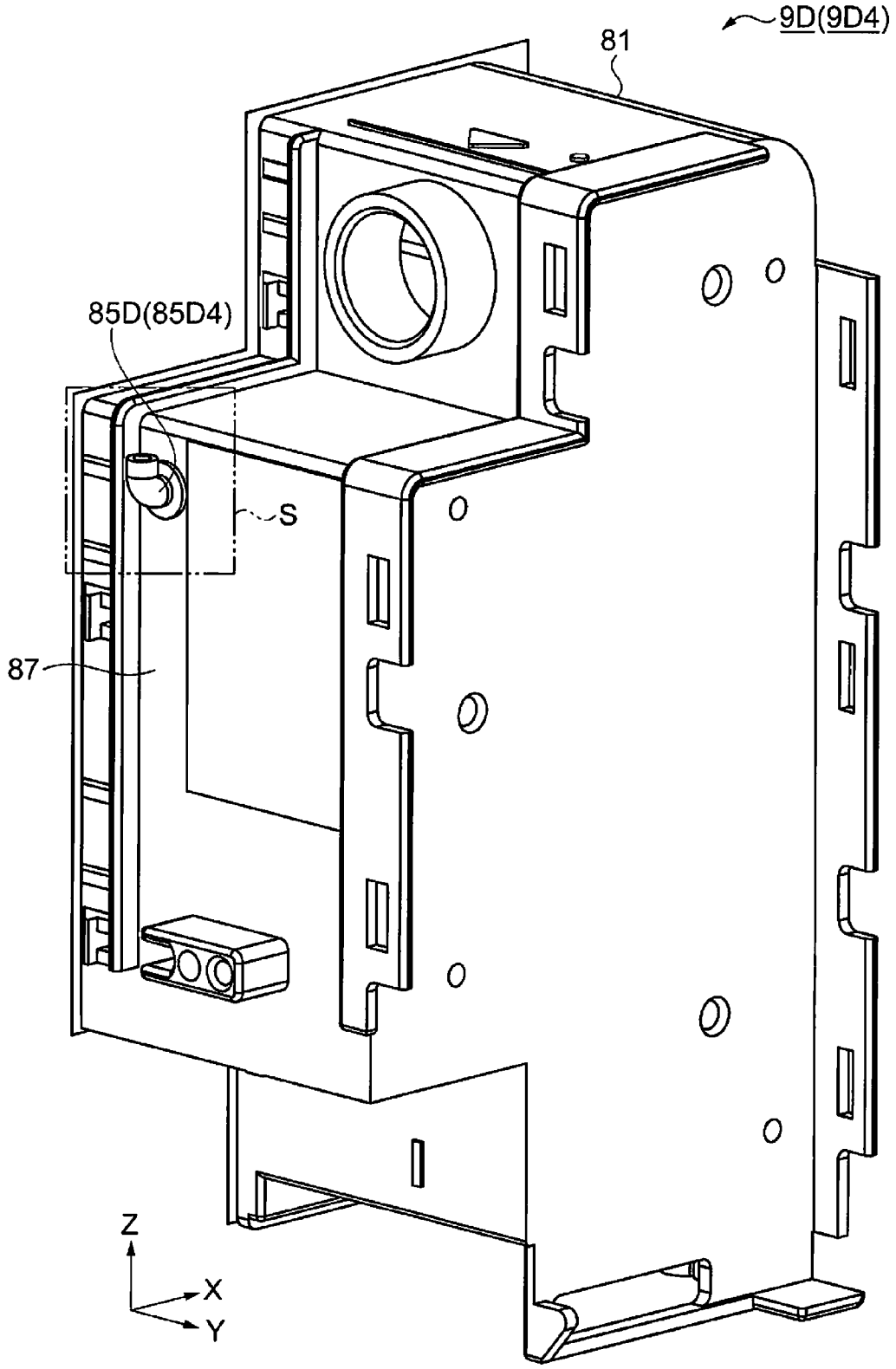
FIG. 65 is a perspective view showing a tank of Example 4-4.
Figure 66:
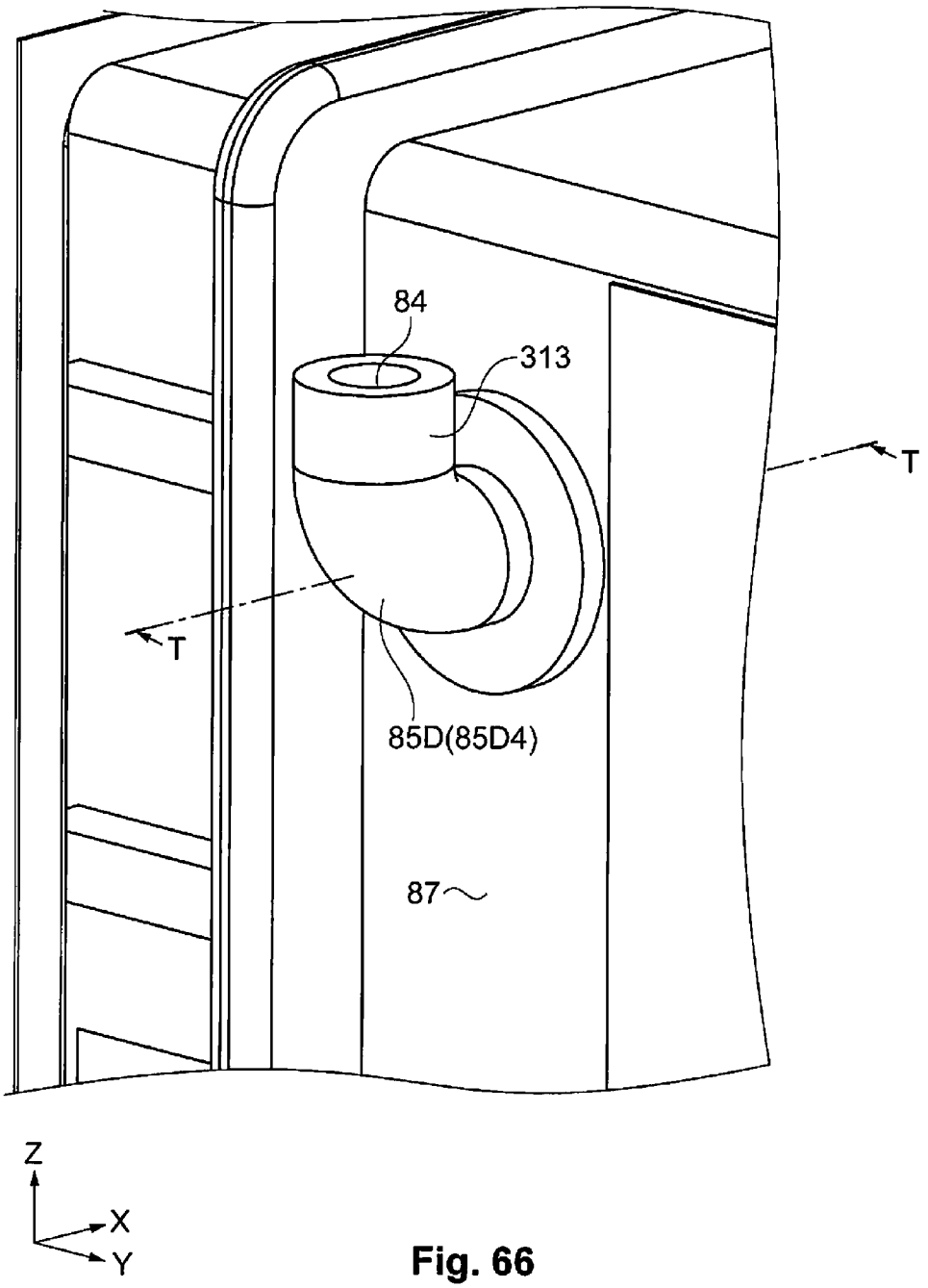
FIG. 66 is an enlarged view of a part S in FIG. 65.
Figure 67:
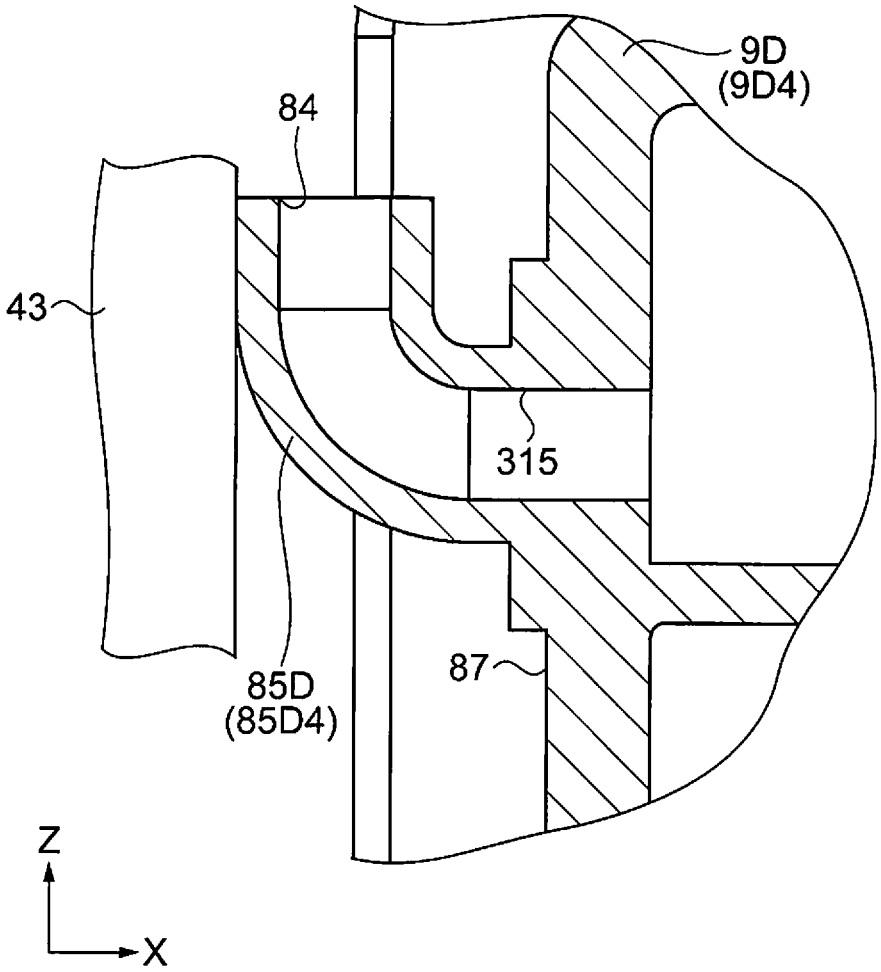
FIG. 67 is a cross-sectional view of T-T line in FIG. 66.

The tank 9D4 of Example 4-4, as shown in FIG. 65, includes a vent portion 85D4. At the vent portion 85D4, as shown in FIG. 66 which is an enlarged view of a part S in FIG. 65, a vent portion 85D4 includes an extension portion 313. The extension portion 313 extends in a direction different (in the present example, the Z axis direction) from the −X axis direction being a protruding direction. Namely, in the present example, the vent portion 85D4 protrudes in the −X axis direction from the side wall 87, and is bent towards the Z axis direction at the extension portion 313. Then, the vent 84 is provided at an end of the extension portion 313. With this, the vent 84 is open in a direction different (in the present example, the Z axis direction) from the −X axis direction being a protruding direction. For this reason, as shown in FIG. 67 which is a cross-sectional view of T-T line in FIG. 66, even if the supply tube 43 overlaps the vent portion 85D4, the vent channel 315 communicates with the outside air by the vent 84. The vent channel 315 is a passage communicating from the vent 84 to the inside of the tank 9D4. With this, the inside of the tank 9D4 communicates with the outside air. For this reason, because it is easier to maintain the pressure in the tank 9D4 at the outside air pressure, it is easier to prevent lowering the printing function. Thus, it is easier to maintain the reliability of the liquid ejection system 1. The direction in which the extension portion 313 extends is not limited to the Z axis direction, but various directions can be employed.

Example 4-5

Figure 68:
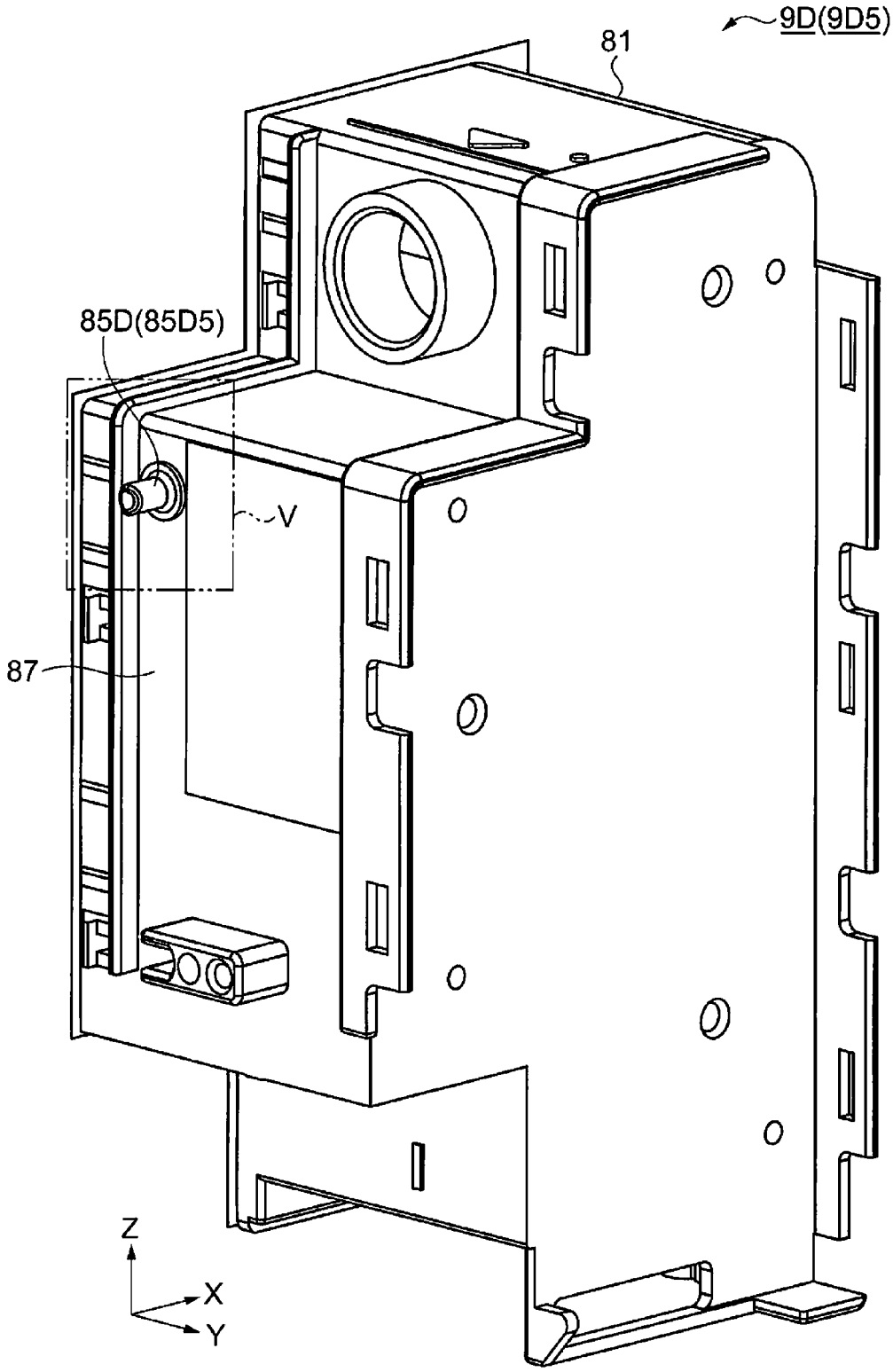
FIG. 68 is a perspective view showing a tank of Example 4-5.
Figure 69:
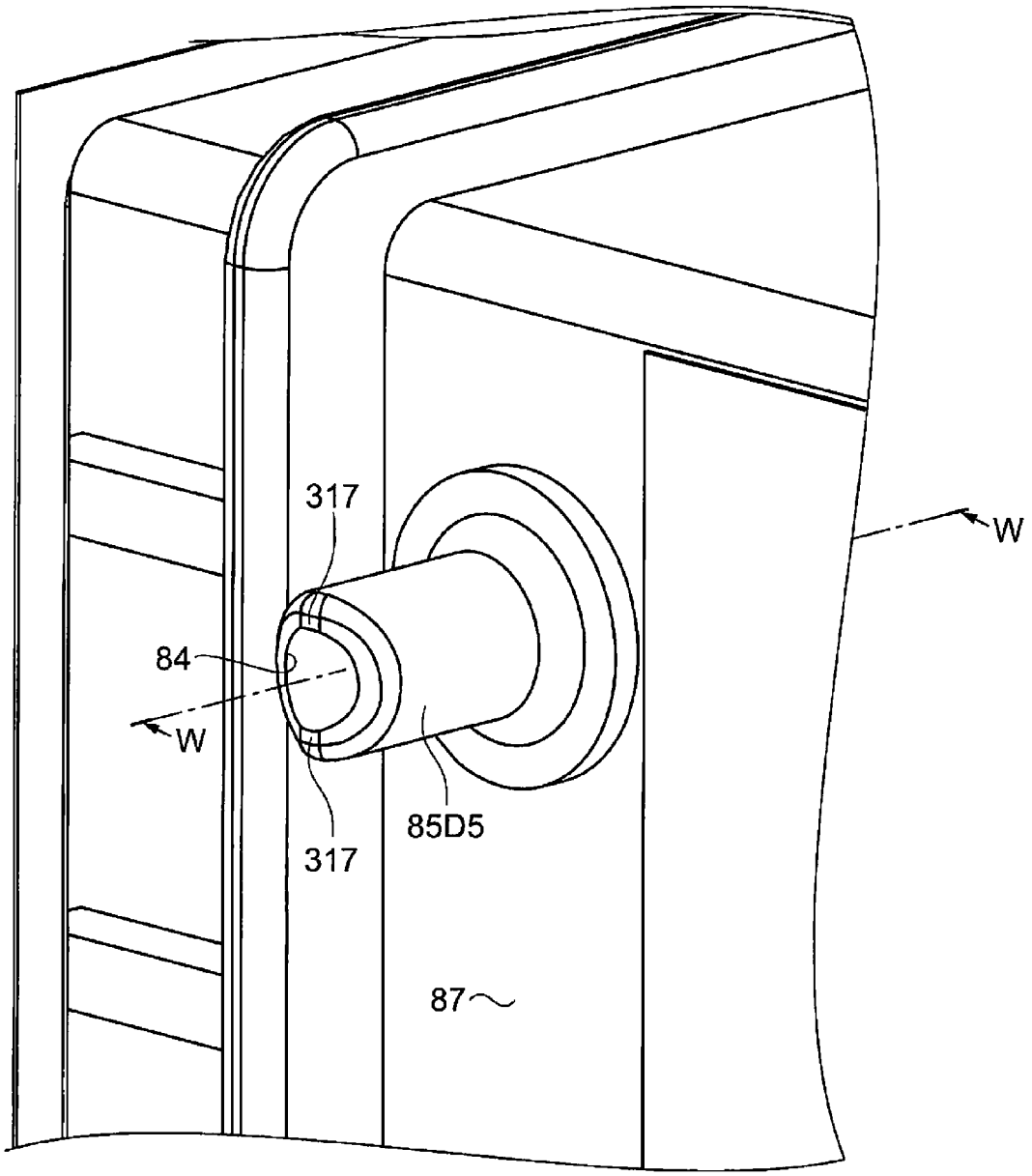
FIG. 69 is an enlarged view of a part V in FIG. 68.
Figure 69:
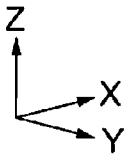
Figure 70:
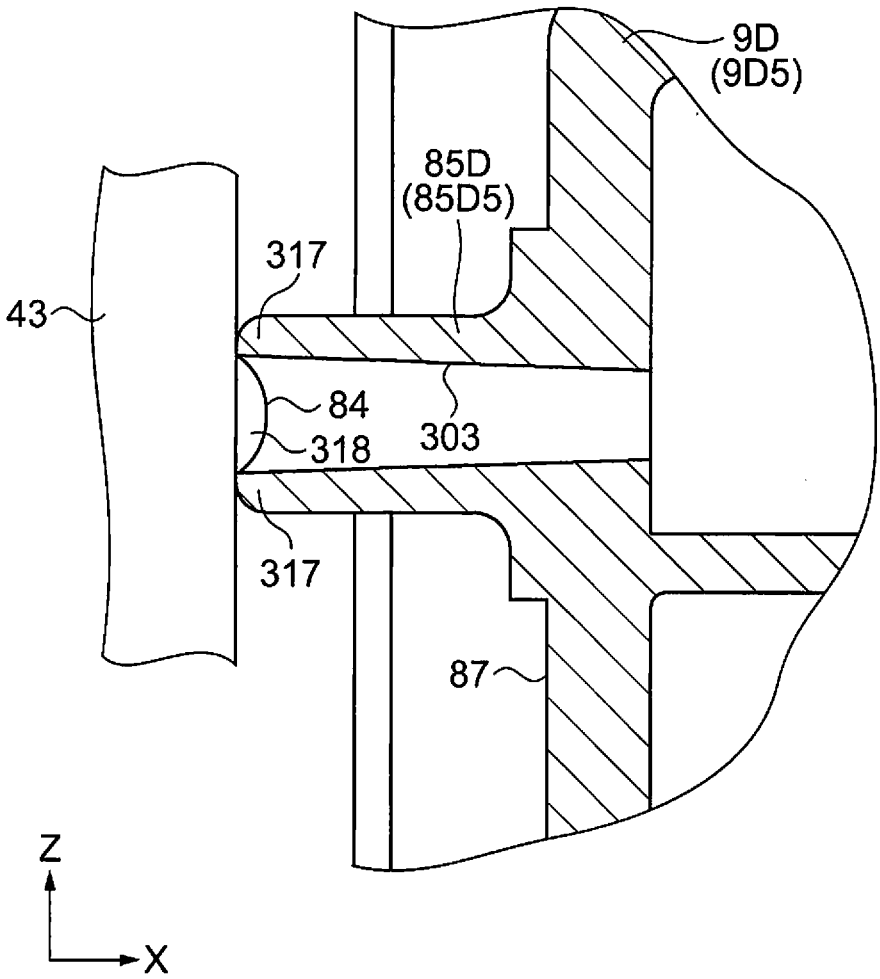
FIG. 70 is a cross-sectional view of W-W line in FIG. 69.

The tank 9D5 of Example 4 to 5, as shown in FIG. 68, includes a vent portion 85D5. At the vent portion 85D5, as shown in FIG. 69 which is an enlarged view of a part V in FIG. 68, a plurality of projections 317 protruding towards the opposite side of the side wall 87 from an end of the vent portion 85D5 are provided. The plurality of projection section 317, as shown in FIG. 70 which is a cross-sectional view of W-W line in FIG. 69, protrudes to the −X axis direction further than an edge of the vent 84. For this reason, even if the supply tube 43 overlaps the vent 84, the opening 318 is maintained between the plurality of projections 317. In other words, for the opening 318, the vent channel 303 of the vent portion 85D5 communicates with the outside air via the opening 318 which opens to a different direction from the −X axis direction being protruding direction of the vent portion 85D5. With this, the inside of the tank 9D5 communicates with the outside air. For this reason, it is easier to maintain the pressure inside the tank 9D5 at the outside air pressure, it is easier to prevent lowering the printing function. Thus, it is easier to maintain the reliability of the liquid ejection system 1. The number of the projection section 317 can be one, as long as a space is ensured when the supply tube 43 overlaps the vent 84.

The vent channel 303 in Example 4-1, Example 4-2, Example 4-3, and Example 4-5, as shown in FIGS. 58, 61, 64, and 70, is tapered in getting narrower in a direction from the outside to the inside of the tank 9D. With this, even in a case in which the ink from the inside of the tank 9D flows into the vent portion 85D, because the ink is easily led to a narrower side of the vent channel 303 due to the capillary phenomenon, it is easier to avoid the leakage of the ink to the outside from the vent portion 85D. By the way, in these examples, the vent channel 303 corresponds to a tapered portion.

Figure 71:
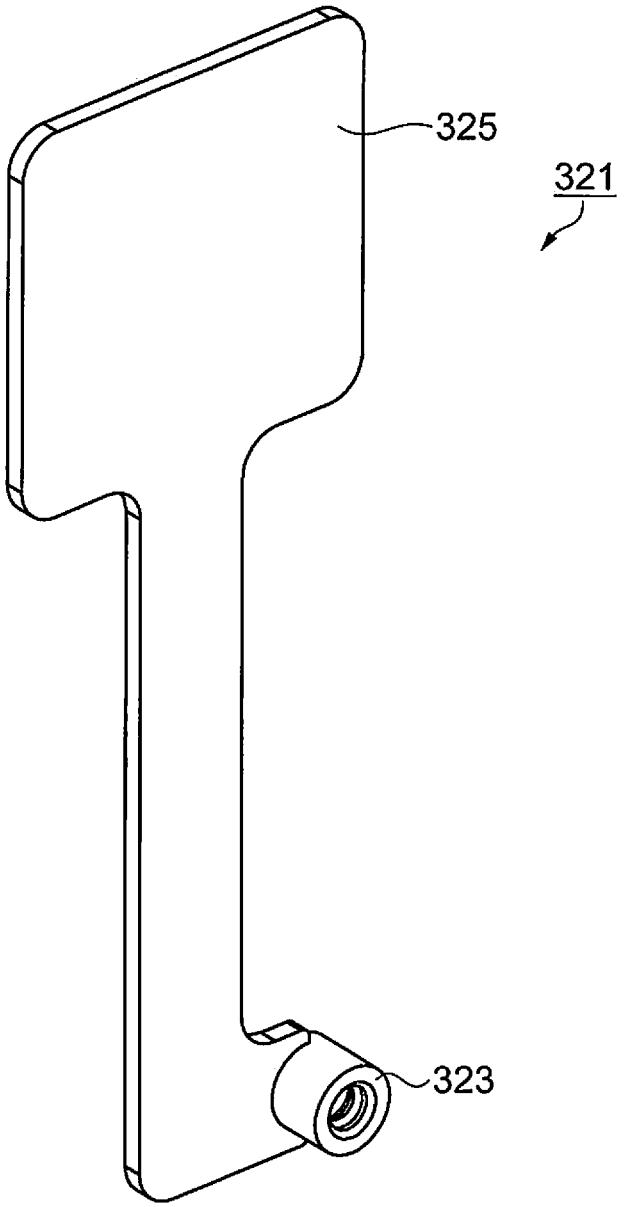
FIG. 71 is a perspective view showing a cap member of the present embodiment.
Figure 72:
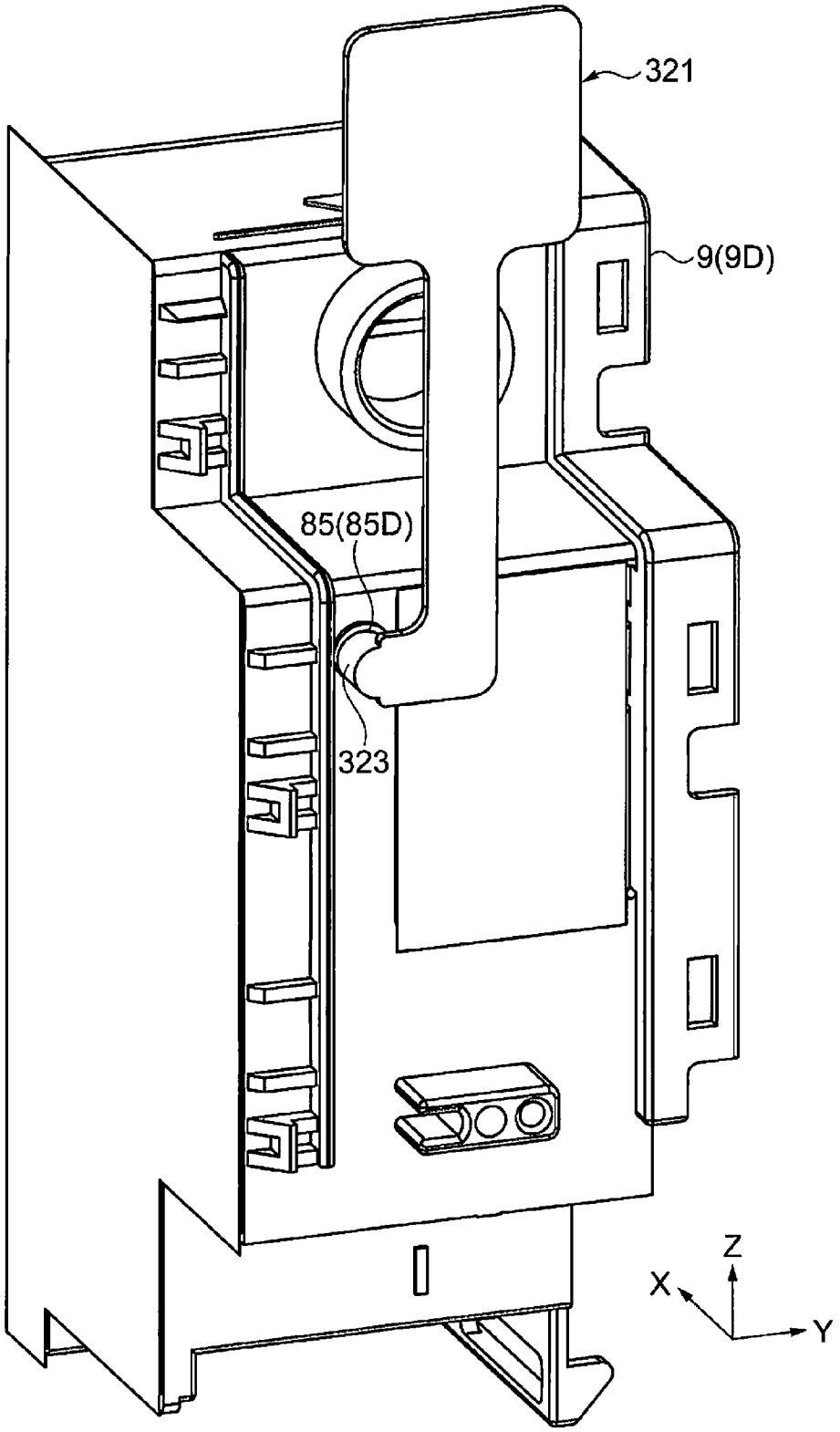
FIG. 72 is a perspective view showing a tank and the cap member of the present embodiment.

On the tank 9, the tank 9A, the tank 9B, and the tank 9D of Example 1-Example 4, a cap member 321 (FIG. 71) which is attachable to and detachable from the vent portion 85 or the vent portion 85D is provided. The cap member 321, as shown in FIG. 71, includes a cap section 323 and a knob section 325. The cap section 323, as shown in FIG. 72, can be coupled to the vent portion 85 or the vent portion 85D. It is possible to close the vent 84 by the cap section 323 by equipping the cam member 321 to the vent portion 85 or the vent portion 85D. With this, it is possible to render the ink difficult to evaporate from the vent 84. The operator or the user, in a state of pinching the knob section 325 of the cap member 321, can remove the cap member 321 from the tank 9 or the tank 9D by pulling the cap member 321 off in the Z axis direction.

In each of Example 4-1, Example 4-2, Example 4-3, and Example 4-5, the cap member 321 is can be equipped to the vent portion 85D (85D1, 85D2, 85D3, 85D5). When the cam member 321 is equipped to the vent portion 85D1 (FIG. 57), the opening 301 is closed by the cap section 323. When the cap member 321 is equipped to the vent portion 85D2 (FIG. 61), opening 307 between the two projections 305 is closed by the cap section 323. When the cam member 321 is equipped to the vent portion 85D3 (FIG. 64), the opening 311 formed by the notch 309 is closed by the cap section 323. When the cap member 321 is equipped to the vent portion 85D5 (FIG. 70), the opening 318 between the two projections 317 is closed by the cap section 323. Therefore, even in Example 4-1, Example 4-2, Example 4-3, and Example 4-5, it is possible to render the ink difficult to evaporate from the vent portion 85D.

Figure 73:
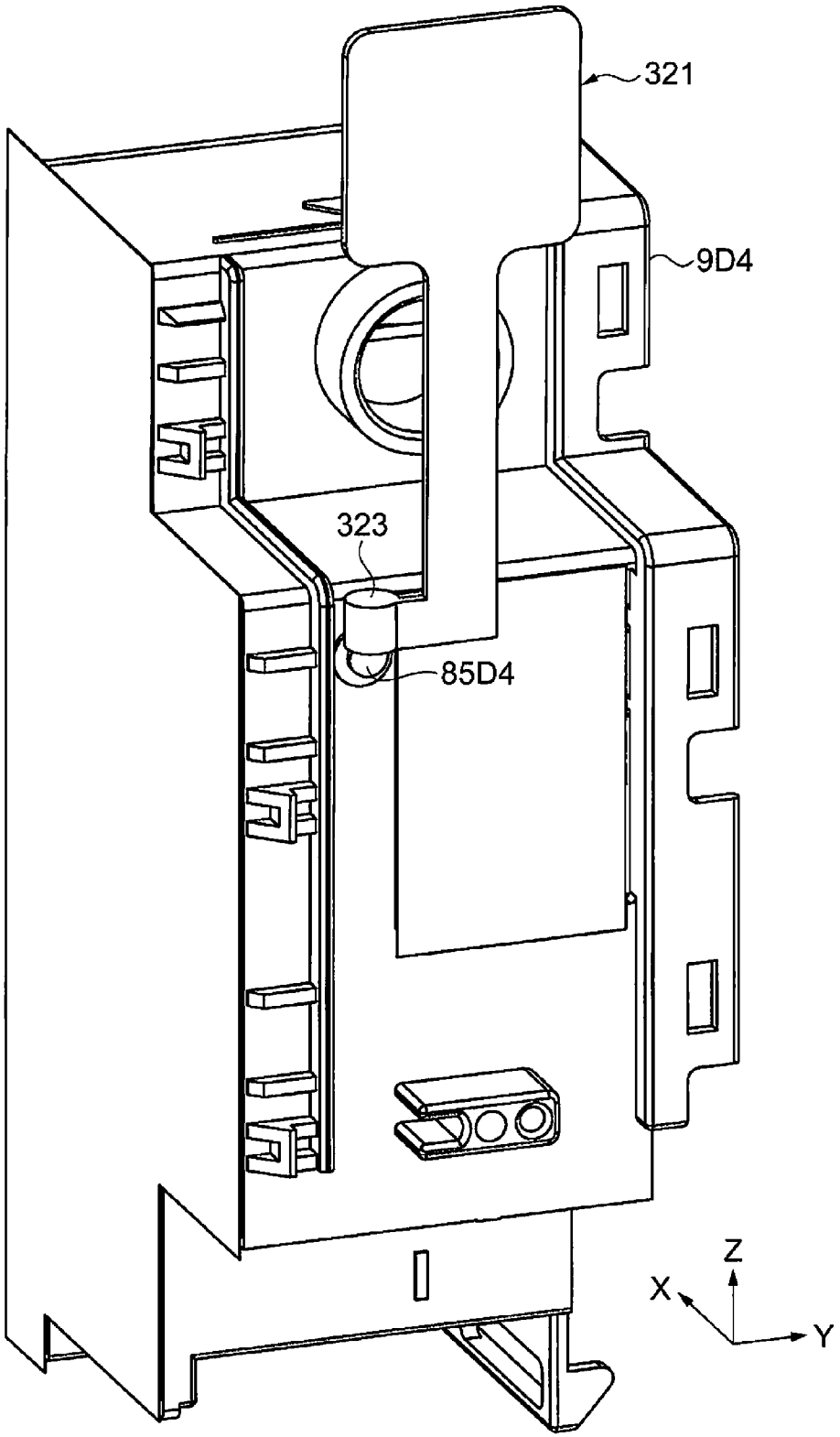
FIG. 73 is a perspective view showing a tank and a cap member of Example 4-4.

The cam member 321 applicable for the tank 9D4 of Example 4-3, as shown in FIG. 73, has an arrangement in which the cap section 323 is oriented in the −Z axis direction. With this, it is possible to equip the cam member 321 to the tank 9D4 by coupling the cap section 323 with the extension portion 313 (FIG. 66). With this, even for the tank 9D4, it is possible to render the ink difficult to evaporate from the vent 84. The operator or the user, in a state of pinching the knob section 325 of the cap member 321, can remove the cap member 321 from the tank 9D4 by pulling the cap member 321 off in the Z axis direction.

In the examples above, the liquid ejection device can be a liquid ejection device ejecting, applying, and consuming liquid other than ink. The state of liquid being ejected as a small amount of a droplet from the liquid ejection device includes a granular state, a tear-drop state, and a thread state which threads. The liquid here can be a material to be consumed by the liquid ejection device. For example, it is fine to be in a state in which a substance is in phase change, and includes body of fluid, such as liquid body with high or low viscosity, sol, gel water, other inorganic solvent, organic solvent, solution, liquid resin, and liquid metal (metallic melt). Further, not only liquid as a state of substance, but also things in which particles of functional materials are dissolved in solvent, dispersed, or mixed are included, where the functional materials are made of solid materials such as pigments or metallic grains. A typical example of the liquid can be liquid crystal or the like other than the ink which is mentioned above in each of the examples. Here, the ink includes various liquid compositions, such as ordinary aqueous ink and oil ink, as well as gel ink, and hot-melt ink. Specific examples of the liquid ejecting device, for example includes a liquid crystal display, an EL (electroluminescence) display, a plane emission display, and a liquid ejection device ejecting liquid including an electrode material used for manufacturing color filters, or a dispersed or dissolved material such as a color material or the like. Also, it can be a liquid ejection device ejecting bioorganic substance used for biochip fabrication, a liquid ejection device ejecting liquid as a sample used for precise pipette, printing device, a micro-dispenser, or the like. Further, it can be a liquid ejection device ejecting lubricant pinpoint to precision machines such as a timepiece or a camera, or a liquid ejection device ejecting transparent resin solution onto a substrate which is used for optical communication element or the like. Further, it can be a liquid ejection device ejecting etching solution of acid, alkali, or the like for etching a substrate.

In the conventional liquid ejection system, an air inlet (vent) is provided in the tank. The air inlet is an opening capable of introducing air inside the tank. When the ink inside the tank is consumed, a pressure inside the tank becomes lower than the air pressure outside. At this time, because the air is introduced to the inside of the tank from the air inlet, the pressure inside the tank is easily maintained at the air pressure outside.

Also, for the liquid ejection system, a tube for leading the ink to the ejection head from the tank is provided to be long enough in order to correspond the change of the posture from the using posture to the injecting posture. In other words, when the tank is in the using posture, the tube has a slack. With this, when the tank changes the posture, it is possible to reduce an external force being applied to the tube. As a result, when the tank changes the posture, it is possible to prevent the tube from being pulled or being collapsed. When the tank is in the using posture, the slack of the tube is stored between the tank and the liquid ejection device.

In this manner, in the liquid ejection system, because the tube has the slack when the tank is in the using posture, there may be a case in which the slack of the tube covers the air inlet, when the tank is changed to the injecting posture or changed to the using posture. When the slack of the tube covers the air inlet, the air inlet is blocked by the tube. When things like this happen, because the air is difficult to be introduced to the inside of the tank, and because the pressure inside the tank is decreased, the ink in the tank is difficult to be supplied to the ejection head. As a result of this, because the printing is easily impeded, the liquid ejection system does not function properly; therefore, it is possible that reliability of the liquid ejection system is impaired. Therefore, there is a problem that it is difficult for the conventional liquid storing container or the liquid ejection system to increase the reliability.

The present invention is conceived to solve at least a part of the above mentioned problems, and is realized in embodiments or examples below.

A liquid storing container according to the embodiment is adapted to supply liquid to a liquid ejection section configured and arranged eject the liquid. The liquid storing container includes a liquid storage chamber, a liquid supply opening, and a vent portion. The liquid storage chamber is configured and arranged to store the liquid. The liquid supply opening communicates with the liquid storage chamber, and configured and arranged to be connected to a tube which is connected to the liquid ejection section. The vent portion communicates with the liquid storage chamber to introduce air to the liquid storage chamber. The vent portion protrudes from a side wall of the liquid storing container. The vent portion has an opening facing in a direction different from a protruding direction of the vent portion.

With this example of the liquid storing container, because the opening is arranged on the vent portion to face in a direction different from the protruding direction, even if the tube comes into contact with the vent portion, it is easier to avoid covering the opening by the tube. For this reason, even if the tube is in contact with the vent portion, introducing the air to the inside of the liquid storage chamber is not impeded. In other words, even if the tube is in contact with the vent portion, it is easier to maintain communication between the liquid storage chamber and the outside air. As a result, it is easier to maintain supplying the liquid to the liquid ejection section well. Therefore, the reliability of the liquid storing container is enhanced.

With the liquid storing container, the opening of the vent portion is preferably disposed on a side part of the vent portion.

With this example, even if the tube is in contact with the vent portion in the protruding direction, it is possible to maintain the communication between the liquid storage chamber and the outside air via the opening arranged on the side part of the vent portion.

With the liquid storing container, the vent portion preferably includes a plurality of projections on an end of an opposite side to the side wall, the plurality of projections protruding from the end towards the opposite side to the side wall, and a space between the plurality of the projections preferably defines the opening.

With this example, even if the tube is in contact with the vent portion in the protruding direction, because the tube abuts the projections, it is possible to maintain the communication between the liquid storage chamber and the outside air via the opening being the space between the projections.

With the liquid storing container, the vent portion preferably includes an extension portion on an opposite side to the side wall, the extension portion extending in a direction different from the projecting direction, and the opening is disposed at an end of the extension portion.

With this example, even if the tube is in contact with the vent portion in the protruding direction, it is possible to maintain the communication between the liquid storage chamber and the outside air via the opening arranged at the extension portion extending in a direction different from the protruding direction.

With the liquid storing container, the vent portion preferably includes a vent channel as a passage for the air, and the vent channel includes a tapered portion tapered as becoming narrower towards inside from the outside.

With this example, even in a case in which the ink from the liquid storage chamber flows into the vent portion, because the ink is easily led to a narrower side of the vent channel due to the capillary phenomenon, it is easier to avoid the leakage of the ink to the outside from the vent portion.

With the liquid storing container, the vent portion preferably includes a cap member which is attachable and detachable, and when the cap member is attached to the vent portion, the opening is covered from the outside by the cap member.

With this example, because the cap member can cover the opening, it is possible to render the liquid in the liquid storage chamber difficult to evaporate from the vent portion, and render the leakage of the liquid difficult from the vent portion to the outside.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid supply device adapted to supply liquid to a liquid ejection section configured and arranged to eject the liquid, the liquid supply device comprising:

a plurality of liquid storage sections configured and arranged to store the liquid; and a plurality of tubes connected to the liquid storage sections so that the liquid stored in the liquid storage sections flows out through the tubes, at least one of the tubes being respectively connected to a corresponding one of the liquid storage sections, at least one of the liquid storage sections including a support section supporting at least two of the tubes in a state in which one of the at least two of the tubes is located vertically above another one of the at least two of the tubes in an area in which the at least two of the tubes are supported by the support section, the support section including a joint section configured and arranged to couple the plurality of tubes with a plurality of extension tubes, respectively, via respective through-holes provided in the joint section, the joint section including a plurality of first fitting sections provided on a first side of the joint section and a plurality of second fitting sections provided on a second side of the joint section, the through-holes communicating with the first fitting sections and the second fitting sections, the plurality of tubes being different in diameters from the plurality of extension tubes, with the plurality of tubes being fitted onto the first fitting sections, respectively, and the plurality of extension tubes being fitted onto the second fitting sections, respectively, and a width of each of the first fitting sections and a width of each of the second fitting sections being different to each other.

2. The liquid supply device according to claim 1, wherein the support section is attachable to and detachable from the at least one of the liquid storage sections.

3. The liquid supply device according to claim 1, wherein the support section includes a plurality of openings configured and arranged to insert the plurality of tubes thereinto, and the support section supports the plurality of tubes inserted into the opening.

4. The liquid supply device according to claim 3, wherein at least one of the openings is constituted by a notch.

5. The liquid supply device according to claim 1, wherein the one surface is a bottom surface of the at least one of the liquid storage sections, and the support section supports the at least two of the tubes in a state in which the at least two of the tubes are aligned in a vertical direction.

6. The liquid supply device according to claim 1, further comprising an opening/closing section configured and arranged to open and close flow passages of the plurality of tubes, the opening/closing section being provided closer to the liquid ejection section than the support section.

7. The liquid supply device according to claim 1, wherein the first fitting sections are apart from each other, and the second fitting sections are apart from each other.

8. An ink-jet printer comprising:

an ink ejection head;

an ink tank configured and arranged to store ink to be supplied to the ink ejection head;

a plurality of tubes connected to the ink tank so that the liquid stored in the ink tank flows out through the tubes, each of the tubes including a first tube portion configured and arranged to supply ink to the ink ejection head and a second tube portion connected to the ink tank; and a support member connecting the first tube portion and the second tube portion, the support member supporting at least two of the tubes in a state in which one of the at least two of the tubes is located vertically above another one of the at least two of the tubes in an area in which the at least two of the tubes are supported by the support member, the support member including a joint section configured and arranged to couple the first tube portions with the second tube portions, respectively, via respective through-holes provided in the joint section, the joint section including a plurality of first fitting sections provided on a first side of the joint section and a plurality of second fitting sections provided on a second side of the joint section, the through-holes communicating with the first fitting sections and the second fitting sections, the first tube portions being different in diameters from the second tube portions, with the first tube portions being fitted onto the first fitting sections, respectively, and the second tube portions being fitted onto the second fitting sections, respectively, and a width of each of the first fitting sections and a width of each of the second fitting sections being different to each other.

9. The ink-jet printer according to claim 8, wherein each of the first fitting section and each of the second fitting section are provided to face each other in an axis direction of each of the through-hole.

10. The ink-jet printer according to claim 8, wherein the support member is configured and arranged to be attached to a wall of the ink tank.

11. The ink-jet printer according to claim 10, wherein the support member is attachable to and detachable from the wall of the ink tank.

12. The ink-jet printer according to claim 8, wherein each of the through-hole has a first opening on the first fitting section side and a second opening on the second fitting section side, and a diameter of the first opening and a diameter of the second opening are different to each other.

13. The ink-jet printer according to claim 10, wherein the support member is configured and arranged to support the plurality of tubes in a direction intersecting the wall of the ink tank.

14. The ink-jet printer according to claim 13, wherein the support member includes a notch configured and arranged to insert the tubes thereinto.

* * * * *